US007004128B2

(12) United States Patent
Majima et al.

(10) Patent No.: US 7,004,128 B2
(45) Date of Patent: Feb. 28, 2006

(54) CONTROL APPARATUS FOR DEVICE HAVING DEAD BAND, AND VARIABLE VALVE SYSTEM

(75) Inventors: Yoshihiro Majima, Inuyama (JP); Jun Hasegawa, Kariya (JP); Hisashi Iida, Kariya (JP); Masaomi Inoue, Kariya (JP); Hideyuki Maeji, Okazaki (JP); Haruyuki Urushihata, Chiryu (JP); Noriaki Iwase, Chiryu (JP)

(73) Assignee: DENSO Corporation, Kariya (JP)

( * ) Notice: Subject to any disclaimer, the term of this patent is extended or adjusted under 35 U.S.C. 154(b) by 36 days.

(21) Appl. No.: 10/172,496

(22) Filed: Jun. 17, 2002

(65) Prior Publication Data

US 2003/0000489 A1 Jan. 2, 2003

(30) Foreign Application Priority Data

| | | | |
|---|---|---|---|
| Jun. 15, 2001 | (JP) | ..... | 2001-182521 |
| Jul. 18, 2001 | (JP) | ..... | 2001-218091 |
| Mar. 14, 2002 | (JP) | ..... | 2002-069540 |
| May 15, 2002 | (JP) | ..... | 2002-140028 |

(51) Int. Cl.
*F01L 1/34* (2006.01)

(52) U.S. Cl. ..... 123/90.17; 123/90.15; 123/90.16; 361/152; 318/116; 310/317; 137/554

(58) Field of Classification Search ..... 123/90.12, 123/90.15–90.18, 90.31; 74/568 R; 464/1, 464/2, 160; 361/152, 154, 159; 318/116, 318/286, 466; 310/317; 137/554, 487.5, 137/624.13, 624.11, 625.65, 625.64, 596.17
See application file for complete search history.

(56) References Cited

U.S. PATENT DOCUMENTS

| | | | | | |
|---|---|---|---|---|---|
| 4,364,111 | A | * | 12/1982 | Jocz | 361/175 |
| 4,748,365 | A | * | 5/1988 | Poupaert et al. | 310/316.01 |
| 4,961,441 | A | * | 10/1990 | Salter | 137/14 |
| 5,113,116 | A | * | 5/1992 | Wilson | 310/316.01 |
| 5,261,371 | A | * | 11/1993 | Sumida et al. | 123/339.27 |
| 5,529,034 | A | | 6/1996 | Sone et al. | |
| 5,562,071 | A | | 10/1996 | Urushihata et al. | |
| 5,630,440 | A | * | 5/1997 | Knutson et al. | 137/82 |
| 5,789,880 | A | * | 8/1998 | Iwai et al. | 318/116 |
| 6,023,988 | A | * | 2/2000 | McKee et al. | 74/336 R |
| 6,049,310 | A | * | 4/2000 | Sadahiro | 343/702 |
| 6,061,310 | A | * | 5/2000 | Iida | 369/44.27 |

(Continued)

FOREIGN PATENT DOCUMENTS

JP 7-19073 1/1995

(Continued)

*Primary Examiner*—Thomas Denion
*Assistant Examiner*—Jaime Corrigan
(74) *Attorney, Agent, or Firm*—Nixon & Vanderhye P.C.

(57) ABSTRACT

A control unit employed in a variable valve timing apparatus vibrates a control signal for controlling an oil-pressure control valve. If the vibration center of the duty value of the control signal for driving the oil-pressure control valve lies in a dead band, the vibration takes the duty value to the outside of the dead center temporarily. Thus, even if the center value of the control signal lies in the dead band, the valve timing of the oil-pressure control valve changes with variations in control signal. As a result, the width of the dead band appears small or to have a value of zero. Accordingly, the response characteristic of variations in valve timing to the variations in control signal is improved. The vibration of the control signal is also effective for detection of a width of the dead band.

33 Claims, 37 Drawing Sheets

U.S. PATENT DOCUMENTS

| | | | | |
|---|---|---|---|---|
| 6,390,044 | B1 * | 5/2002 | Yoshizawa et al. | 123/90.17 |
| 6,431,131 | B1 * | 8/2002 | Hosoya et al. | 123/90.15 |
| 6,574,544 | B1 * | 6/2003 | Yoshizawa et al. | 701/102 |
| 2001/0013324 | A1 * | 8/2001 | Yoshizawa et al. | 123/90.16 |

FOREIGN PATENT DOCUMENTS

| | | |
|---|---|---|
| JP | 8-109840 | 4/1996 |

* cited by examiner

| Tw (°C) | -10 | 0 | 20 | 40 |
|---|---|---|---|---|
| KT (s) | 50 | 40 | 30 | 30 |

| Tw (°C) | -10 | 0 | 20 | 40 |
|---|---|---|---|---|
| KNE (rpm) | 90000 | 60000 | 45000 | 45000 |

FIG. 52

| Tw (°C) | -10 | 0 | 20 | 40 |
|---|---|---|---|---|
| KGA (g/s) | 900 | 600 | 450 | 450 |

FIG. 53

| Tw (°C) | -10 | 0 | 20 | 40 |
|---|---|---|---|---|
| KPM (mmHg) | 12000 | 9000 | 6000 | 6000 |

FIG. 54

| Tw (°C) | -10 | 0 | 20 | 40 |
|---|---|---|---|---|
| KOIL (L) | 15 | 13 | 10 | 10 |

CONTROL APPARATUS FOR DEVICE HAVING DEAD BAND, AND VARIABLE VALVE SYSTEM

CROSS REFERENCE TO RELATED APPLICATION

This application is based on Japanese Patent Applications No. 2001-182521 filed on Jun. 15, 2001, No. 2001-218091 filed on Jul. 18, 2001, No. 2002-69540 filed on Mar. 14, 2002, and No. 2002-140028 filed on May 15, 2002, the contents of which are incorporated herein by reference.

BACKGROUND OF THE INVENTION

1. Field of the Invention

The present invention relates to a control apparatus for a device having a dead band. In the dead band, the device is not responsive fully or substantially to an input. That is, the device has non-linear characteristics. The present invention also relates to a variable valve timing system that has a malfunction-determining means.

2. Description of Related Art

A control system has a configuration for controlling a control object to a target state. In the case of a control object having a dead band, however, the response of the control object is non-linear so that it is difficult to realize both a fast response and control stability at the same time. It is particularly hard to control such a control object in areas in close proximity to boundaries of the dead band.

As an example of such a control object, a variable valve timing apparatus is known. JP-A No. H7-19073, JP-A No. H8-74530 and JP-A No. H8-109840 each disclose a variable valve timing apparatus for changing a valve timing of an engine. As an apparatus similar to such a variable valve timing apparatus, there is known a variable valve timing apparatus for changing a variable quantity of an intake valve and/or a variable quantity of an exhaust valve. Examples of the variable quantity are at least one of a valve timing, a lift magnitude, a working angle, and a combination of them. These apparatus are useful for, among others, increasing an output, reducing the amount of consumed fuel and decreasing exhaust emission.

Each of these apparatus typically employs an oil-pressure control valve such as a 3-port 3-position valve. As shown in FIG. 26A, a dead band exists in the middle of a characteristic. In this dead band, the response of an oil flow rate is very slow or there is all but no response even if a duty value Duty is changed. For this reason, a dead band DB appears also in the changing speed of a valve timing as shown in FIG. 26B. This dead band DB appears in an area in close proximity to a holding duty value Dh for holding a valve timing. FIGS. 26A and 26B are each a diagram showing a plurality of responses each obtained for an oil temperature. A solid line represents a response for an oil temperature of 80 degrees Celsius. A single-dotted line represents a response for an oil temperature of 20 degrees Celsius and a double-dotted line represents a response for an oil temperature of −10 degrees Celsius. The plus direction of the vertical axis of FIG. 26B represents advancing while the minus direction represents retarding. As shown in FIG. 26B, the width of the dead band DB changes in accordance with the temperature of oil.

As is obvious from the characteristics shown in FIGS. 26A and 26B, when the duty value Duty is changed from the holding duty value Dh in the advance or retard direction, the response of the valve timing is slow due to the dead band.

In order to compensate the characteristic for the slow response, the duty value is corrected by using a feedback loop. With such correction, however, it is feared that an excessive response is resulted in right after a departure from the dead band.

In addition, since the apparatus utilizes engine oil, a delay time increases due to a decrease in oil pressure. Typically, the oil pressure decreases at a low temperature or when the revolution speed of the engine is low. Variations in delay time serve as a hindrance to the function of a means for determining whether the apparatus is normal or abnormal. JP-A No. H7-127407 discloses an apparatus, which operates to inhibit the determination of an abnormality when the discharge pressure of an oil pump drops to a level equal to or lower than a predetermined value.

After a long stopped state of the engine or after oil replacement, however, oil is inevitably lost from an oil-pressure circuit in some cases. In such a case, it takes more time to fill up the oil-pressure circuit with oil even if the discharge pressure of the oil pump has reached the predetermined value. Thus, during that time, the variable valve apparatus is not capable of responding normally. In consequence, with the disclosed technologies, it is quite within the bounds of possibility that a response delay caused by the loss of oil is determined incorrectly to be an abnormality of the variable-valve apparatus in spite of the fact that the apparatus itself operates normally.

SUMMARY OF THE INVENTION

It is thus an object of the present invention to provide a control apparatus capable of improving the response characteristic of a control object having a dead band.

It is another object of the present invention to provide a control apparatus capable of improving the response characteristic of a variable valve apparatus.

It is a further object of the present invention to provide a variable valve system capable of determining whether an abnormality exists with a high degree of reliability.

It is a still further object of the present invention to provide a variable valve system capable of determining whether an abnormality exists with a high degree of reliability on the basis of a response characteristic of a variable valve apparatus.

In order to achieve the objects described above, it is necessary to provide a plurality of characteristics, some of which are explained in later descriptions of embodiments. These embodiments have the following characteristic.

In an embodiment of the present invention, a vibration means vibrates a control signal at a predetermined amplitude. As a result, effects of the dead band can be suppressed.

Typically, the control signal is vibrated at an amplitude in a range extending over both the dead band and areas outside the dead band. When the control signal is changed from a value inside the dead band to a value outside the dead band, a response can be obtained by varying magnitude of the control signal extending beyond the dead band to accompany a change in control signal. The magnitude of the control signal may be set at a value greater than half the width of the dead band. Even if the center of the vibration of the control signal is in close proximity to the center of the dead band, the control signal may go beyond the dead band temporarily due to the vibration. Thus, even if the control signal is changed from a location in close proximity to the center of the dead band, a predetermined response characteristic can be obtained. As an alternative, the amplitude of the control signal may be set at a value smaller than half the width of the dead band.

In the case of a variable valve apparatus adopting the oil-pressure driving technique for controlling at least one of valve variable quantities of an intake and exhaust valves of an engine, a dead band exists as shown in FIG. 26B. The valve variable quantities include a valve timing, a lift magnitude and a working angle. In such a variable valve apparatus, a control signal for controlling an oil-pressure control valve is vibrated at a predetermined amplitude to improve responsiveness.

For example, a valve variable quantity such as a valve timing can be converged to a target value with a good response characteristic. As a result, it is possible to prevent drivability from deteriorating and exhaust emission from worsening.

As shown in FIGS. 26A and 26B, the width of the dead band varies due to changes in oil viscosity, which are caused by variations in oil temperature. Accordingly, the amplitude of the control signal may be changed in accordance with a parameter having a correlation with the dead band. The amplitude of the control signal can thus be set at an optimum value. Examples of the parameter having a correlation with the dead band are the temperature of the oil and the temperature of the engine or a parameter having correlations with the temperature of the oil and the temperature of the engine. Examples of the parameter having correlations with the temperature of the oil and the temperature of the engine are the temperature of the cooling water of the engine and the lapse of time since a start of the engine. In addition, it is also possible to use the pressure of the oil, the engine revolution speed that changes the pressure of the oil or a parameter having correlations with the pressure of the oil and the revolution speed of the engine.

The magnitude of the control signal may also be changed in accordance with the position of the vibration center of the control signal with respect to the dead band. In this way, it is possible to improve the responsiveness in an area inside the dead band or areas in close proximity to the dead band as well as to sustain the stability in areas outside the dead band.

The amplitude of the control signal may also be corrected so as to converge a valve variable quantity to a target value. By correcting the amplitude in this way, the convergence of the valve variable quantity and the stability in areas in close proximity to the dead band can be improved.

The control apparatus can be designed into a configuration for finding a width of the dead band by carrying out a learning process. For example, a width of the dead band can be found by monitoring variation of a valve variable quantity accompanying the vibration of the control signal. When the vibration of a valve variable quantity is started in a process of increasing the amplitude of the control signal, for instance, the magnitude of the control signal observed at that point of time shows a width of the dead band. If the vibration of a valve variable quantity ceases in a process of decreasing the amplitude of the control signal, on the other hand, the magnitude of the control signal observed at that point of time also shows a width of the dead band. As a result, even if the width of the dead band varies, by observing the variations in dead-band width in a learning process, control can be executed with a high degree of precision according to the actual width of the dead band.

The amplitude of the control signal may be corrected so that a valve variable quantity changes toward a new target value of the valve variable quantity by at least a predetermined quantity when the target value is changed to the new target value. It is possible to obtain proper responsiveness to a request for a change in target value. A width of the dead band can also be found in a learning process based on the amplitude of the control signal and the position of the center of the vibration, which are observed when the valve variable quantity is changing toward a target value.

The frequency of the vibration of the control signal is set at such a proper value that the flow volume of oil can be changed and excessive vibration of the valve variable quantity can be avoided. The frequency may be varied in accordance with a parameter having a correlation with at least one of the temperature of the oil, the temperature of the engine, the pressure of the oil and the engine revolution speed, which changes the pressure of the oil. In addition, with the valve variable quantity converged to a target value, the vibration of the control signal can be ended.

In one embodiment of the present invention, a control gain is increased when the control signal is within the dead band. As a result, the responsiveness in the dead band can be improved. The control gain may be varied in accordance with a parameter having a correlation with at least one of the temperature of the oil, the temperature of the engine, the pressure of the oil and the engine revolution speed, which changes the pressure of the oil.

With the control signal not vibrated, on the other hand, the responsiveness of the variable valve apparatus changes abruptly when the control signal exceeds the upper or lower limit of the dead band. A width of the dead band may be found in a learning process based on the magnitude of the control signal, which is observed when the responsiveness of the variable valve apparatus changes abruptly.

When the target value of a valve variable quantity changes, the magnitude of the control signal may be varied to offset the change in target value in accordance with the width of the dead band. In this scheme, when the target value of a valve variable quantity changes, the magnitude of the control signal can be immediately varied to a value in an area in close proximity to a boundary of the dead band or an area outside the dead band to offset the change in target value. As a result, responsiveness can be improved. The magnitude of an offset obtained as result of varying the magnitude of the control signal can be set by using the width of the dead band obtained in a learning process or a fixed width determined in advance.

A variable valve apparatus adopting the oil-pressure technique is provided with a function for obtaining a magnitude of the control signal, which is applied to sustain a valve variable quantity at a target value, by carrying out a learning process. The magnitude of the control signal obtained in this way is referred to as a holding control value. Referred to as a holding duty value, a duty value for sustaining the changing speed of the valve variable quantity at all but 0 is typically obtained by carrying out a learning process. The valve variable quantity is controlled by using the learned holding control value as a reference. If a dead band exists, the duty value in the dead band to be obtained by carrying out a learning process becomes indeterminate as shown in FIG. 27A. Thus, a learned value has an error corresponding to the width of the dead band. In order to reduce the magnitude of the error, the learning process can be inhibited when the width of the dead band increases. For example, the width of the dead band increases at a low temperature of the oil. However, this solution has a demerit that the learning process is carried out less frequently. By vibrating the control signal at a proper amplitude, on the other hand, the dead band can be eliminated as shown in FIG. 27B. In this case, as a learned value, it is possible to obtain a point at which the changing speed of the valve variable quantity is 0. Thus, while the control signal is being vibrated, a holding control value is obtained by carrying out a learning process. Once the learning process is completed, the learning process can be inhibited during a predetermined period of time following the completion of the learning process. In this way, it is possible to suppress an error caused by a response delay of the variable valve apparatus. For example, it is possible to provide a period of time, during which the learning process is inhibited, as shown in FIG. 40.

In order to carry out an accurate learning process, the amplitude of the control signal applied during the learning process can be set at a fixed value proper for the learning process. The amplitude of the control signal applied during the learning process may be set at a value according to the width of the dead band, which is estimated on the basis of a parameter having a correlation with the dead band. The amplitude of the control signal applied during the learning process may be set at a value at least equal to half the width of the dead band. The amplitude of the control signal applied during the learning process may be set at a value depending on differences among a plurality of learned values. For example, the amplitude is set at a large value for large differences. The learning process can be carried out when the changing speed of the variable valve apparatus becomes a value equal to or smaller than a predetermined value. This predetermined value can be a variable.

In addition, the center value of the vibration of the control signal or a parameter equivalent to the center value can be found by carrying out a learning process. Furthermore, a learned value may be subjected to a predetermined filtering process.

Moreover, in order to avoid an erroneous learning process, the learning process of a holding control value is prohibited when a valve variable quantity exists in an area, for which it is quite within the bounds of possibility that the valve variable quantity reaches a limit of the controllable range.

In accordance with another embodiment of the present invention, a variable valve timing system has:

a means for determining whether an abnormality exists; and a means for inhibiting determination of whether an abnormality exists till a condition for determination of completion of oil replenishment is satisfied to indicate that an oil pressure for driving a variable valve timing apparatus can be determined to have increased to a level in a proper range after a start of the engine.

As a result, the existence of an abnormality is not determined till the oil-pressure circuit is filled up with oil so that the oil pressure of the oil-pressure circuit increases to a level in the proper range. Thus, erroneous determination can be avoided. As the condition for determination of completion of oil replenishment, it is possible to set a condition, which requires that the lapse of time since a start of the engine shall have exceeded a predetermined criterion value. For example, the engine is started with oil leaking and a time required by the oil pressure to increase to a level in a proper range is measured experimentally. The predetermined criterion value is then set from the measurement data.

As an alternative, as the condition for determination of completion of oil replenishment, it is also possible to set a condition, which requires that the engine speed cumulated after a start of the engine shall have exceeded a predetermined criterion value. The cumulative engine speed is proportional to a cumulative oil flow amount of an oil pump and can thus be used to evaluate the replenishment state of oil in the oil-pressure circuit. A cumulative engine speed can be found by cumulating engine speeds each detected for every unit time.

As another alternative, as the condition for determination of completion of oil replenishment, it is also possible to set a condition, which requires that the intake air volume cumulated after a start of the engine or the intake pressure cumulated after a start of the engine shall have exceeded a predetermined value.

As a further alternative, as the condition for determination of completion of oil replenishment, it is also possible to set a condition, which requires that an oil flow amount of the oil pump cumulated after a start of the engine shall have exceeded a predetermined value.

As a still further alternative, as the condition for determination of completion of oil replenishment, it is also possible to set a condition, which requires that the mileage after a start of the engine shall have exceeded a predetermined value.

The predetermined criterion value used in the determination of whether the condition for determination of completion of oil replenishment is satisfied can be set in accordance with a condition based on at least one of the length of the stopped time of the engine, the temperature of the cooling water and the temperature of intake air. Determination based on the amount of leaking oil and/or the rate of oil replenishment is thus possible.

If an abnormality is detected before the condition for determination of completion of oil replenishment is satisfied, an abnormality can be preliminarily determined to exist, indicating that it is quite within the bounds of possibility that a real abnormality exists. The preliminarily determined abnormality can be used for example in return control after a leaking-oil state. For instance, it can be used as a condition for starting control to gradually change a target valve timing in order to prevent the actual valve timing from varying abruptly when the oil-pressure circuit is filled up with oil.

A system implemented by an embodiment described later is suitable for a system in which a locked state of a lock mechanism is ended and the valve timing is changed right after the engine is started.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 52 shows a table used for finding a predetermined criterion value KGA that is suitable for a cooling-water temperature Tw;

FIG. 53 shows a table used for finding a predetermined criterion value KPM that is suitable for a cooling-water temperature Tw; and FIG. 54 shows a table used for finding a predetermined criterion value KOIL that is suitable for a cooling-water temperature Tw.

PREFERRED EMBODIMENTS OF THE INVENTION

First Embodiment

Figure 1:
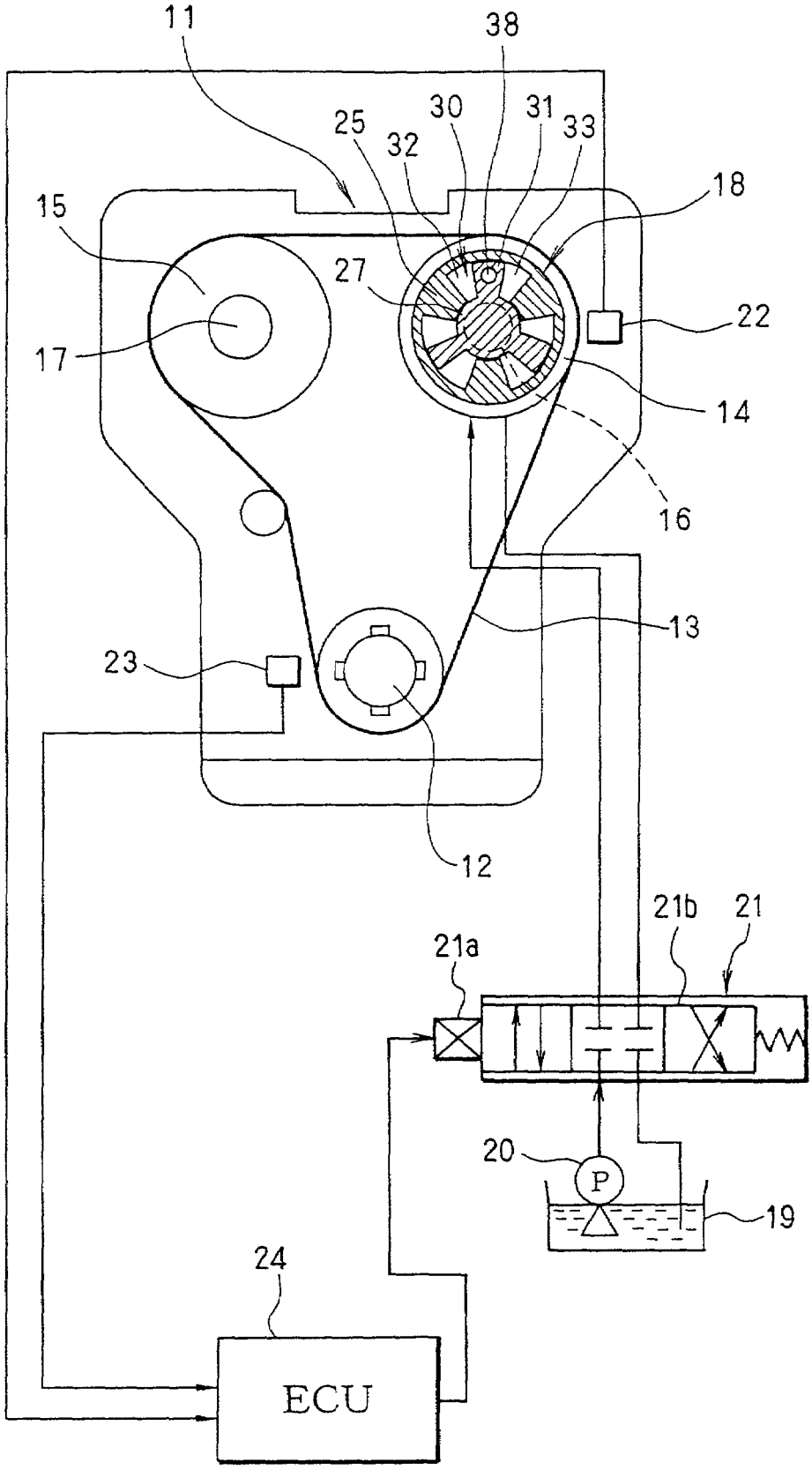
FIG. 1 is a block diagram showing a variable valve timing control system implemented by a first embodiment of the present invention.

By referring to the diagrams, the following description explains a plurality of preferred embodiments of the present invention. It is to be noted that, throughout the following description of the embodiments, an element in a specific embodiment identical with or similar to a counterpart employed in a preceding embodiment is denoted by the same reference numeral as the counterpart in the explanation of the specific embodiment and figures related to the specific embodiment, and the description of the element is not repeated.

Figure 2:
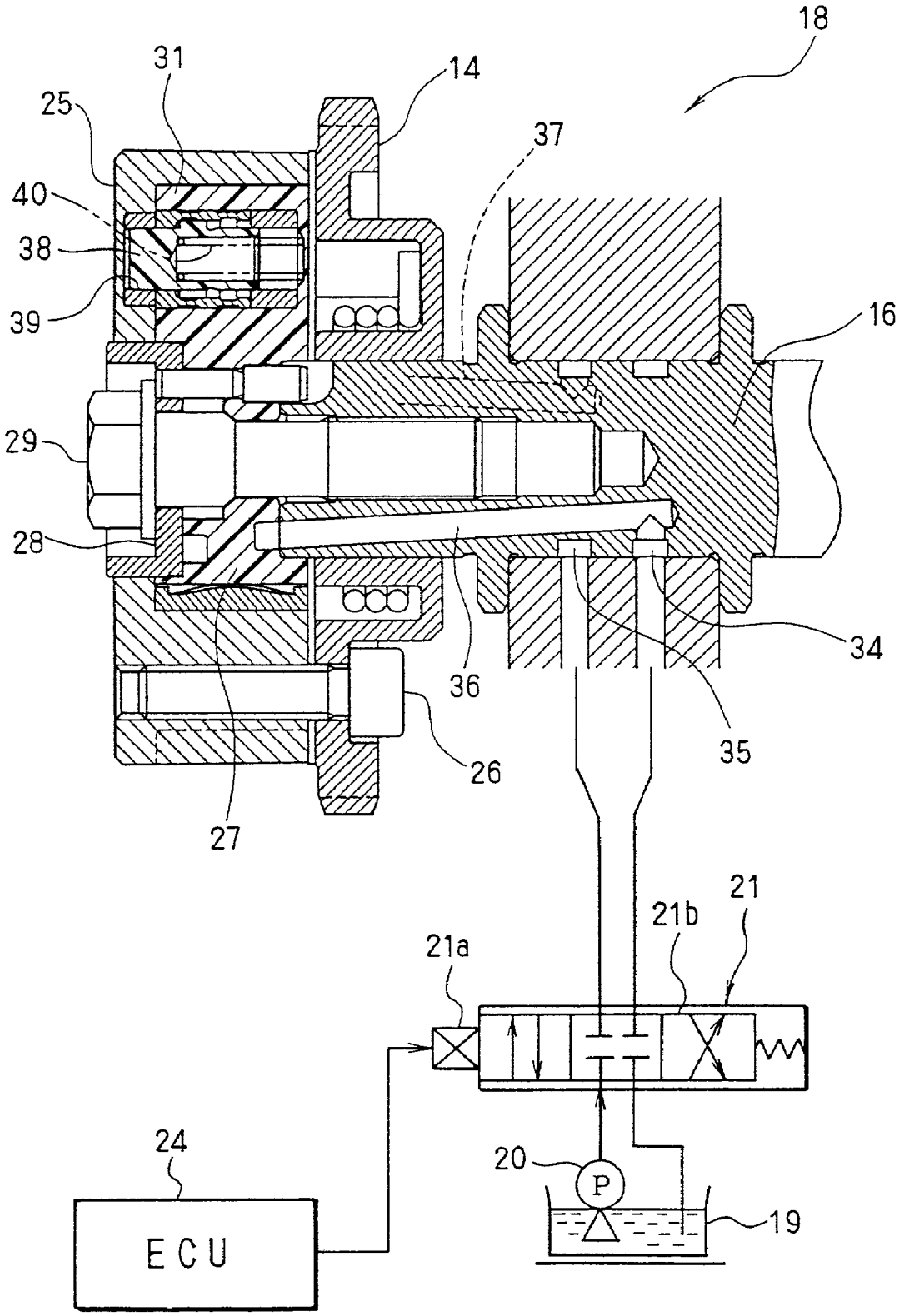
FIG. 2 is a cross-sectional diagram showing the variable valve timing control system implemented by the first embodiment of the present invention.

First of all, the configuration of a variable valve timing control system is explained by referring to FIGS. 1 and 2. An internal combustion engine 11, which is referred to hereafter simply as an engine 11, has an intake-side camshaft 16 and an exhaust-side camshaft 17. A crankshaft 12 is connected to sprockets 14 and 15 by a timing chain (or a timing belt) 13. A power driving the crankshaft 12 is propagated to the intake-side camshaft 16 and the exhaust-side camshaft 17 by way of the sprockets 14 and 15. On the intake-side camshaft 16, there is provided a variable valve timing apparatus 18 for changing the valve timing of an intake valve by varying the rotational phase of the intake-side camshaft 16 relative to the crank shaft 12. An oil pump 20 supplies oil from an oil pan 19 to an oil-pressure circuit of the variable valve timing apparatus 18. On the oil-pressure circuit, there is provided an oil-pressure control valve (OCV) 21 for controlling applications and removals of an oil pressure to and from the oil-pressure circuit in order to adjust the valve timing of the intake valve.

In addition, on the intake-side camshaft 16, there is also provided a cam-angle sensor 22 for generating a cam-angle signal representing one among a plurality of possible cam-angle positions. The cam-angle signal can be used for identifying a cylinder. On the crankshaft 12, there is provided a crank-angle sensor 23 for outputting a crank-angle signal at each predetermined crank angle. The cam-angle signal output by the cam-angle sensor 22 and the crank-angle signal output by the crank-angle sensor 23 are supplied to an engine control circuit 24, which is abbreviated hereafter to an ECU 24. The ECU 24 finds an engine revolution speed from the frequency of the crank-angle signal output by the crank-angle sensor 23.

Furthermore, signals generated by a variety of other sensors not shown in the figures are also supplied to the ECU 24. The other sensors include a throttle sensor, an intake-pressure sensor and a cooling-water-temperature sensor. The ECU 24 controls injection of fuel, ignition and the variable valve timing on the basis of these various input signals. The ECU 24 also controls an oil-pressure control valve 21 in a feedback loop so as to make the actual valve timing of the intake valve match a target valve timing. As a result, the actual camshaft phase of the intake-side camshaft 16 follows a target camshaft phase.

The variable valve timing apparatus 18 has an intermediate lock mechanism. A housing 25 accommodating the variable valve timing apparatus 18 is firmly fixed by using a bolt 26 on the sprocket 14, which is supported in such a way that the sprocket 14 is capable of rotating outside the intake-side camshaft 16 with a high degree of freedom. The rotation of the crankshaft 12 is propagated by the timing chain 13 to the sprocket 14 and the housing 25 so that the sprocket 14 and the housing 25 rotate synchronously with the crank shaft 12. On one edge of the intake-side cam shaft 16, a rotor 27 is firmly fixed by a bolt 29 through a stopper 28. The rotor 27 is accommodated in the housing 25 in such a way that the rotor 27 is capable of rotating with a high degree of freedom relatively to the housing 25. A plurality of fluid chambers 30 is created inside the housing 25. Each of the fluid chambers 30 is divided into an advance chamber 32 and a retard chamber 33 by a vane 31 formed on a circumferential portion of the rotor 27.

Driven by the engine 11, the oil pump 20 pumps up oil from the oil pan 19. The oil is supplied to an advance groove 34 and a retard groove 35, which are provided on the intake-side camshaft 16, by way of the oil-pressure control valve 21. An advance oil path 36 connected to the advance groove 34 is linked to each of the advance chambers 32. A retard oil path 37 connected to the retard groove 35 is linked to each of the retard chambers 33. In accordance with a current supplied to a linear solenoid 21*a*, the oil-pressure control valve 21 drives a valve body 21*b* to continuously change the opening of each oil-pressure port. The oil-pressure control valve 21 is capable of changing over the position of the valve body 21*b* among a position to apply an oil pressure to the advance chamber 32, a position to apply an oil pressure to the retard chamber 33 and a position to apply no oil pressure to the advance chamber 32 and the retard chamber 33. Thus, the oil-pressure control valve 21 is capable of increasing and decreasing the amount of oil supplied to each of the advance chamber 32 and the retard chamber 33.

With an oil pressure raised to a level at least equal to a predetermined value and applied to each of the advance chamber 32 and the retard chamber 33, the vane 31 is held firmly by the oil pressures applied to the advance chamber 32 and the retard chamber 33. The rotation of the housing 25 is propagated to the rotor 27 (the vane 31) though the oil so that the intake-side cam shaft 16 is driven to rotation as an assembled body including the rotor 27.

The vane 31 accommodates a lock pin 38 for locking rotation of the rotor 27 (the vane 31) relative to rotation of the housing 25. The lock pin 38 is engaged with a lock hole 39 provided on the housing 25 so that the valve timing of the intake valve is locked at a lock position in about the middle of an adjustable range of the valve timing. This lock position is set at a proper location at a start of the engine 11. The lock pin 38 is forcibly pressed in a lock direction (or a protruding direction) by a spring 40. Components including the lock pin 38, the lock hole 39 and the spring 40 form a lock mechanism.

With the engine 11 stopped, the spring 40 holds a locked state in which the lock pin 38 is engaged with the lock hole 39. In this locked state, the valve timing of the intake valve is locked at a lock position. Thus, the engine 11 is started in a locked state with the lock pin 38 engaged with the lock hole 39 and, at a point of time the discharge pressure of the oil pump 20 increases to a certain degree, the lock pin 38 is pushed out from the lock hole 39 by the pressure of oil to a position of ending the locked state, terminating the locked state of the lock pin 38.

In a running state of the engine 11, the lock pin 38 is held by the pressure of oil at the locked-state-ending position. At this position, the lock pin 38 is held in a state allowing rotation of the rotor 27 relative to rotation of the housing 25. In this state, the variable valve timing can be controlled.

The ECU 24 controls the oil-pressure control valve 21 employed in the variable valve timing apparatus 18 in a feedback loop so as to make the actual valve timing VT of the intake valve match a target valve timing VTtg. The actual valve timing VT is the actual camshaft phase of the intake-side camshaft 16 and the target valve timing VTtg is a target camshaft phase of the intake-side camshaft 16. This feedback control is typically PD control. A duty value Duty used as a control signal is found on the basis of a holding duty value Dh, which is a duty value Duty for holding a valve timing. A driving signal conveying a duty ratio of the duty value Duty is supplied to the linear solenoid 21*a*.

Figure 26A:
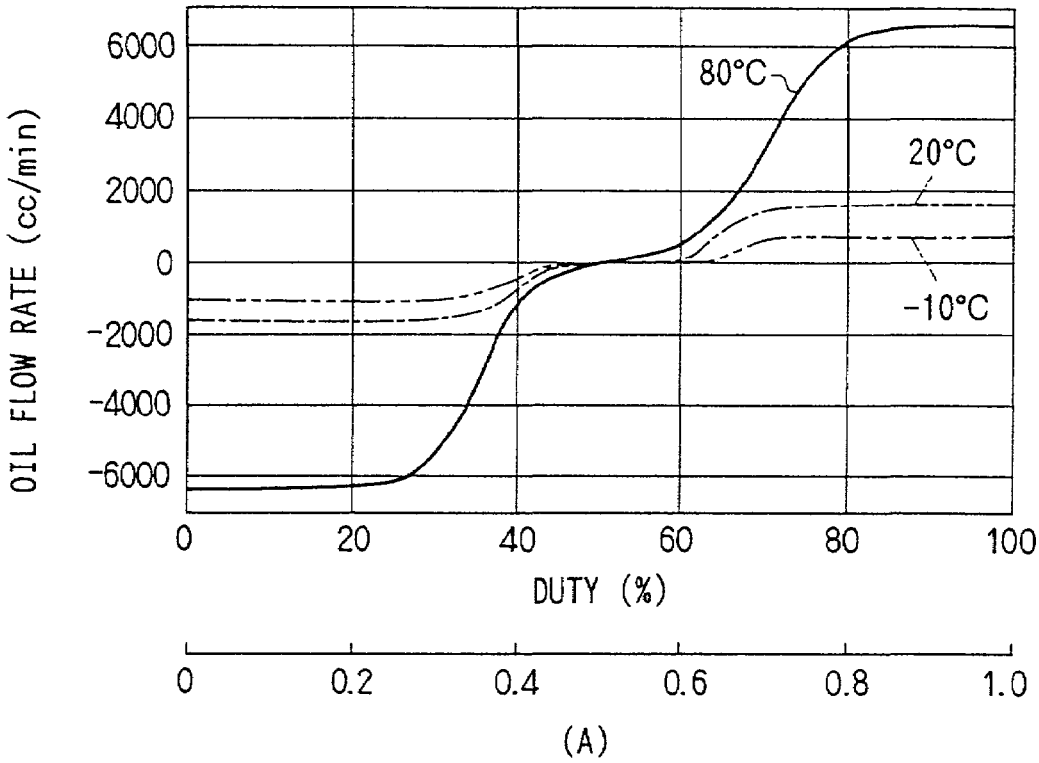
FIG. 26A shows graphs representing control characteristics of an oil-pressure control valve.
Figure 26B:
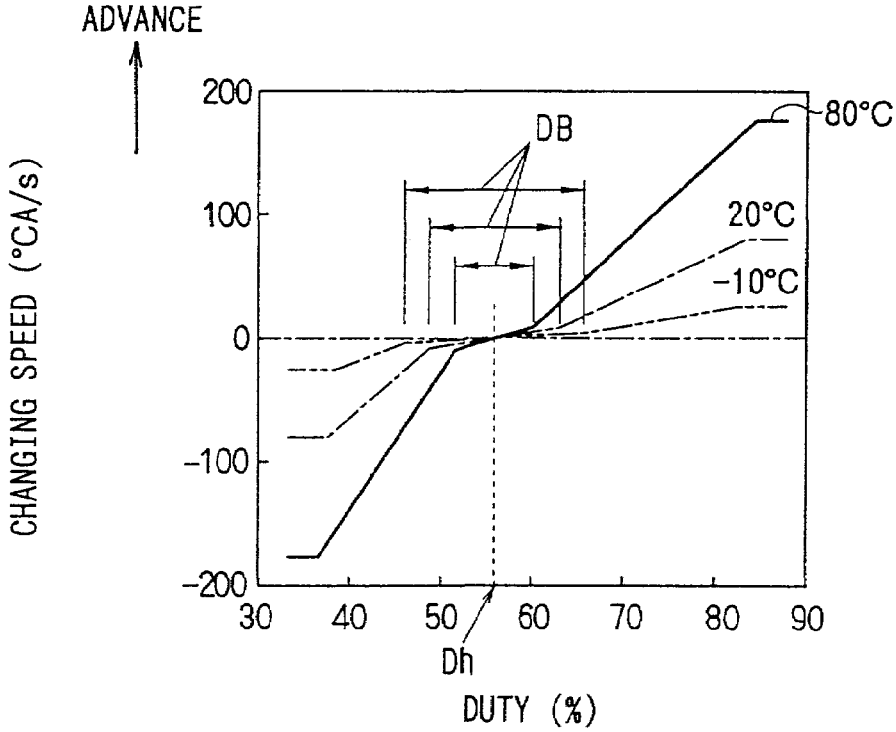
FIG. 26B shows graphs representing control characteristics of a variable valve timing apparatus.
Figure 27A:
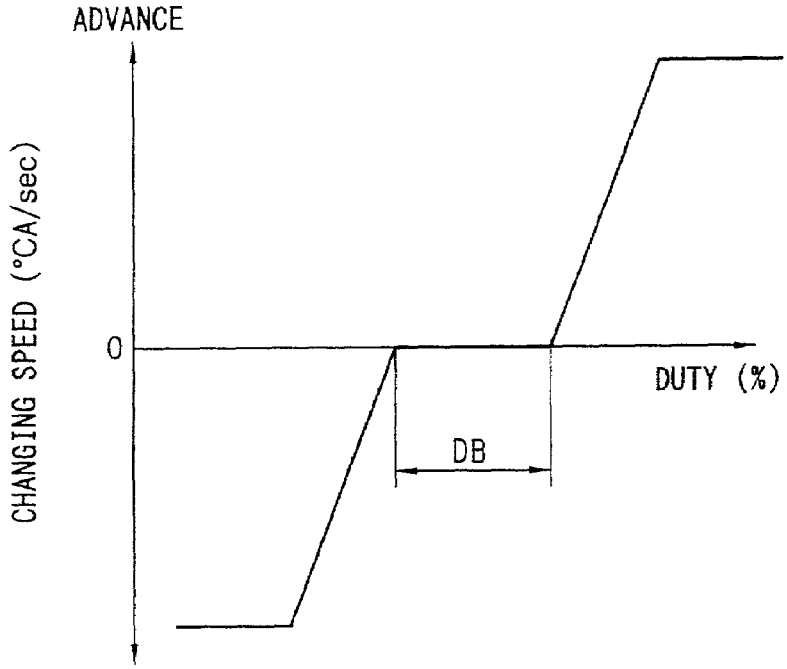
FIG. 27A shows a graph representing a control characteristic of a variable valve timing apparatus.
Figure 27B:
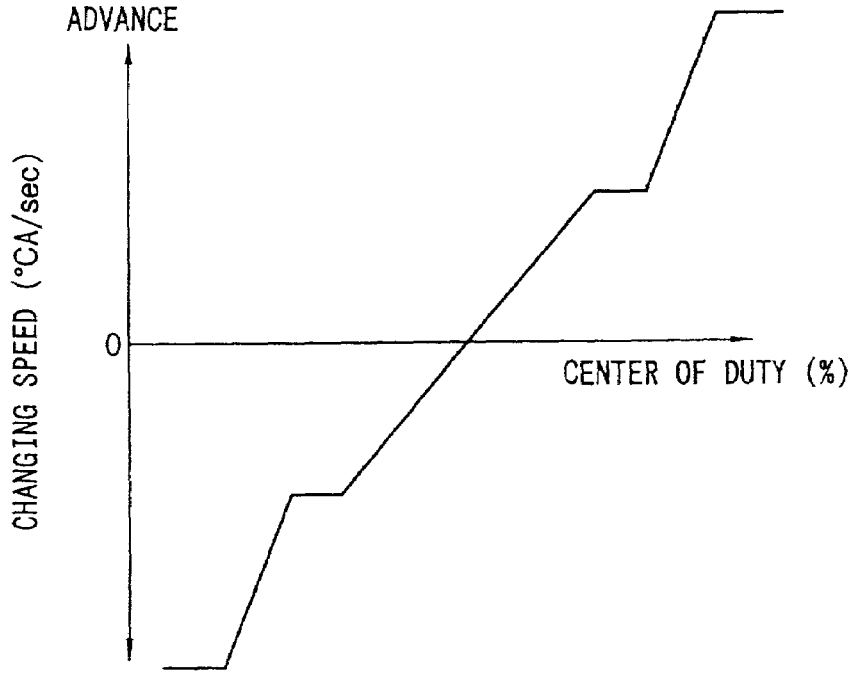
FIG. 27B shows a graph representing a control characteristics of a variable valve timing apparatus.

As shown in FIG. 26A, a flow-rate characteristic of the oil-pressure control valve 21 includes a dead band in which a response of the flow rate to a change in duty value Duty is extremely slow or hardly exists. For this reason, a changing-speed characteristic of the variable valve timing apparatus 18 also includes a dead band as well as shown in FIG. 26B.

Figure 3:
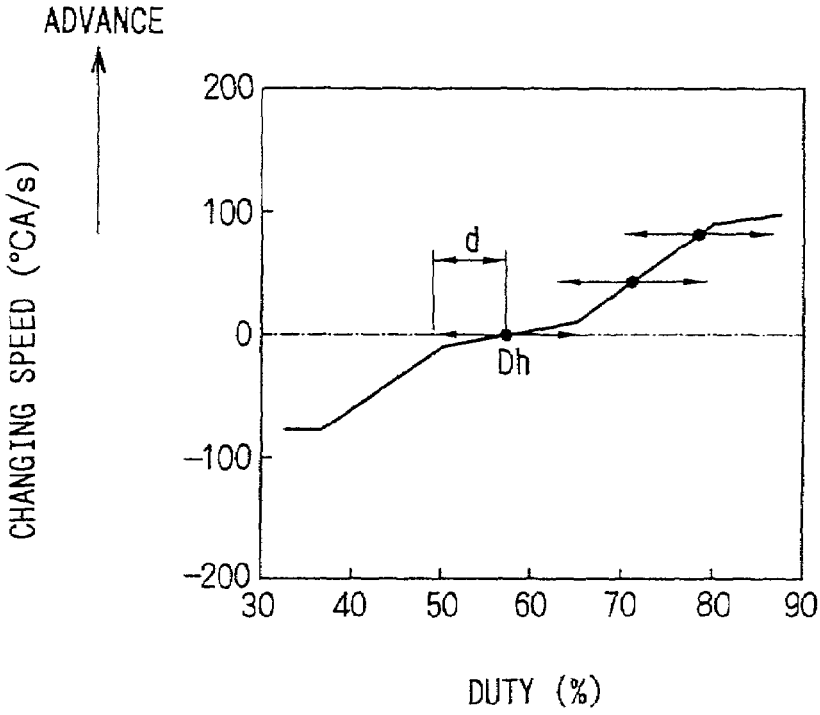
FIG. 3 is a diagram showing a graph representing a control characteristic according to the first embodiment of the present invention.
Figure 4:
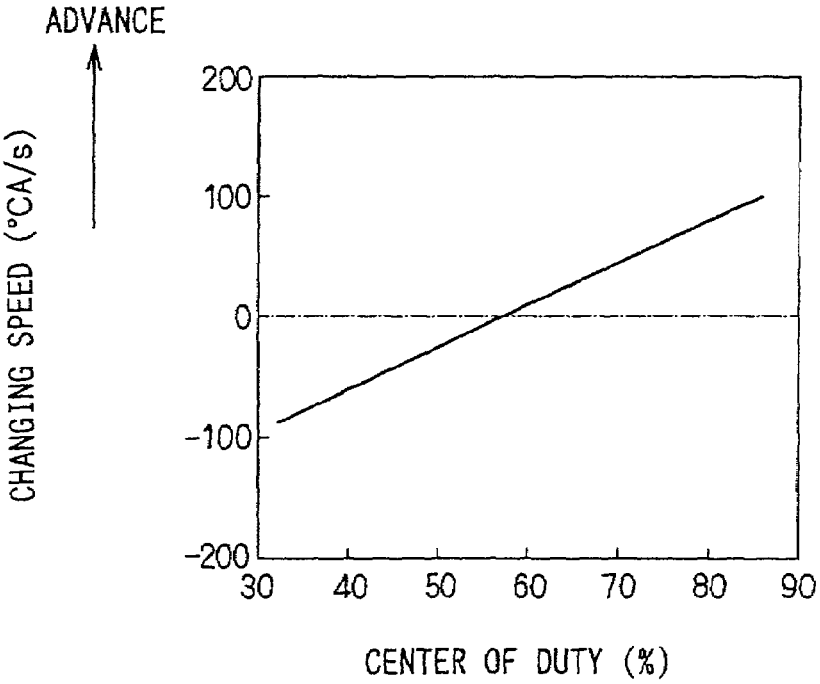
FIG. 4 is a diagram showing a graph representing another control characteristic according to the first embodiment of the present invention.

In order to reduce the effects of the dead bands, the ECU 24 vibrates the duty value Duty at a predetermined amplitude d as shown in FIG. 3. It is desirable to set the amplitude d at a value at least equal to half the width of the dead band. By setting the amplitude d at such a value, the vibration range of the duty value Duty will extend over areas in both the inside and the outside of the dead band when the duty value Duty varies in the dead band. Thus, the magnitude of the control signal's portion beyond the dead band changes with variations in duty value Duty. As a result, the effect of the dead band can be suppressed so that a response can be obtained continuously. As shown in FIG. 4, it is possible to make the valve-timing changing speed of the variable valve timing apparatus 18 linearly vary with changes in duty value Duty.

Figure 5:
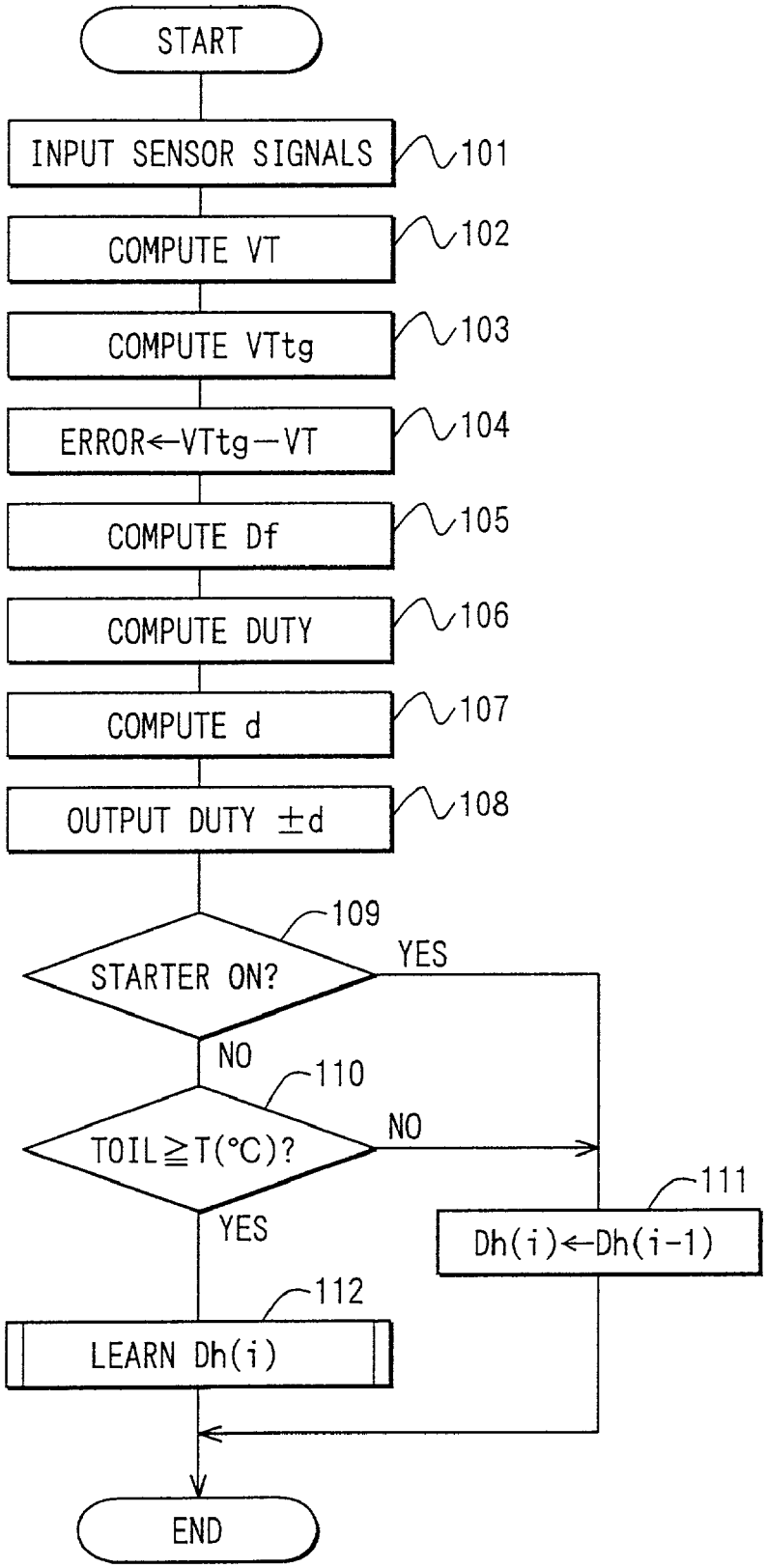
FIG. 5 is a flowchart representing control processing according to the first embodiment of the present invention.
Figure 6:
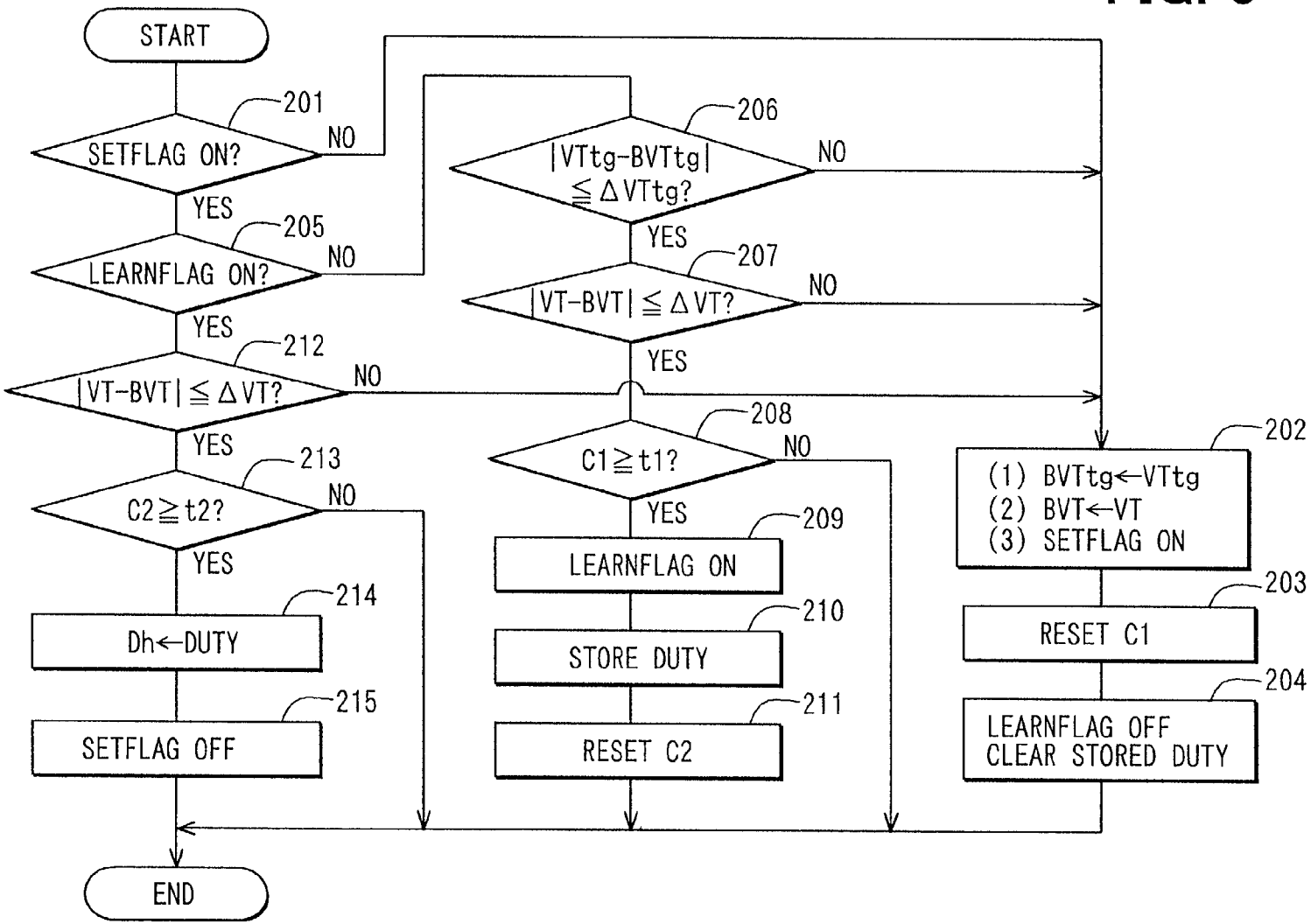
FIG. 6 is a flowchart representing other control processing according to the first embodiment of the present invention.

The ECU 24 carries out processing represented by flowcharts shown in FIGS. 5 and 6. A valve-timing control program represented by the flowchart shown in FIG. 5 is executed at predetermined time intervals or at each predetermined crank angle repeatedly to accomplish functions of a control means.

The flowchart shown in FIG. 5 begins with a step 101 at which signals generated by a variety of sensors are input. Then, at the next step 102, the present actual valve timing VT of the intake valve is computed. When the valve timing is vibrated by vibration control, the actual valve timing VT is used as a center of the vibration. Subsequently, at the next step 103, a target valve timing VTtg of the intake valve is computed on the basis of a running state of the engine 11. Then, at the next step 104, a deviation (error) Error of the actual valve timing VT relative to the target valve timing VTtg is computed (Error=VTtg−VT). Subsequently, at the next step 105, a feedback correction value Df is computed by execution of the PD control based on the deviation Error of the actual valve timing VT relative to the target valve timing VTtg. Typically, the feedback correction value Df is computed in accordance with the following equation:

$$Df=Kp\cdot\text{Error}+Kd\cdot d(\text{Error})/dt$$

where notation d(Error)/dt represents (Error(i)−Error (i−1))/dt, notation dt denotes a period of detection, notation Kp denotes a proportional constant, notation Kd denotes an integration constant and notations (i) and (i−1) each denote a sampling-time point.

Then, at the next step 106, a holding duty value Dh is added to the feedback correction value Df to find a duty value Duty. Thus, a duty value Duty is computed as follows:

$$\text{Duty}=Df+Dh$$

Subsequently, the flow of the program goes on to the next step 107 to compute an amplitude d at which the duty value D is to be vibrated. The amplitude d is set at a value at least equal to half the width of the dead band so that the width of the vibration range of the duty value Duty will be at least equal to the width of the dead band.

Figure 7:
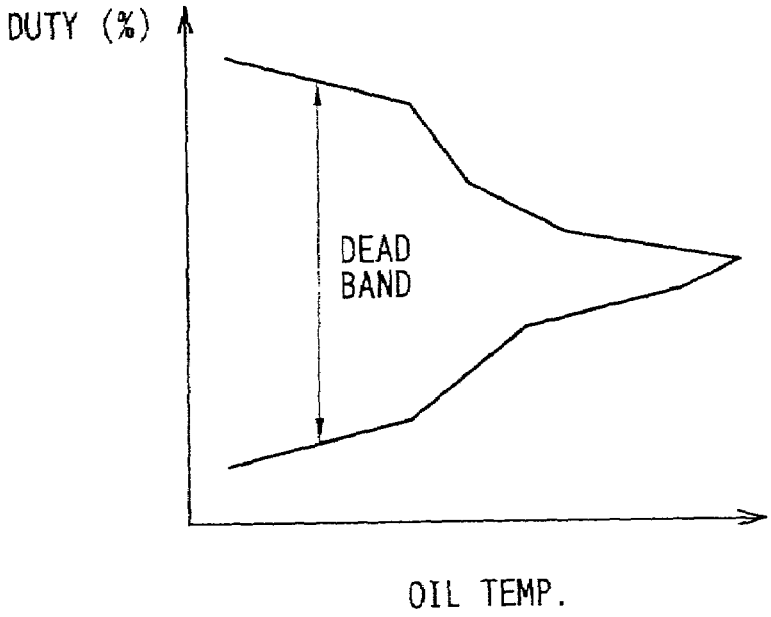
FIG. 7 is a diagram showing a graph representing a relation between oil temperatures and widths of a dead band.
Figure 8:
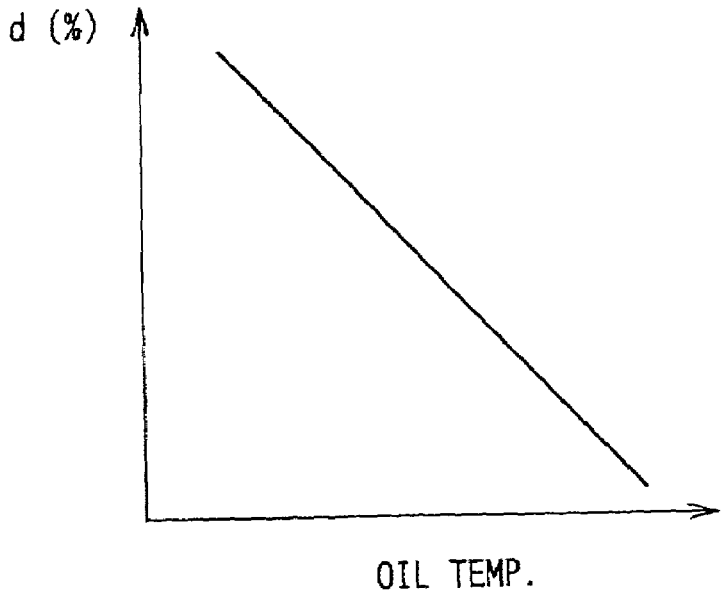
FIG. 8 is a diagram showing a map for finding the magnitude d of the dead band that is suitable for an oil temperature in accordance with the first embodiment of the present invention.

The amplitude d may be set at a fixed value determined in advance or found by searching a map shown in FIG. 8 for a value that is suitable for the current oil temperature. As shown in FIG. 7, as the oil temperature increases, the viscosity of the oil in use decreases, improving the flowability of the oil. Thus, the width of the dead band of the variable valve timing apparatus 18 becomes small at higher oil temperatures. By consideration of such a characteristic, the map of FIG. 8 representing a relation between the amplitude d and the temperature of oil is set so that the amplitude d decreases in proportion to the increase in oil temperature. With such a map, while the width of the vibration range of the duty value Duty is set at a value at least equal to half the width of the dead band, the width of the vibration range of the duty value Duty is prevented from being set at an excessively large value. Even though an oil temperature can be detected by using an oil-temperature sensor, an oil temperature can also be estimated from typically a running state of the engine 11. The amplitude d can also be computed from a parameter having a correlation with the temperature of oil. Examples of such a parameter are the temperature of the engine 11, the temperature of the cooling water and the lapse of time since a start of the engine 11.

Then, at the next step 108, control of the vibration is executed to vibrate the duty of the control signal at the amplitude d and a predetermined vibration period. The duty of the control signal is put in vibration centered at the duty value Duty computed at the step 106. Thus, the duty of the control signal vibrates in the range Duty=Duty±d.

Subsequently, the flow of the program goes on to the next step 109 to determine whether a start signal is being turned on, that is, whether the engine 11 is being started. If the engine 11 is being started, the flow of the program goes on to a step 111 at which the valve timing control is continued by using Dh(i−1) as Dh(i) where notation Dh(i) denotes the present holding duty value Dh and notation Dh(i−1) denotes the immediately preceding holding duty value Dh. If the engine 11 is not being started, on the other hand, the flow of the program goes on to a step 110 to determine whether the oil temperature TOIL is at least equal to a predetermined temperature T (in degrees Celsius). If the oil temperature TOIL is lower than the predetermined temperature T, the flow of the program goes on to the step 111 as is the case with the start of the engine 11 described above. If the engine 11 is not being started and the oil temperature TOIL is at least equal to the predetermined temperature T, the flow of the program goes on to a step 112 at which a duty-value-learning program represented by the flowchart shown in FIG. 6 is executed to find a holding duty value Dh by carrying out a learning process prior to termination of execution of this routine. It is possible to use the temperature of the cooling water in place of the oil temperature TOIL.

The flowchart shown in FIG. 6 begins with a step 201 to determine whether base values have been set as evidenced by an ON state of a base-setting flag to be described later. If no base value has been set, the flow of the program goes on to a step 202 to set the base values for determining whether a condition for execution of a learning process is satisfied as follows:

(1): Use the target valve timing VTtg as a target valve timing base value BVTtg.

(2): Use the actual valve timing VT as an actual valve timing base value BVT.

(3): Turn on a SETFLAG flag to indicate that the base values have been set.

Then, at the next step 203, a continuous time counter C1 is reset to 0. Subsequently, at the next step 204, a LEARNFLAG flag indicating that a learning process is being carried out is turned off and a duty value Duty is deleted from a memory.

At the step 206, |VTtg−BVTtg| is examined to determine whether |VTtg−BVTtg| representing a variation of the target valve timing VTtg relative to the target valve timing base value BVTtg is equal to or smaller than an infinitesimal range ΔVTtg or whether (|VTtg−BVTtg|≦ ΔVTtg), that is, whether the target valve timing VTtg is all but constant.

If the target valve timing VTtg is found all but constant, the flow of the program goes on to a step 207 to determine whether |VT−BVT| representing a variation of the actual valve timing VT relative to the actual valve timing base value BVT is equal to or smaller than an infinitesimal range ΔVT or whether (|VT−BVT|≦ΔVT), that is, whether the actual valve timing VT is all but constant.

If the results of determination obtained at the steps 206 and 207 indicate that both the target valve timing VTtg and the actual valve timing VT are all but constant, a holding duty value Dh is found by carrying out a learning process based on the steps described below. In the learning process, when both the target valve timing VTtg and the actual valve timing VT are found all but constant, a duty value Duty is found as a new holding duty value Dh. The learning process begins with a step 208 to check the value of the counter C1. The counter C1 is used for measuring the length of a time in which both the target valve timing VTtg and the actual valve timing VT are sustained at all but constant values. If the value of the counter C1 has reached a predetermined time t1, the flow of the program goes on to a step 209 at which the LEARNFLAG flag is turned on. Then, at the next step 210, the duty value Duty of the control signal is stored in a memory. Subsequently, at the next step 211, a counter C2 is reset to 0.

After that, the processing branches and proceeds to steps 212 and 213. In the steps 212 and 213, a counter C2 is used for measuring the length of a time in which the actual valve timing VT is sustained at an all but constant value. If the value of the counter C2 has reached a predetermined time t2, the flow of the program goes on to a step 214 at which the duty value Duty stored in a memory at the step 210 is used as a new holding duty value Dh. The predetermined time t2 is set at a value at least equal to a response delay time by which the actual valve timing VT lags behind the output duty value Duty. Finally, at the next step 215, the SETFLAG flag is turned off to indicate that the learning process has been ended.

Since this learning process is carried out in the course of valve timing control, after the start of the learning process, the variation of the actual valve timing VT relative to the actual valve timing base value BVT may exceed the infinitesimal range ΔVT. In such a case, since the condition for execution of the learning process is not satisfied, the flow of the program goes on from the step 212 to the step 202 to resume the learning process.

Figure 9:
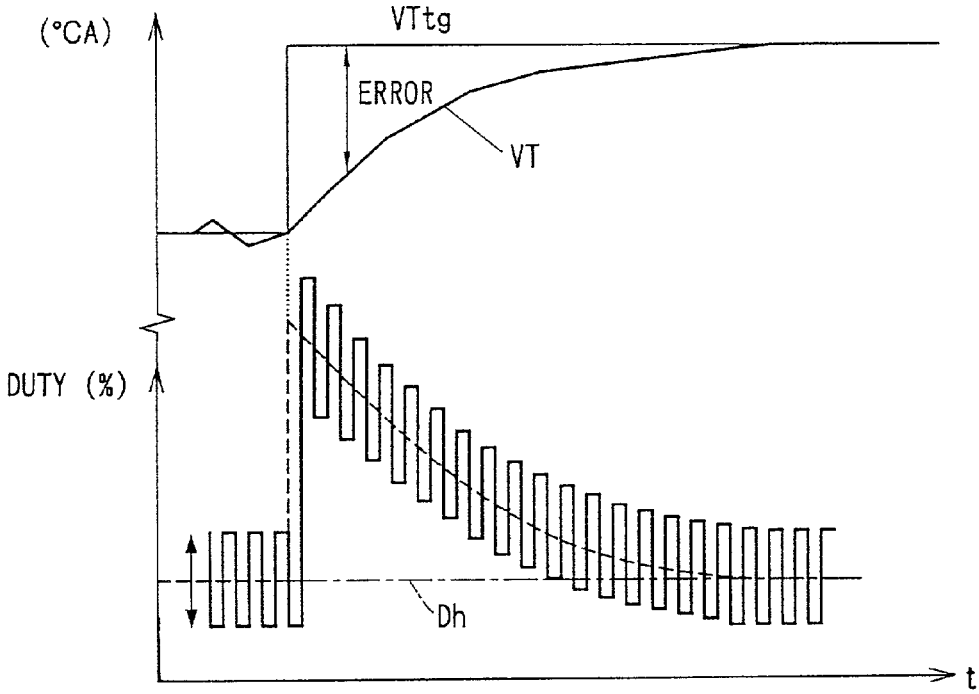
FIG. 9 shows time charts of a control state according to the first embodiment of the present invention.

In accordance with the first embodiment described above, the duty value Duty is vibrated at a predetermined amplitude d. Thus, the response characteristic of the variable valve timing apparatus 18 can be improved. If the duty value Duty is changed from the holding duty value Dh in the advance direction or the retard direction to accompany a change in target valve timing VTtg, the actual valve timing VT follows the target valve timing VTtg, displaying a good response characteristic as shown in FIG. 9. As a result, it is possible to enhance drivability and improve the exhaust emission.

In the first embodiment, the duty value Duty is vibrated at an amplitude d at least equal to half the width of the dead band. Thus, even if the center of the vibration of the duty value Duty coincides approximately with the center of the dead band, the duty value Duty can be vibrated over a range going beyond the limits of the dead band so that a response can be obtained continuously. It is to be noted, however, that the amplitude d can also be set at a value smaller than half the width of the dead band.

Second Embodiment

Figure 10:
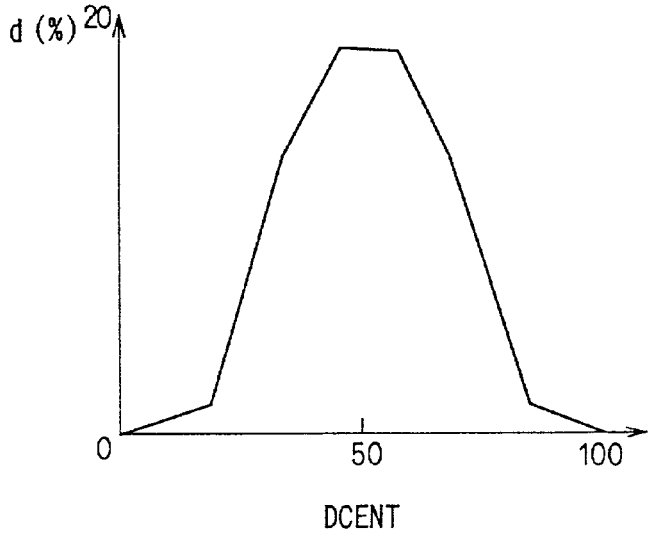
FIG. 10 is a diagram showing a map for finding the magnitude d of the dead band that is suitable for a position of a vibration center of a duty value Duty in accordance with a second embodiment of the present invention.
Figure 11:
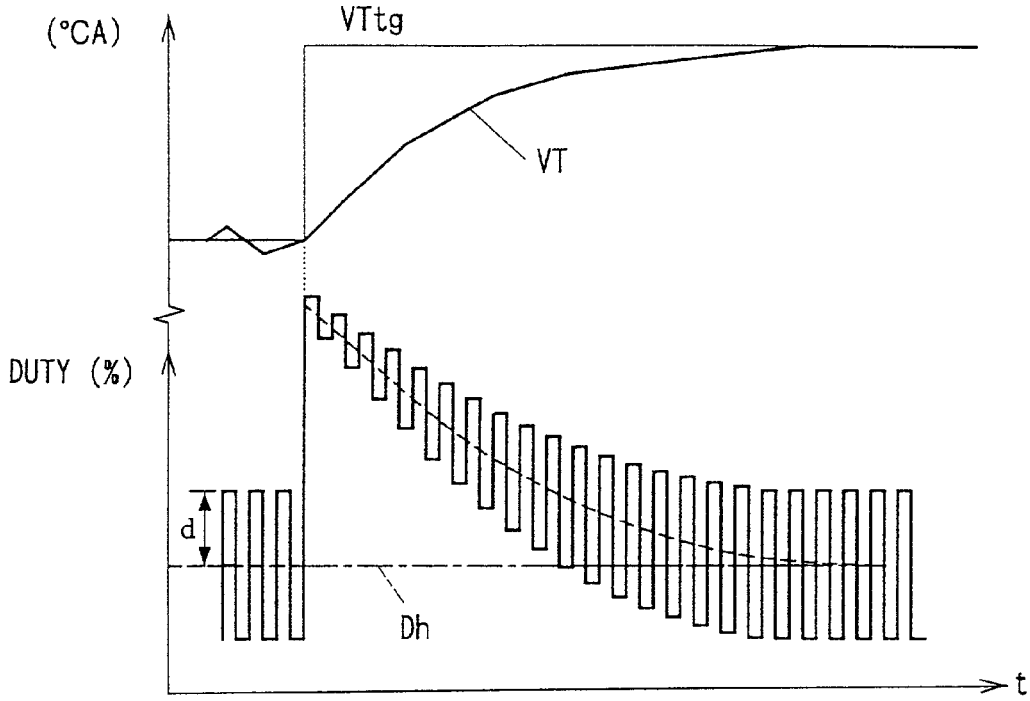
FIG. 11 shows time charts of a control state according to the second embodiment of the present invention.

Next, a second embodiment of the present invention is explained by referring to FIGS. 10 and 11. In this case, a map shown in FIG. 10 is used for finding an amplitude d that is suitable for the position of the center DCENT of the duty value Duty. As is obvious from FIG. 10, the amplitude d that is suitable for the center DCENT of the duty value Duty is a maximum value when the center DCENT of the duty value Duty is located at a position in close proximity to the holding duty value Dh or in close proximity to the center of the dead band. The longer the distance by which the position of the center DCENT of the duty value Duty is separated away from the holding duty value Dh, the smaller the amplitude d. The maximum value of the amplitude d is at least equal to half the width of the dead band. For an area outside the dead band, a good response characteristic is obtained even if the duty value Duty is not vibrated. In addition, there is an effect of avoiding vibration of the actual valve timing for an area outside the dead band.

Furthermore, a duty value Duty maximizing the changing speed of the valve timing varies in accordance with the magnitude of the amplitude d of the vibration of the duty value Duty. Thus, in order to produce a maximum changing speed at the same duty value Duty as the conventional one, it is necessary to set the amplitude d at 0 for an area of the maximum changing speed.

As shown in FIG. 11, by varying the amplitude d, the effect of the dead band DB and the vibration of the actual valve timing can be suppressed. In addition, by setting the amplitude d at 0 for an area of the maximum changing speed, it is possible to produce a maximum changing speed at the same duty value Duty as the conventional one.

Third Embodiment

Figure 12:
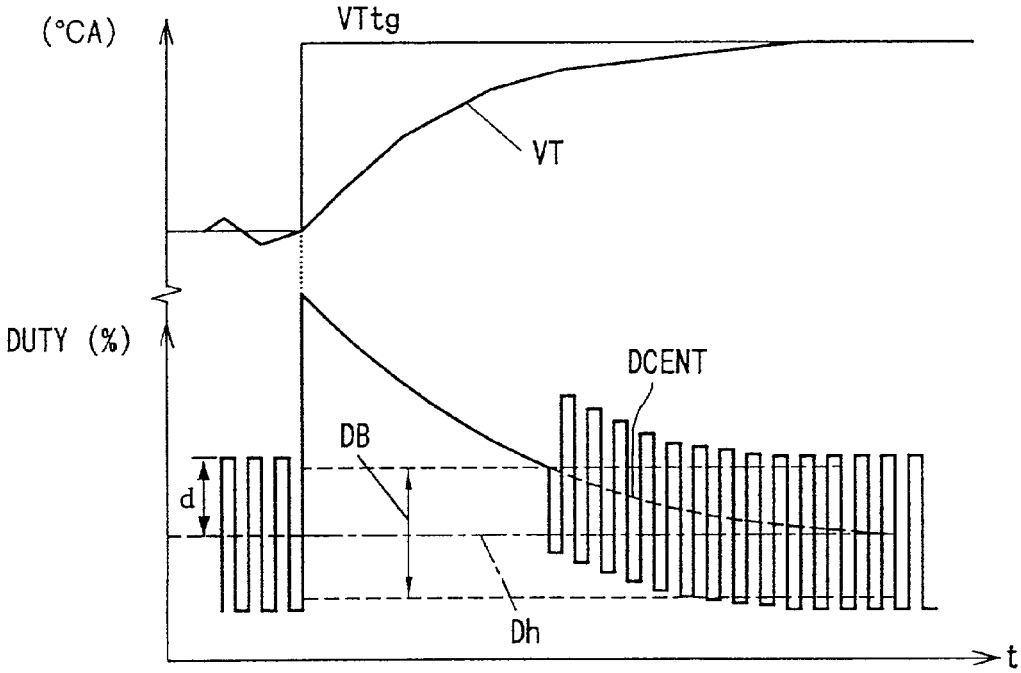
FIG. 12 shows time charts of a control state according to a third embodiment of the present invention.

In a third embodiment, when the vibration center value DCENT exists outside the dead band, the amplitude d is reset to 0 to halt the vibration of the duty value Duty. Thus, it is possible to provide a good response characteristic as well as terminate the vibration. As shown in FIG. 12, if the vibration center value DCENT goes beyond the limit of the dead band, the vibration of the duty value Duty is terminated. In order to keep up with variations in dead-band width and changes caused by an aging characteristic, the duty value Duty may be vibrated over a range slightly wider than the dead band.

Fourth Embodiment

Figure 13:
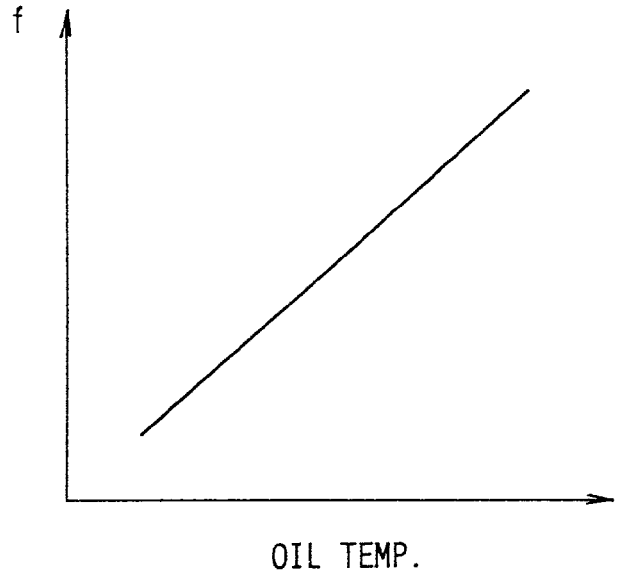
FIG. 13 is a diagram showing a map for finding a vibration frequency that is suitable for an oil temperature in accordance with a fourth embodiment of the present invention.

It is desirable to vibrate the duty value Duty at such a frequency that that the flow volume of the oil can be changed. However, the viscosity of the oil changes in accordance with the temperature of the oil. In a fourth embodiment, a map shown in FIG. 13 is used for finding the duty value Duty's vibration frequency f that is suitable for an oil temperature. The map shown in FIG. 13 is so provided that the vibration frequency f of the duty value Duty becomes lower in proportion to a decrease in oil temperature.

Figure 14A:
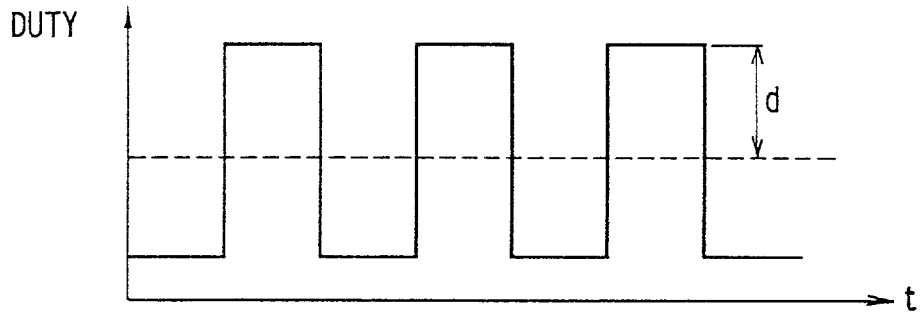
FIG. 14A is a time chart of a control state according to the fourth embodiment of the present invention for low temperatures of oil.
Figure 14B:
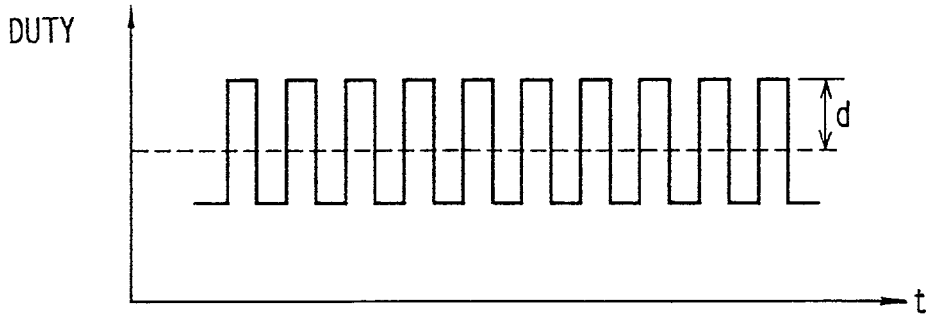
FIG. 14B is a time chart of a control state according to the fourth embodiment of the present invention for high temperatures of oil.

In accordance with the fourth embodiment, at a low oil temperature, the vibration frequency f is set at a small value as shown in FIG. 14A. As a result, a good response characteristic can be assured even for low oil temperatures. At a high oil temperature, on the other hand, the vibration frequency f is set at a large value as shown in FIG. 14B. As a result, the vibration of the actual valve timing can be avoided.

It is to be noted that, even though an oil temperature can be detected by using an oil-temperature sensor, the oil temperature can also be estimated from typically a running state of the engine 11. The amplitude d can also be computed from a parameter having a correlation with the temperature of oil. Examples of such a parameter are the temperature of the engine 11, the temperature of the cooling water and the lapse of time since a start of the engine 11.

Fifth Embodiment

Figure 15:
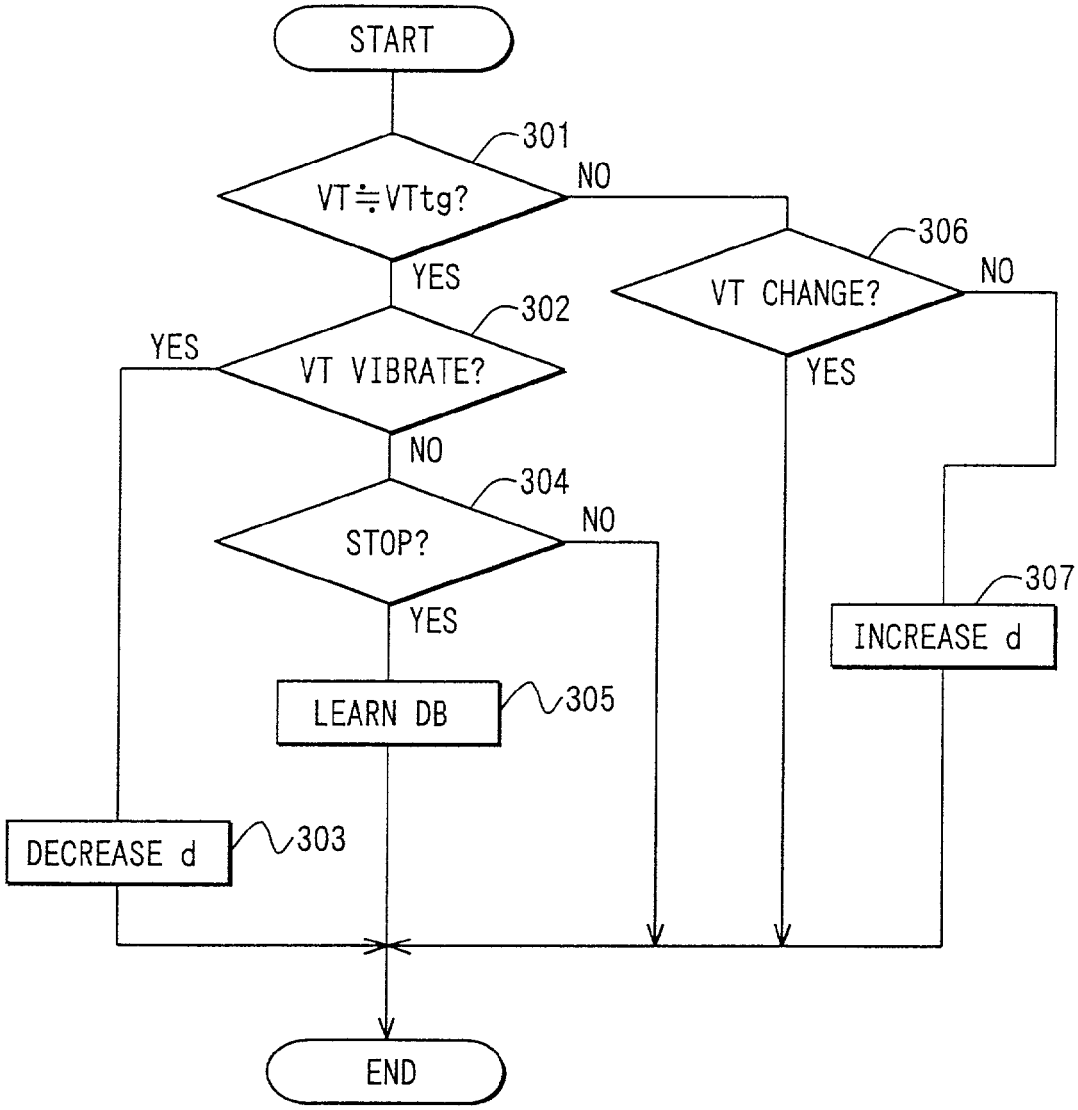
FIG. 15 is a flowchart representing processing to correct an amplitude in accordance with a fifth embodiment of the present invention.
Figure 16:
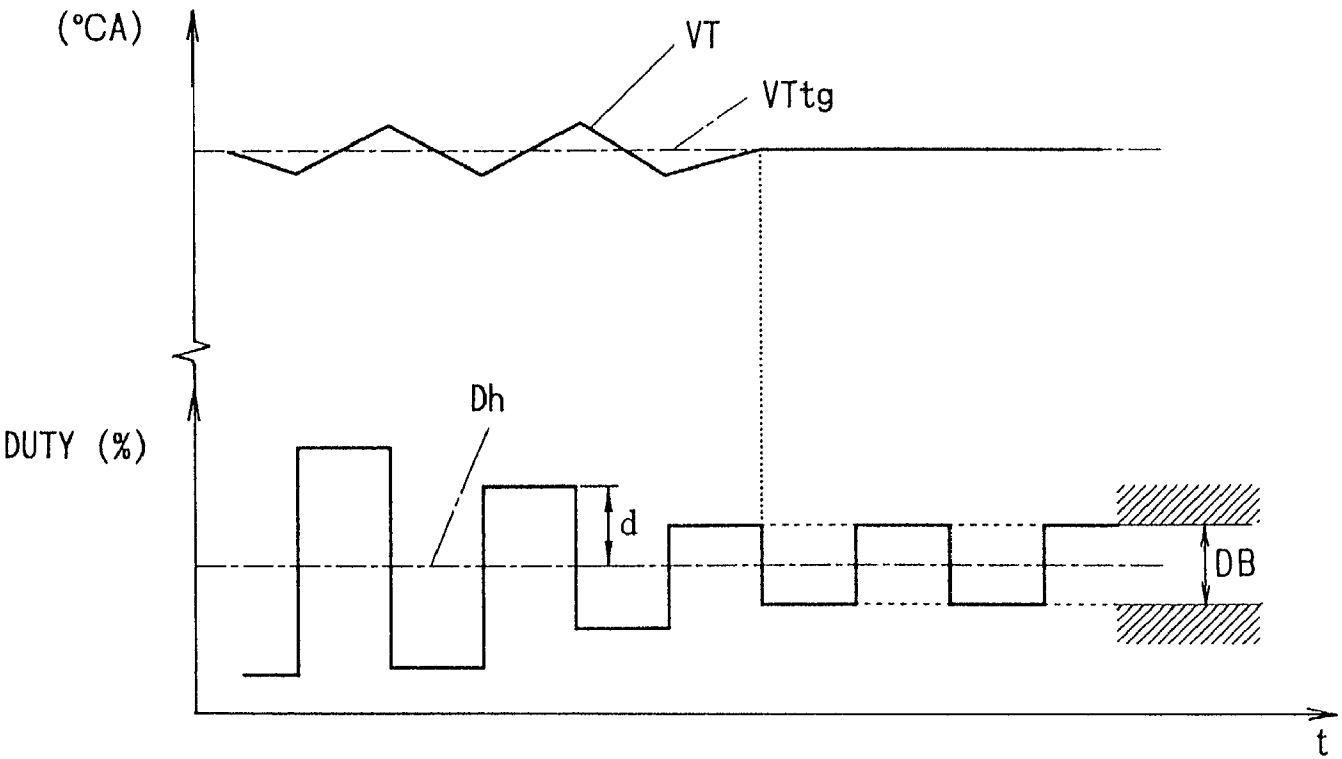
FIG. 16 shows time charts of a control state according to the fifth embodiment of the present invention.
Figure 17:
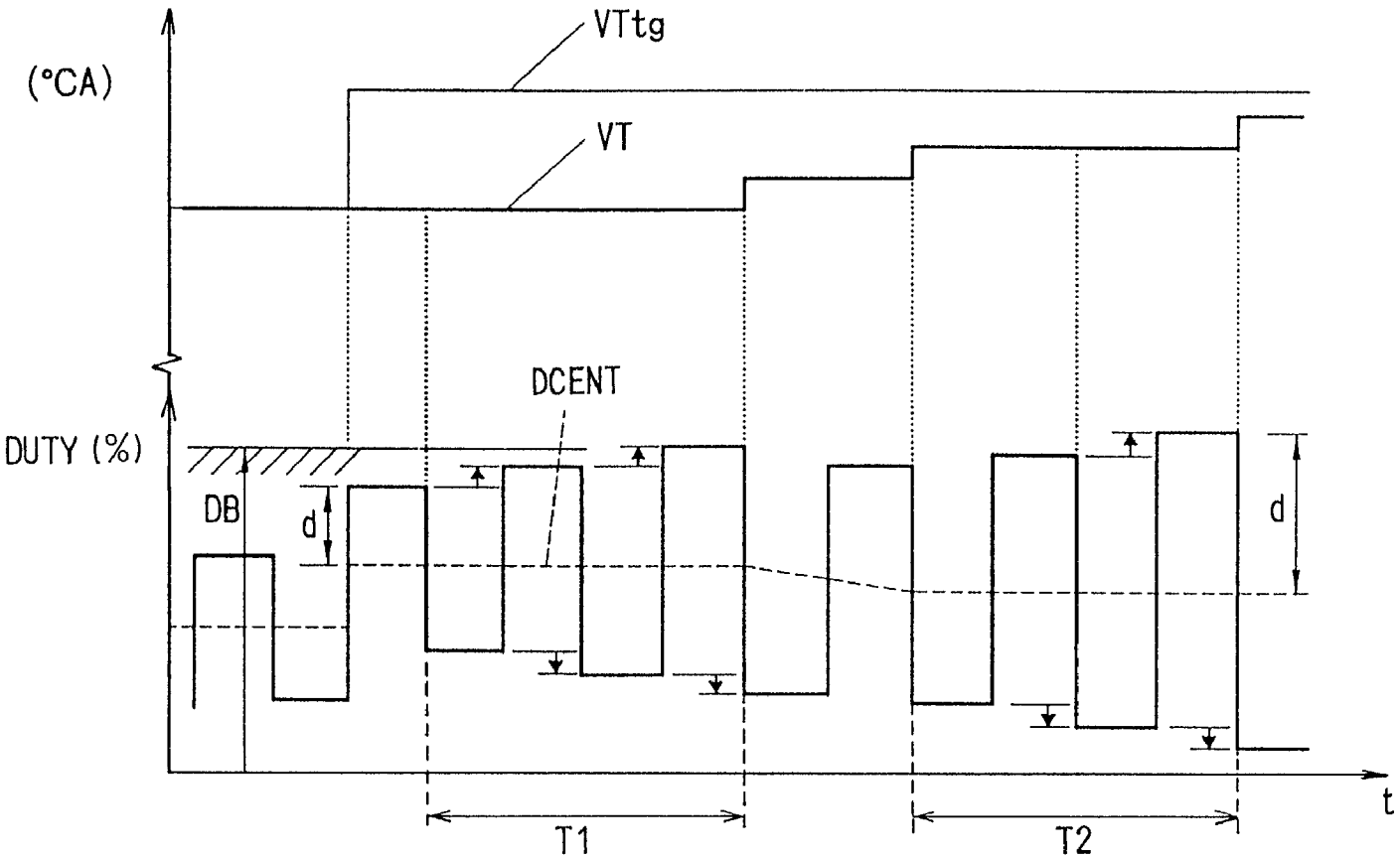
FIG. 17 shows time charts of another control state according to the fifth embodiment of the present invention.

Next, a fifth embodiment of the present invention is explained by referring to FIGS. 15 to 17.

With the actual valve timing held at the target valve timing, the duty value Duty representing the center of the vibration is set at a value corresponding to a position in close proximity to the center of the dead band or set at the holding duty value Dh for holding the current valve timing. In this case, if the vibration range of the of the duty value Duty becomes excessively large in comparison with the width of the dead band, it is feared that the actual valve timing vibrates over an area in close proximity to the target valve timing to accompany the vibration of the duty value Duty.

In order to solve the above problem, the ECU 24 executes an amplitude correction program represented by a flowchart shown in FIG. 15 in order to search for a width of the dead band in a learning process. When the actual valve timing is converged to the target valve timing, that is, when the actual valve timing is stabilized, exhibiting no changes, the amplitude correction program is executed. As shown in FIG. 16, in a learning process, the ECU 24 gradually reduces the amplitude d and, at a point of time the actual valve timing ceases from vibrating, [the vibration center value of the duty value Duty (the holding duty value Dh)+the amplitude d] and [the vibration center value of the duty value Duty (the holding duty value Dh)−the amplitude d] are regarded as an upper limit and a lower limit of the dead band respectively. The termination of the vibration of the actual valve timing indicates that the width of the vibration range of the duty value Duty matches the width of the dead center.

In a state with the actual valve timing not converged to the target valve timing, that is, during a period of time, which starts when the target valve timing changes and ends when the actual valve timing is converged to the target valve timing, on the other hand, the duty value Duty (or the vibration center value DCENT) changes from the holding duty value Dh in a direction toward the target valve timing. At that time, if the width of the vibration range of the duty value Duty is smaller than the width of the dead center, the actual valve timing does not vibrate. In this case, the ECU 24 executes the amplitude correction program represented by the flowchart shown in FIG. 15. As shown in FIG. 17, the amplitude d is increased till the actual valve timing changes by at least a predetermined quantity in a direction toward the target valve timing. In this way, the actual valve timing is changed in a direction toward the target valve timing. In time charts shown in FIG. 17, the amplitude d is increased gradually during periods T1 and T2.

FIG. 15 shows the flowchart representing a program executed to carry out processing to correct the amplitude. This program is executed repeatedly at predetermined time intervals or at each predetermined crank angle.

The flowchart begins with a step 301 to determine whether the actual valve timing has been all but converged to the target valve timing, that is, whether the actual valve timing has been stabilized, exhibiting no changes. If the actual valve timing has been all but converged to the target valve timing, the flow of the program goes on to a step 302 to determine whether the actual valve timing is vibrating over an area in close proximity to the target valve timing to accompany the vibration of the duty value Duty.

If the actual valve timing is vibrating, the flow of the program goes on to a step 303 at which the amplitude d is reduced to a predetermined value. Thereafter, the processing to reduce the amplitude d by the predetermined quantity each time is carried out repeatedly till the vibration of the actual valve timing is terminated. As the actual valve timing ceases from vibrating, the flow of the program goes on from a step 302 to a step 304 to determine whether the actual valve timing has ceased from vibrating, that is, whether the timing to get a learned value of the width of the dead band has been reached. If the timing to get such a learned value has been reached, the flow of the program goes on to a step 305 at which [the duty value Duty's vibration center value (holding duty value Dh) in the end of the vibration of the actual valve timing+the amplitude d] and [the duty value Duty's vibration center value in the end of the vibration of the actual valve timing−the amplitude d] are taken as the upper limit and the lower limit of the dead band respectively in this learning process.

In a step 306, it is determined that whether the actual valve timing has changed in a direction toward a new target valve timing to at least a predetermined value since a change of the target valve timing to the new target valve timing. If the actual valve timing has not changed to at least a predetermined value, the flow of the program goes on to a step 307. At the step 307, the amplitude d is increased by a predetermined quantity. Thereafter, the processing to increase the amplitude d by the predetermined quantity each time is carried out repeatedly till the actual valve timing changes to the predetermined value. As the actual valve timing changes to the predetermined value, the processing to correct the amplitude d is ended.

In accordance with the fifth embodiment, it is possible to prevent the actual valve timing from vibrating over an area in close proximity to the target valve timing and improve the convergability of the actual valve timing to the target valve timing. In addition, a width of the dead band can be acquired by carrying out a learning process in a running state of the engine 11. Furthermore, a width of the dead band can be acquired by carrying out a learning process in the event of a change in target valve timing.

In place of the fifth embodiment, it is also possible to provide a configuration in which, with the actual valve timing held at the target valve timing in a non-vibratory state, the amplitude d of the duty value Duty is increased gradually and [the duty value Duty's vibration center value (holding duty value Dh) at the start of the vibration of the actual valve timing+the amplitude d] and [the duty value Duty's vibration center value at the start of the vibration of the actual valve timing−the amplitude d] are taken as the upper and lower limits of the dead band respectively in this learning process.

Sixth Embodiment

Figure 18A:
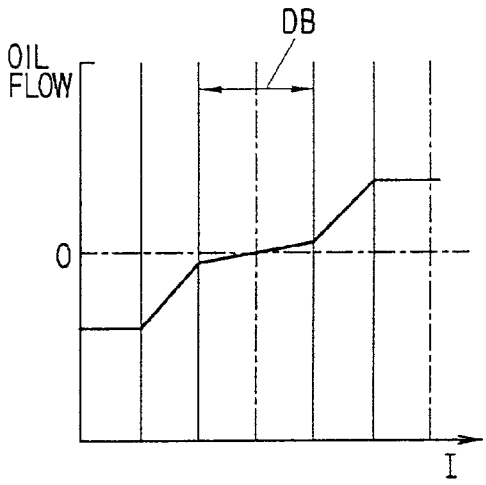
FIG. 18A shows a graph representing a control characteristic according to a sixth embodiment of the present invention.

As shown in FIG. 18A, a dead band DB is included in a characteristic representing a relation between a current and an oil flow of the oil-pressure control valve 21. The dead band DB exists in an area of currents for which the foil flow is all but 0. In this dead band DB, response of the oil flow to a change in current magnitude is extremely slow. In the conventional variable valve timing control system, throughout the entire control area including the dead band DB, a current with a magnitude proportional to the duty value Duty is supplied to the oil-pressure control valve 21 as shown by a dashed line in FIG. 18B. Thus, a characteristic representing a relation between the duty value Duty and the oil flow of the oil-pressure control valve 21 also includes a dead band DB as well as shown in FIG. 18C to reflect the non-linear characteristic representing a relation between the current and the oil flow of the oil-pressure control valve 21 as it is.

Figure 18B:
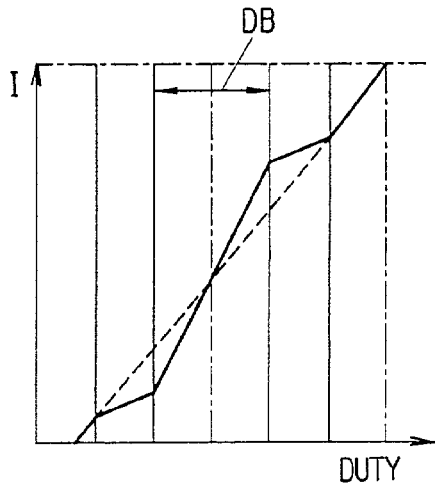
FIG. 18B shows a graph representing another control characteristic according to the sixth embodiment of the present invention.

In the sixth embodiment, the ECU 24 converts a duty value Duty into a current magnitude I. In the conversion, a map represented by a solid line shown in FIG. 18B is used to find a current magnitude I that is suitable for a duty value Duty. In accordance with this map, a rate of change in current magnitude I with respect to the duty value Duty, that is, a control gain, is greater in the dead band than that in other control areas. That is, for control areas outside the dead band, the rate of change in current magnitude I with respect to the duty value Duty is set at small values.

Figure 18C:
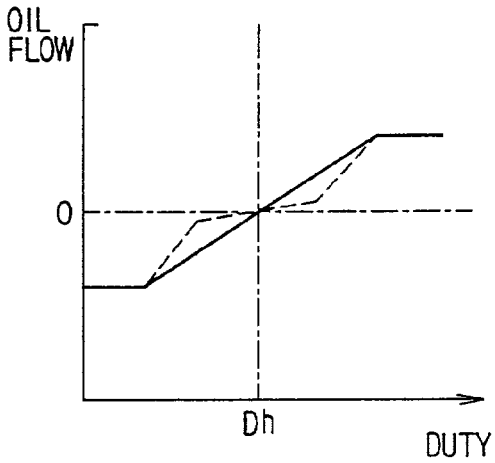
FIG. 18C shows a graph representing a further control characteristic according to the sixth embodiment of the present invention.

As a result, as indicated by a solid line shown in FIG. 18C, the characteristic of the oil-flow response to a change in duty value Duty in the dead-band area of the oil-pressure control valve 21 can be improved even if the duty value Duty changes in an area in close proximity to the holding duty value Dh, which is a duty value Duty with an oil flow of about 0.

Figure 19:
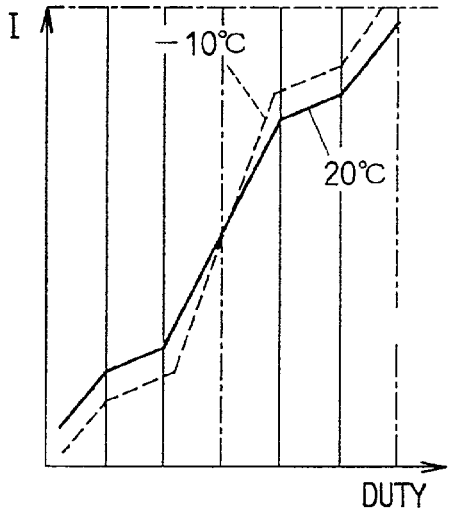
FIG. 19 shows graphs representing a still further control characteristic according to the sixth embodiment of the present invention or, specifically, graphs indicating that a relation between duty values and current changes in dependence on the oil temperature.

As shown in FIG. 19, a map representing a relation between the duty value Duty and the current magnitude I can be set for each oil temperature to change the gain in accordance with the oil temperature. With such a scheme, it is possible to execute stabilized valve timing control not influenced by changes in oil temperature.

It is to be noted that the correction quantity of the rate of change in current with respect to the duty value Duty can also be changed in accordance with a parameter having a correlation with the temperature of oil instead of changing the correction quantity in dependence on the oil temperature itself. Examples of such a parameter are the temperature of the engine 11, the temperature of the cooling water and the lapse of time since a start of the engine 11.

Seventh Embodiment

In the case of a seventh embodiment, when the target valve timing changes, the duty value Duty is modified to the upper or lower limit of the dead band to offset the change in target valve timing. In this embodiment, the duty value Duty does not vibrate.

In addition, in the seventh embodiment, when the duty value Duty goes beyond the upper or lower limit of the dead band, the response characteristic of the valve timing control changes abruptly. Thus, the response characteristic of the valve timing control is monitored in a running state of the engine 11 and the dead band is found by carrying out a learning process based on a duty value Duty, which is seen when the response characteristic changes abruptly. When the target valve timing is changed, an offset quantity to offset the duty value Duty is set on the basis of a learned value of the dead band.

Figure 20A:
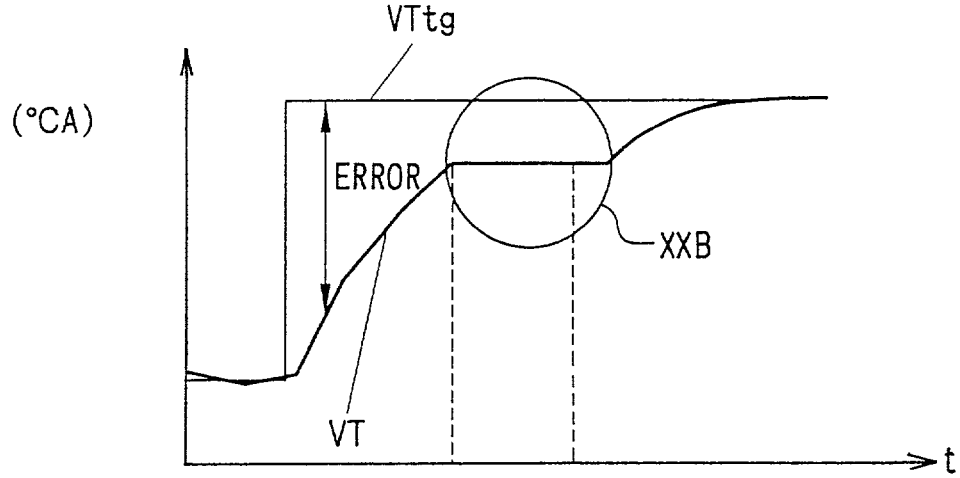
FIG. 20A is a time chart of a learning state according to a seventh embodiment of the present invention.
Figure 20B:
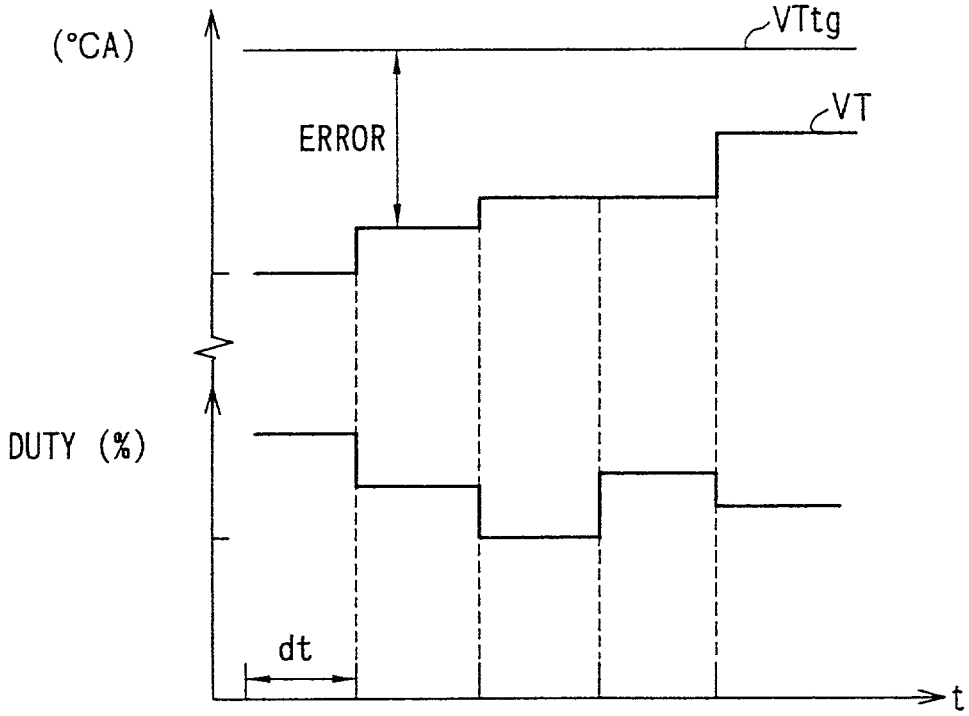
FIG. 20B shows time charts of another learning state according to the seventh embodiment of the present invention.

A width of the dead band is found by carrying out a learning process during a predetermined learning period in a running state of the engine 11. During the learning period to find a width of the dead band, however, the duty value Duty is not changed to offset a change in target valve timing even if such a change exists. If the target valve timing VTtg is changed from a state in which an actual valve timing VT is sustained at the target valve timing VTtg during a learning period, behaviors like ones shown in FIGS. 20A and 20B are obtained. As shown in FIG. 20B, when the duty value Duty is changed from a value in close proximity to the holding duty value Dh in an advance direction or a retard direction, d(Error)/dt representing a rate of change in deviation Error is monitored in order to detect the response characteristic of the valve timing control, where notation Error is a deviation of the actual valve timing relative to the target valve timing. The rate of change in deviation Error can be expressed as follows:

$$d(\text{Error})/dt=[\text{Error}(i)-\text{Error}(i-1)]/dt$$

where notation Error(i) denotes the current deviation, notation Error(i−1) denotes an immediately preceding deviation and notation dt denotes a period of detection.

d(Error)/dt representing the rate of change in deviation Error is examined to determine whether the following relation holds true:

$$-\alpha<d(\text{Error})/dt<\alpha,$$

that is, whether the rate of change in deviation Error represented by d(Error)/dt is in a predetermined range centered at 0. At a point of time d(Error)/dt representing the rate of change in deviation Error falls into the predetermined range, the actual valve timing VT is determined to remain at a value beyond the lower or upper limit of the dead band, that is, the response characteristic of the valve timing control is determined to have changed abruptly. The duty value Duty remaining at the value beyond the upper or lower limit of the dead band is taken as the upper limit Dg1 of the dead band or the lower limit Dg2 of the dead band respectively.

Figure 21:
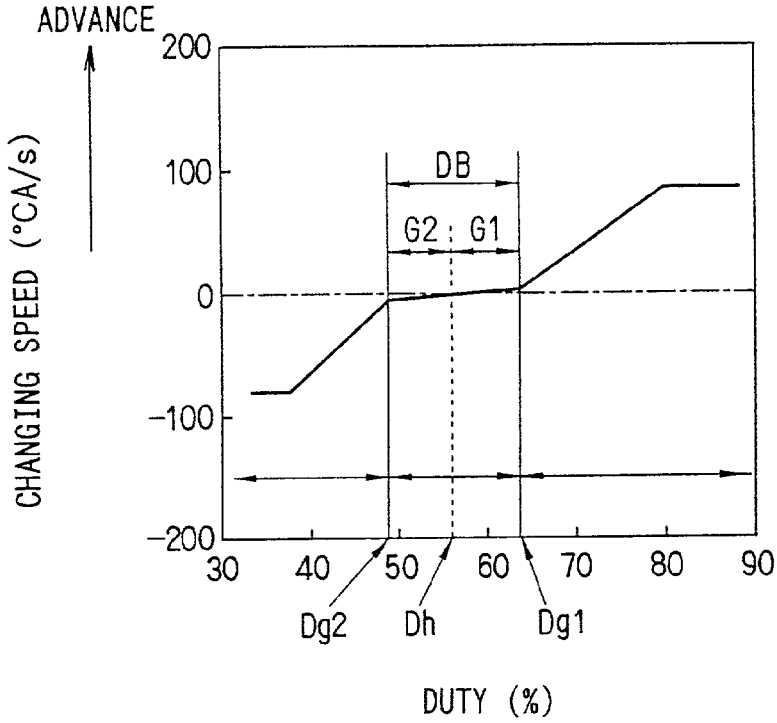
FIG. 21 shows a graph representing a control characteristic according to the seventh embodiment of the present invention.

Then, in the learning process, a difference between the upper limit Dg1 of the dead band and the holding duty value Dh is taken as a learned value G1 (=Dg1−Dh) on the advance side as shown in FIG. 21. The learned value G1 on the advance side is used as an offset quantity, by which the duty value Duty is changed to offset a variation in target valve timing VTtg when the target valve timing VTtg is changed in the advance direction. By the same token, in the learning process, a difference between the lower limit Dg2 of the dead band and the holding duty value Dh is taken as a learned value G2 (=Dh−Dg2) on the retard side. The learned value G2 on the retard side is used as an offset quantity, by which the duty value Duty is changed to offset a variation in target valve timing VTtg when the target valve timing VTtg is changed in the retard direction.

Figure 22:
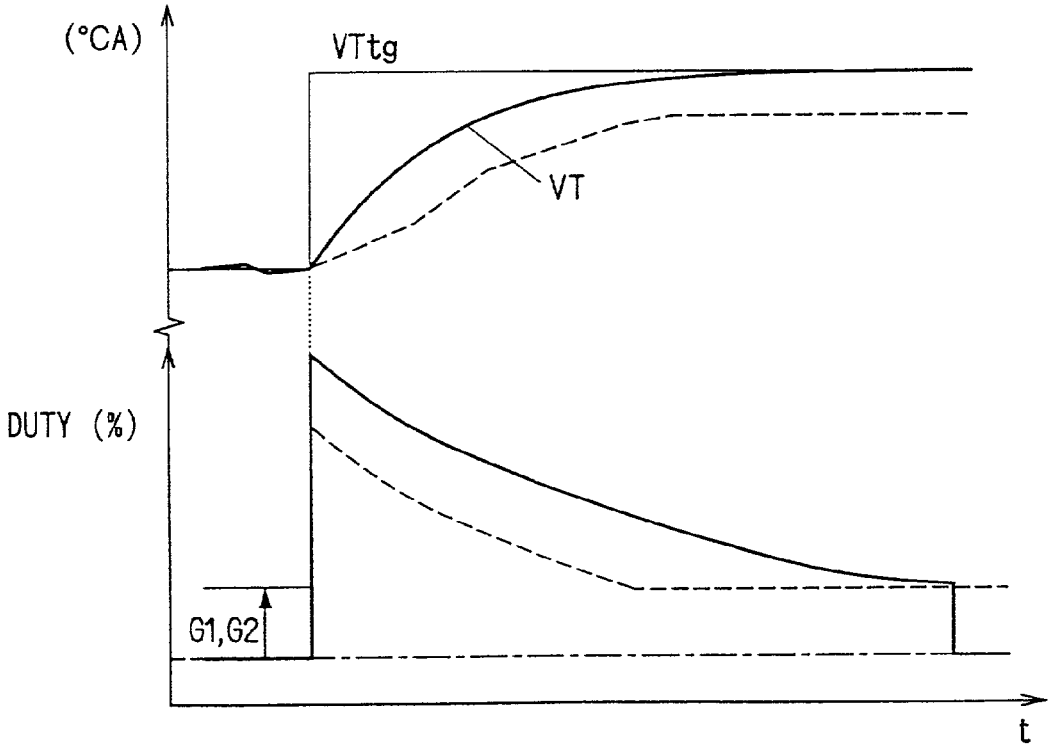
FIG. 22 shows time charts of a control state according to the seventh embodiment of the present invention.

For example, the ECU 24 executes control like one shown in FIG. 22 after the end of the learning period. Solid lines shown in FIG. 22 represent values for this embodiment and dashed lines shown in the same figure represents values for only feedback control. When the target valve timing VTtg is changed in the advance direction, a duty value Duty is found from a feedback correction value Df, the holding duty value Dh and the learned value G1 on the advance side as follows:

$$\text{Duty}=Df+Dh+G1$$

As a result, the duty value Duty is changed only by the learned value G1 on the advance side to offset the change in target valve timing VTtg.

A holding duty value Dh is found by carrying out the same learning process as the first embodiment. As an alternative, a holding duty value Dh can also be found in advance from information such as experimental data and design data.

When the target valve timing VTtg is changed in the retard direction, on the other hand, a duty value Duty is found from a feedback correction value Df, the holding duty value Dh and the learned value G2 on the retard side as follows:

$$\text{Duty}=Df+Dh-G2$$

As a result, the duty value Duty is changed only by the learned value G2 on the retard side to offset the change in target valve timing VTtg.

As described above, when the target valve timing VTtg is changed, the duty value Duty is changed immediately to a value in an area outside the dead band to offset the change in target valve timing VTtg. Thus, feedback control can be executed to change the actual valve timing in accordance with a good response characteristic. As a result, the actual valve timing can be changed to follow a change in target valve timing in accordance with a good characteristic. Accordingly, the actual valve timing can be converged fast to the target valve timing.

As an alternative to the seventh embodiment, when the target valve timing does not change, within a range of having no adverse effects on the running condition of the engine 11, the duty value Duty can be temporarily changed in the advance or retard direction to obtain learned values of G1 and G2.

As another alternative, it is also possible to provide a configuration of a learning process in which, when the duty value Duty is changed from a value outside the dead band to another value inside the dead band, the response characteristic is monitored and a value that the duty value Duty has at a point of time the actual valve timing ceases from changing is taken as the upper limit Dg1 or the lower limit Dg2 of the dead band.

It is to be noted that the technique adopted in learning process may be properly changed. For example, a width of the dead band can be obtained by adopting the same method as the fifth embodiment whereby the duty value Duty is vibrated during a learning period to obtain the width of the dead band.

As a further alternative, in a system having no means for finding a width of the dead band by carrying out a learning process, when the target valve timing is changed, the duty value Duty is varied to offset the change in target valve timing in accordance with the width of a dead band, which has been found in advance from information including experimental data and design data. In his case, the precision of the width of the dead band deteriorates in comparison with a width of the dead band found by carrying out a learning process. By varying the duty value Duty to offset a change in target valve timing in accordance with the width of a dead band in the event of such a change, however, the valve timing can be changed in a response better than the conventional technique.

Eighth Embodiment

Figure 23:
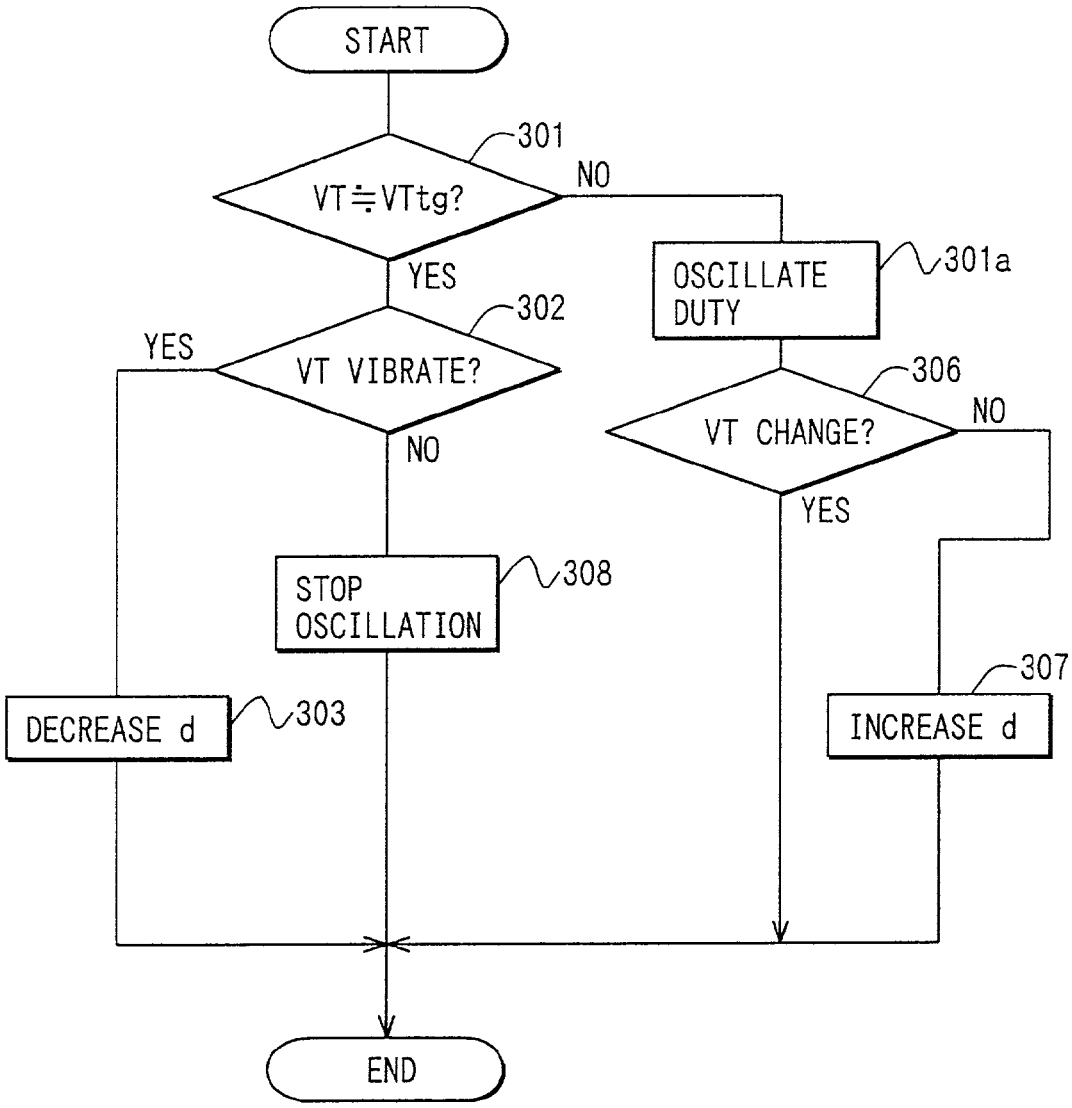
FIG. 23 is a flowchart representing processing to correct an amplitude in accordance with an eighth embodiment of the present invention.

In an eighth embodiment, the vibration of the duty value Duty is halted when the actual valve timing is determined to have converged to a target valve timing. FIG. 23 is a flowchart representing an amplitude correction program. The program is executed at predetermined time intervals or at each predetermined crank angle repeatedly. Each element identical with the counterpart employed in the fifth embodiment is denoted by the same reference numeral as the counterpart. Only differences from the fifth embodiment are explained.

Figure 24:
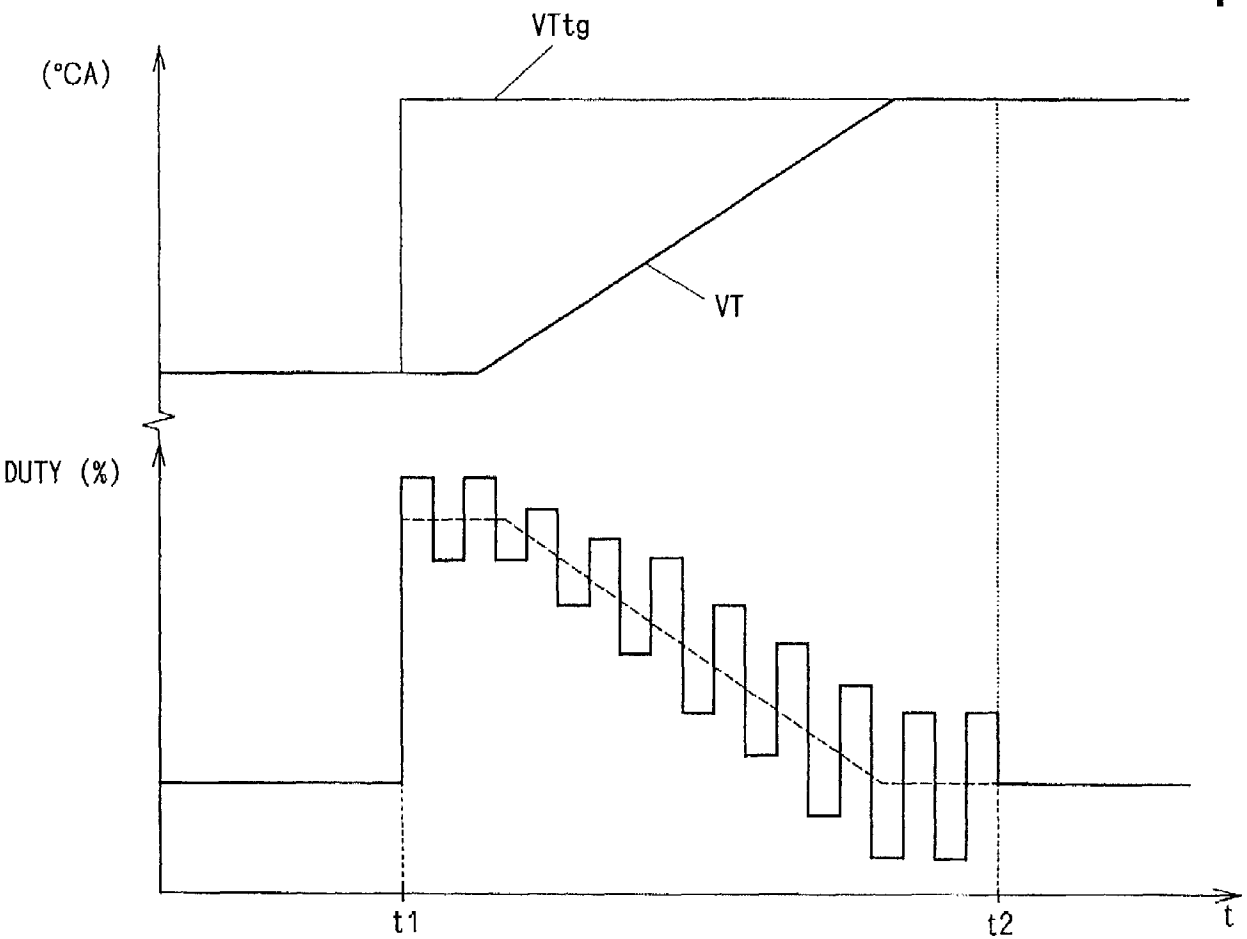
FIG. 24 shows time charts of a control state according to the eighth embodiment of the present invention.

In this embodiment, the vibration of the duty value Duty is started at a step 301*a*. Thereafter, as the actual valve timing ceases from vibrating, the flow of the program goes on from a step 302 to a step 308. At the step 308, the vibration of the duty value Duty is halted after the actual valve timing is determined at the step 302 to have been completely converged to a target valve timing. FIG. 24 is a diagram showing the operation of the eighth embodiment. Vibration starts at a time t1. At a time t2, the convergence is determined and the vibration is halted.

It is to be noted that, the vibration of the duty value Duty may be halted after a width of the dead band is found by carrying out the same learning process as the fifth embodiment right after the actual valve timing ceases from vibrating.

In accordance with this embodiment, when a target valve timing is changed from a state in which the actual valve timing is converged to the target valve timing, it is possible to prevent the direction of the vibration of the duty value Duty from becoming opposite to the direction of a change in target valve timing. As a result, it is possible to prevent the direction of the vibration of the duty value Duty from becoming opposite to the direction of a change in target valve timing when the target valve timing changes.

Ninth Embodiment

Figure 25:
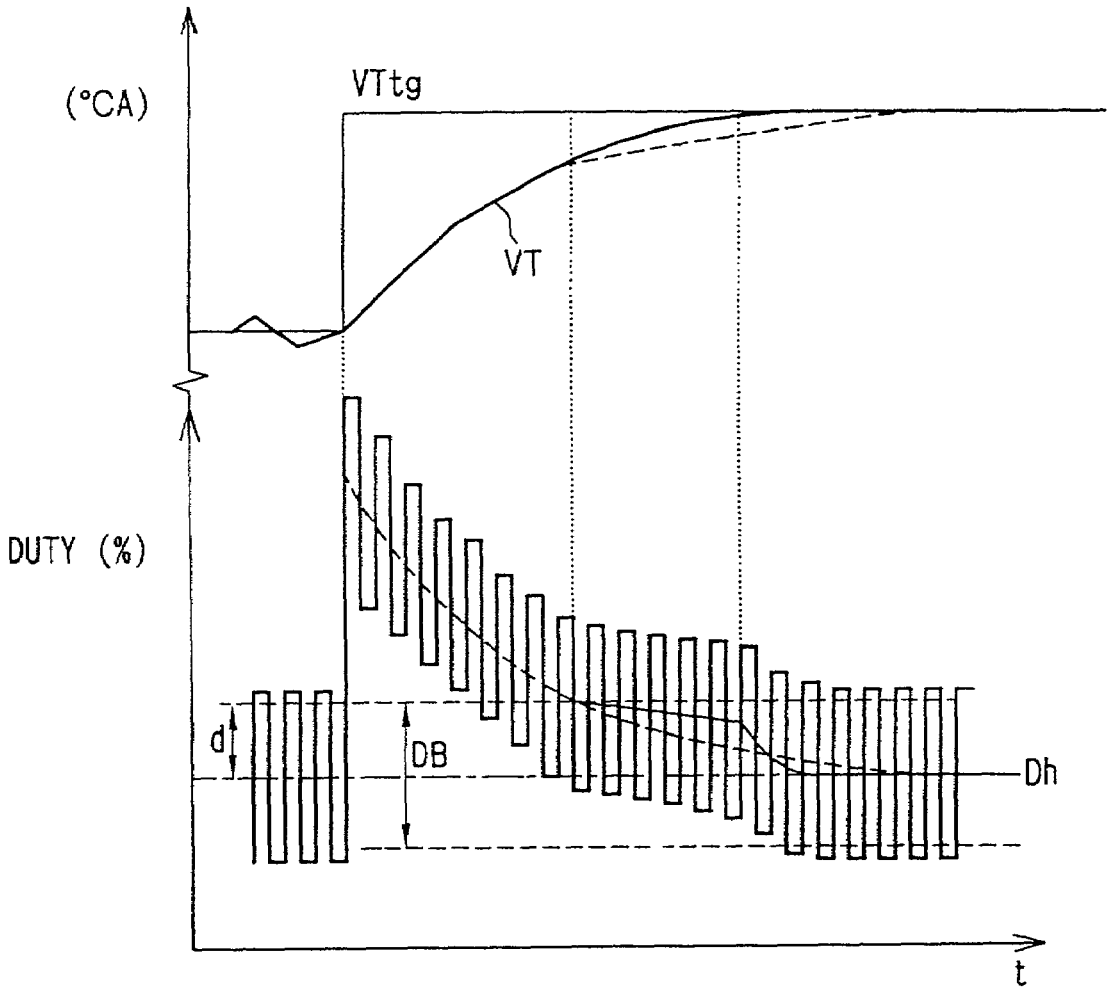
FIG. 25 shows time charts of a control state according to a ninth embodiment of the present invention.

FIG. 25 is a diagram showing a control state of a ninth embodiment. In this embodiment, the duty value Duty is vibrated at an amplitude d. In addition, a variable control gain is adopted. When the target valve timing is changed to vary the duty value Duty in an advance or retard direction, the control gain is being increased during a period of time, which starts when the vibration center of the duty value Duty enters a dead-band area and ends when the actual valve timing is converged to a target valve timing. In this way, it is possible to reduce the length of a time required to converge the actual valve timing to a target valve timing. FIG. 25 is a typical comparison diagram in which a dashed line represents a case with the control gain fixed whereas a solid line represents a case with the control gain increased.

Tenth Embodiment

In a tenth embodiment, the ECU 24 executes programs represented by flowcharts shown in FIGS. 28 to 31. In normal valve-timing control, the duty value Duty is vibrated at a proper amplitude. When predetermined conditions for execution of a learning process to obtain a holding duty value Dh are satisfied, control of the vibration of the duty value Duty is continued to find a holding duty value Dh from a learning process. In this way, effects of a dead band are eliminated and a holding duty value Dh can be found from the learning process.

Figure 28:
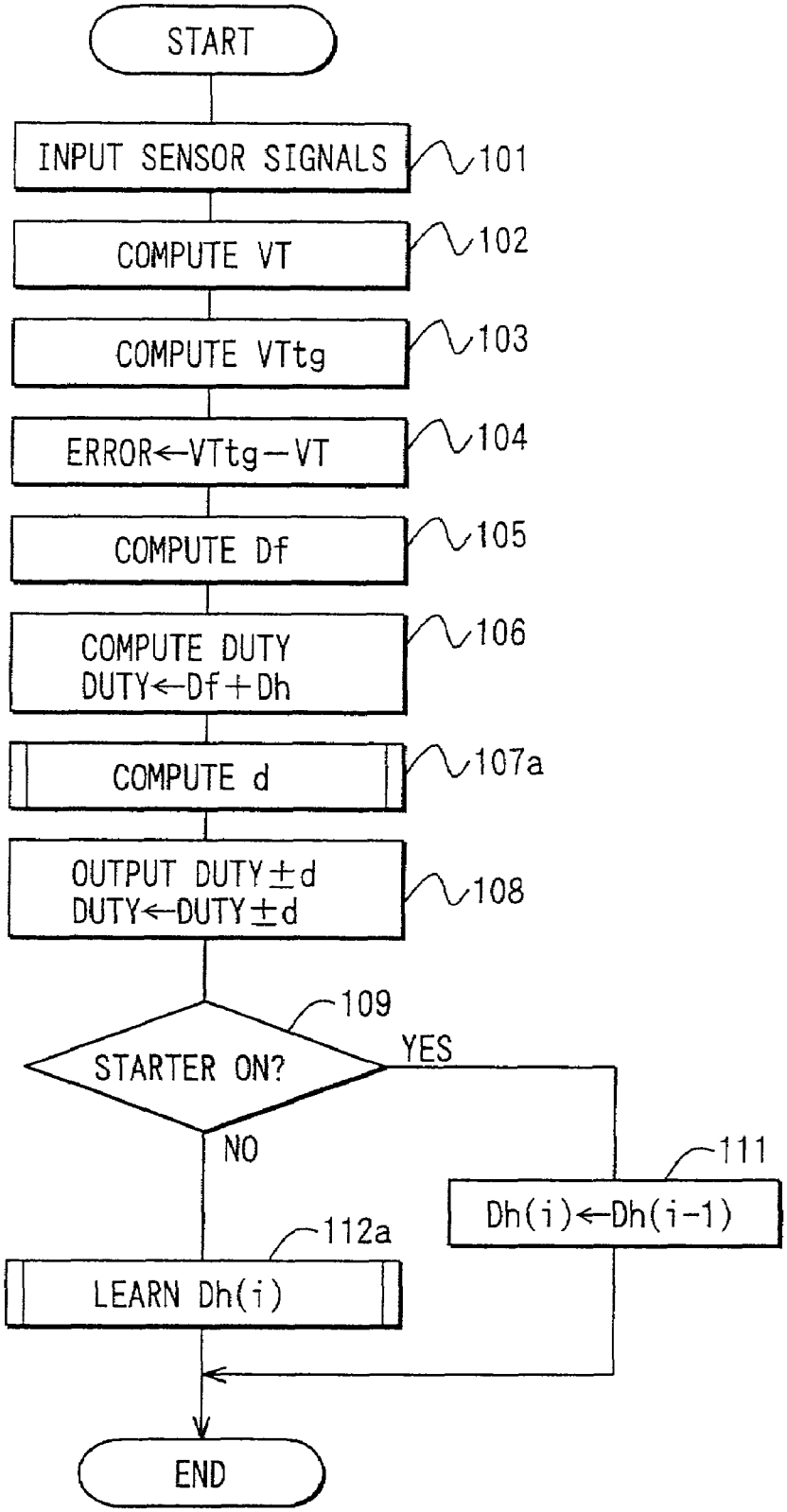
FIG. 28 is a flowchart representing control according to a tenth embodiment of the present invention.
Figure 29:
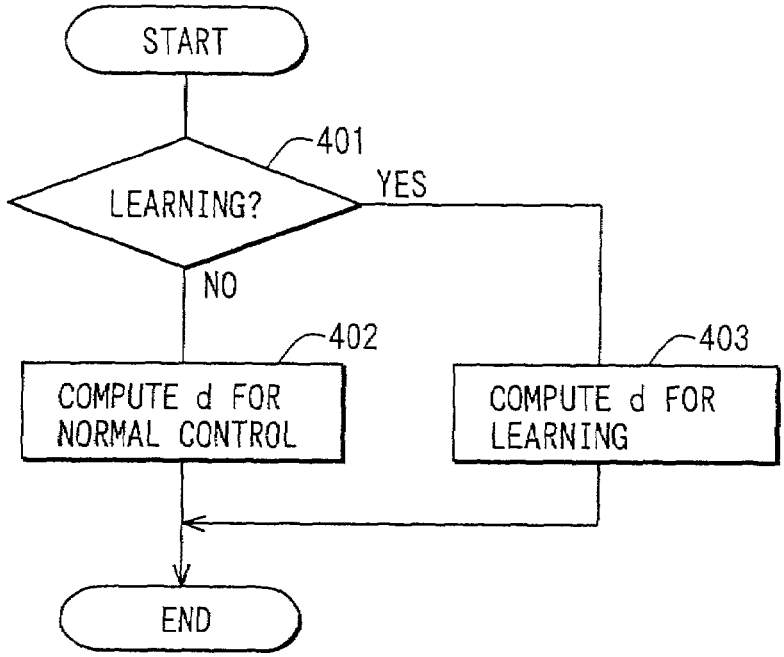
FIG. 29 is a flowchart representing processing to set an amplitude in accordance with the tenth embodiment of the present invention.

Each of the elements of the tenth embodiment identical with the counterpart employed in the first embodiment is denoted by the same reference numeral as the counterpart. Only differences from the first embodiment are explained. At a step 107*a*, the program represented by flowchart shown in FIG. 29 is executed to compute an amplitude d. The flowchart shown in FIG. 28 begins with a step 401 to determine whether a holding duty value Dh is being found by carrying out a learning process. If a holding duty value Dh is not being found by carrying out a learning process, the flow of the program goes on to a step 402 at which an amplitude d of the normal control is computed by adoption of the same method as the embodiments explained previously.

If the determination result obtained at the step 401 indicates that a holding duty value Dh is being found by carrying out a learning process, on the other hand, the flow of the program goes on to a step 403. At the step 403, an amplitude d for the learning process is computed. In this case, one of following methods (1) to (4) is adopted.

(1): The amplitude d of the vibration occurring in the learning process is fixed without regard to the magnitude of the duty value Duty. The amplitude d is set at such a fixed value in advance that the duty value Duty's range of vibration occurring in the learning process can cover the entire area of the dead band without regard to the magnitude of the duty value Duty. The set magnitude of the amplitude d is stored in a ROM employed in the ECU 24. In this case, it is desirable to set the amplitude d at a fixed value at least equal to half the width of a maximum dead band. By setting the amplitude d at such a value, the duty value Duty's range of vibration occurring in the learning process can cover the entire area of the dead band without regard to the magnitude of the duty value Duty so that the entire dead band can be hidden with a high degree of reliability and the learning precision of the holding duty value Dh can be prevented from worsening.

Figure 32:
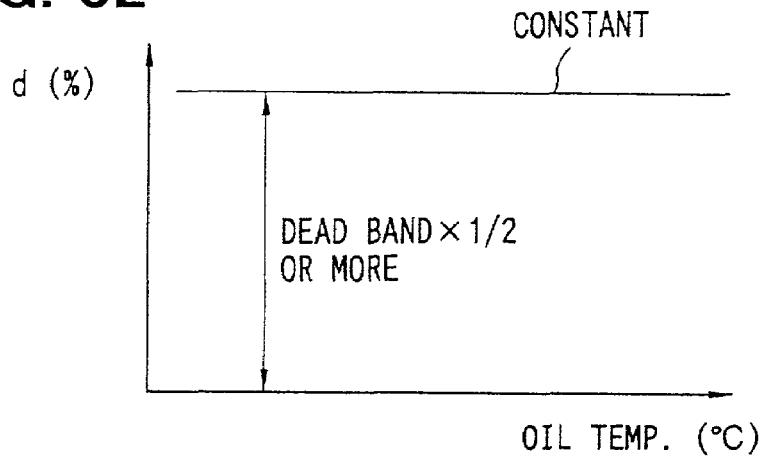
FIG. 32 shows a graph representing a relation between the amplitude d and the oil temperature in the tenth embodiment of the present invention.

(2): As shown in FIG. 32, the amplitude d of the vibration occurring in the learning process is fixed without regard to a parameter having a correlation with the dead band. Examples of such a parameter are the temperature of the oil, the temperature of the engine 11, the oil pressure and the revolution speed of the engine 11. The amplitude d is set at such a fixed value in advance that the duty value Duty's range of vibration occurring in the learning process can cover the entire area of the dead band without regard to the magnitude of the duty value Duty even for a maximum width of the dead band. The set magnitude of the amplitude d is stored in the ROM employed in the ECU 24. Also in this case, it is desirable to set the amplitude d at a fixed value at least equal to half the width of a maximum dead band. By setting the amplitude d at such a value, the duty value Duty's range of vibration occurring in the learning process can cover the entire area of the dead band without regard to the magnitude of the duty value Duty so that the learning precision of the holding duty value Dh can be prevented from worsening even under a condition of the increased dead band width caused by a low temperature of the oil and the like.

Figure 33:
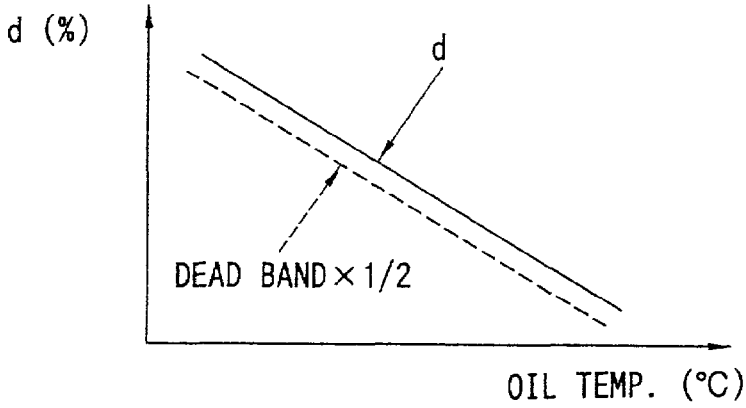
FIG. 33 shows graphs each representing a relation between the amplitude d and the oil temperature in the tenth embodiment of the present invention.

(3): As shown in FIG. 33, the amplitude d of the vibration occurring in the learning process is set on the basis of a parameter having a correlation with the dead band. Examples of such a parameter are the temperature of the oil, the temperature of the engine 11, the oil pressure and the revolution speed of the engine 11. Also in this case, it is desirable to set the amplitude d at a fixed value at least equal to half the width of the dead band. By setting the amplitude d at such a value, when the width of the dead band changes due to a variation in oil temperature and the like, the duty value Duty's range of vibration occurring in the learning process is varied in accordance with the change in dead-band width so that the vibration range of the duty value Duty can cover the entire area of the dead band.

Figure 34:
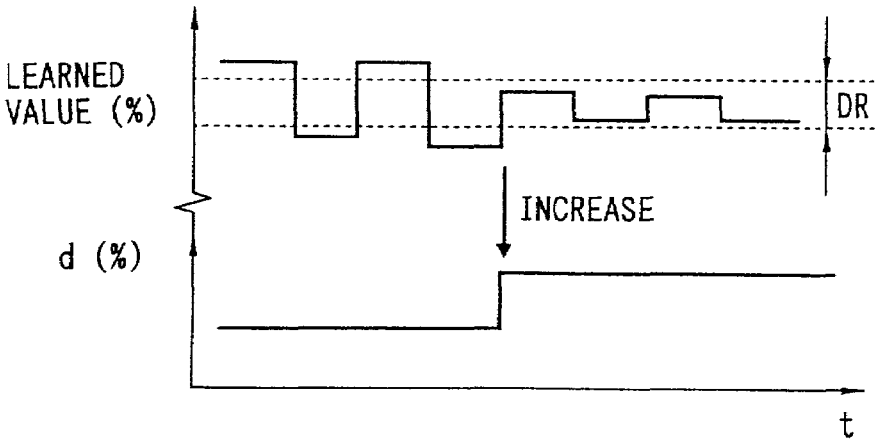
FIG. 34 shows graphs each showing a corrected state of the amplitude d in the tenth embodiment of the present invention.

(4): If the variations of the learned value of the holding duty value Dh are large, the amplitude d of the vibration occurring in the learning process is corrected by increasing the amplitude d. As shown in FIG. 34, for example, the variations of the learned value of the holding duty value Dh are examined to determine whether the variations are within a permissible range DR. If the variations of the learned value of the holding duty value Dh are continuously beyond the permissible range DR for a period of time exceeding a predetermined length, the amplitude d of the vibration occurring in the learning process is corrected by increasing the amplitude d. That is, if the variations of the learned value of the holding duty value Dh are large, the duty value Duty's range of vibration occurring in the learning process is determined to be insufficient for covering the entire area of the dead band. In this case, the amplitude d of the vibration occurring in the learning process is thus corrected by increasing the amplitude d. By correcting the amplitude d in this way, the duty value Duty's range of vibration occurring in the learning process can then cover the entire area of the dead band so that the variations of the learned value of the holding duty value Dh can be reduced.

Figure 30:
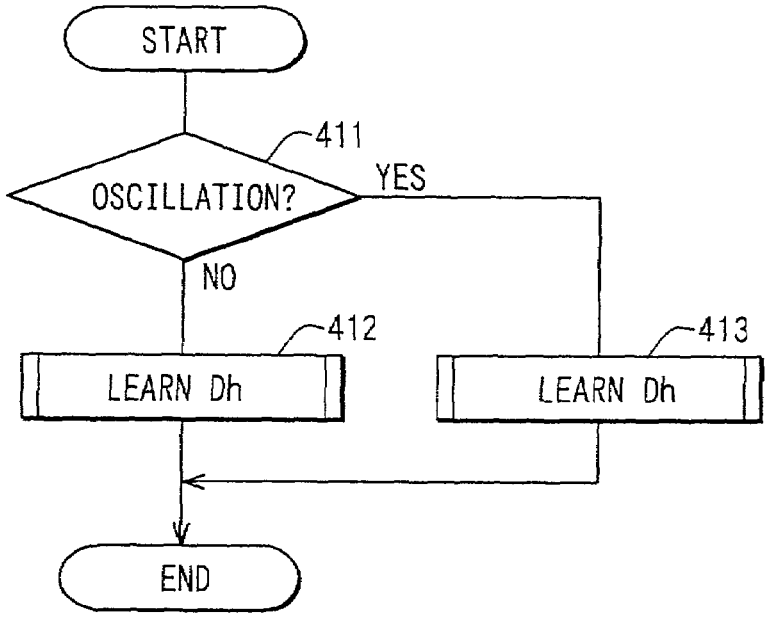
FIG. 30 is a flowchart representing a learning process according to the tenth embodiment of the present invention.

At a step 112*a*, the duty-value-learning program represented by the flowchart shown in FIG. 30 is executed to find a holding duty value Dh through a learning process as follows. The flowchart begins with a step 411 to determine whether, at the present time, control is being executed to vibrate the duty value Duty, that is, whether, at the present time, the amplitude d of the duty value Duty is greater than 0. If the vibration control is not being executed or if the amplitude d of the duty value Duty is 0, the flow of the program goes on to a step 412 to carry out the same processing as the duty-value-learning program represented by the flowchart shown in FIG. 6 for the first embodiment in order to find a holding duty value Dh through a learning process.

Figure 31:
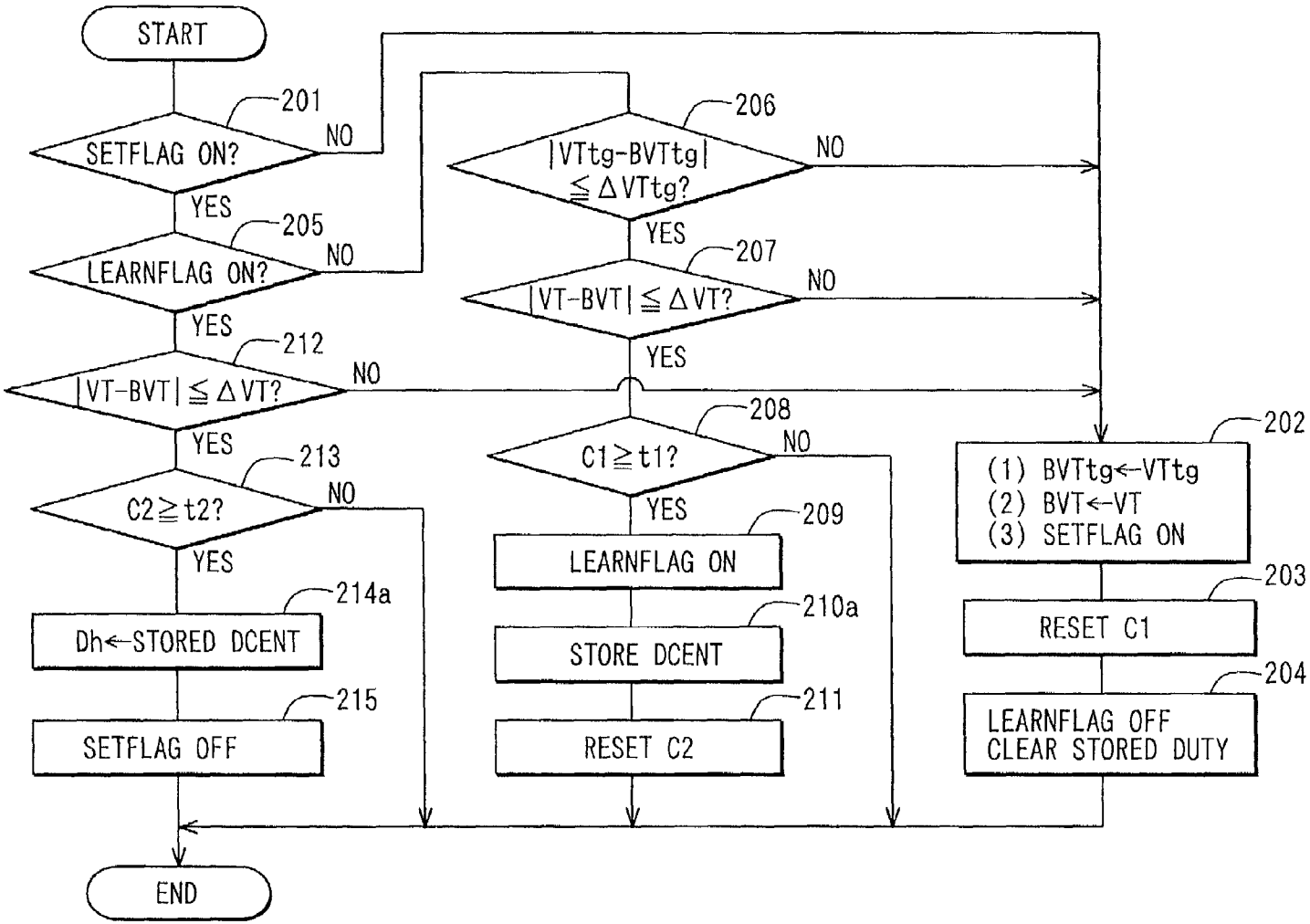
FIG. 31 is a flowchart representing another learning process according to the tenth embodiment of the present invention.

If the determination result obtained at the step 411 indicates that the vibration control is being executed, on the other hand, the flow of the program goes on to a step 413 to execute a duty-value-learning program represented by the flowchart shown in FIG. 31. This duty-value-learning program is a learning program provided for the vibration control.

At a step 210*a*, a learning process is carried out. In this learning process, the variation center DCENT of the duty value Duty observed at the point of time is stored in a memory. That is, a duty value Duty computed at the step 106 of the flowchart shown in FIG. 28 is stored in a memory. The duty value Duty computed at the step 106 is a duty value Duty before increasing or decreasing the amplitude d.

At a step 214*a*, the variation center DCENT of the duty value Duty stored in a memory at the step 210*a* is used as a new learned holding duty value Dh. The other steps are the same as the program represented by the flowchart shown in FIG. 6.

Figure 35:
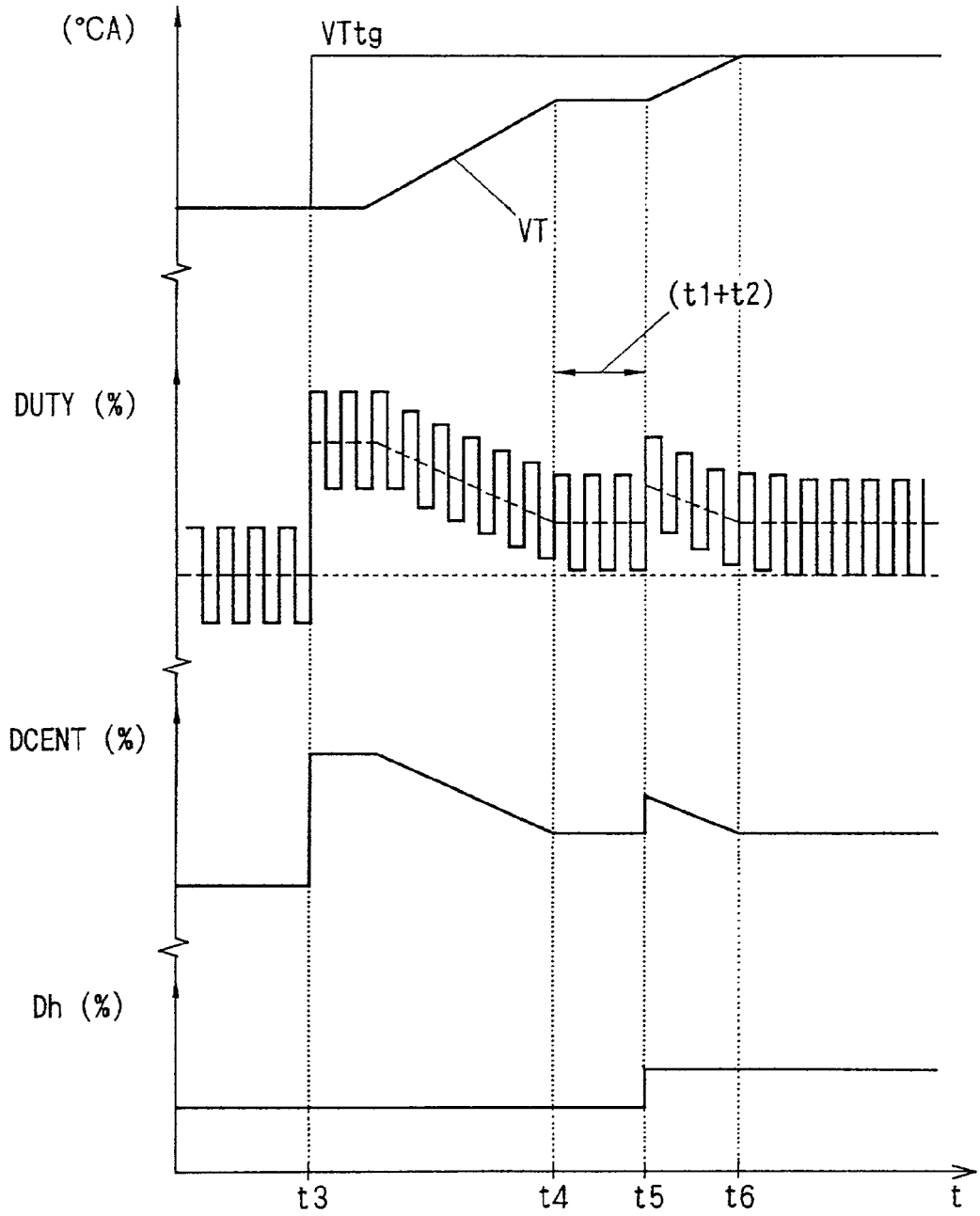
FIG. 35 shows time charts of a control state according to the tenth embodiment of the present invention.

Typical control according to the tenth embodiment is explained by referring to time charts shown in FIG. 35. The time charts shown in FIG. 35 are time charts for typical control executed to update the learned value of the holding duty value Dh in a process in which the actual valve timing changes to follow variations in target valve timing. In this typical control, before the actual valve timing is converged to a target valve timing, the variation of the actual valve timing enters an almost halted state, that is, the changing speed of the actual valve timing becomes equal to or lower than a predetermined value. The variation of the actual valve timing enters this almost halted state between times t4 and t5. At a point of time the almost halted state has been continuing for a predetermined time criterion t1, the variation center DCENT of the duty value Duty stored in a memory so far is used as a new learned holding duty value Dh. Thus, during this learning period (or in this halted state), the vibration control of the duty value Duty is continued to obtain a learned value of the holding duty value Dh in a state in which effects of the dead band are eliminated. In the time charts shown in FIG. 35, the learned value Dh is updated at a time t5.

After obtaining the learned value of the holding duty value Dh, the duty value Duty is changed by a correction quantity of the holding duty value Dh. Thus, the actual valve timing again starts changing in a direction toward the target valve timing. Finally, the actual valve timing is converged to the target valve timing.

In accordance to the tenth embodiment, even in a learning process to obtain a holding duty value Dh, while effects of the dead band are being eliminated by continuing the vibration control of the duty value Duty, a learned value of the holding duty value Dh is found. Thus, under a condition in which a learning process to obtain a holding duty value Dh is prohibited by the conventional system, while effects of the dead band are being eliminated by continuing the vibration control of the duty value Duty, a learned value of the holding duty value Dh can be found with a high degree of precision. An example of such a condition is a low temperature of the oil. As a result, it is possible to increase the frequency at which a learning process is carried out to find a holding duty value Dh.

Figure 36A:
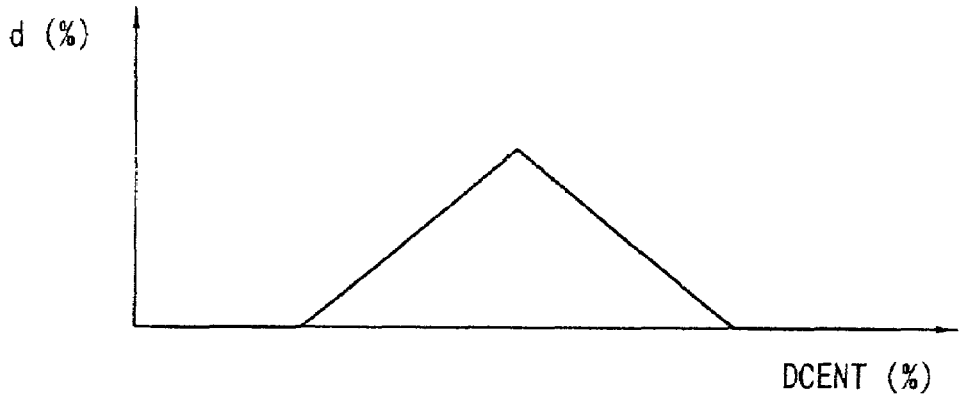
FIG. 36A shows a graph representing values of an amplitude in normal control according to the tenth embodiment of the present invention.
Figure 36B:
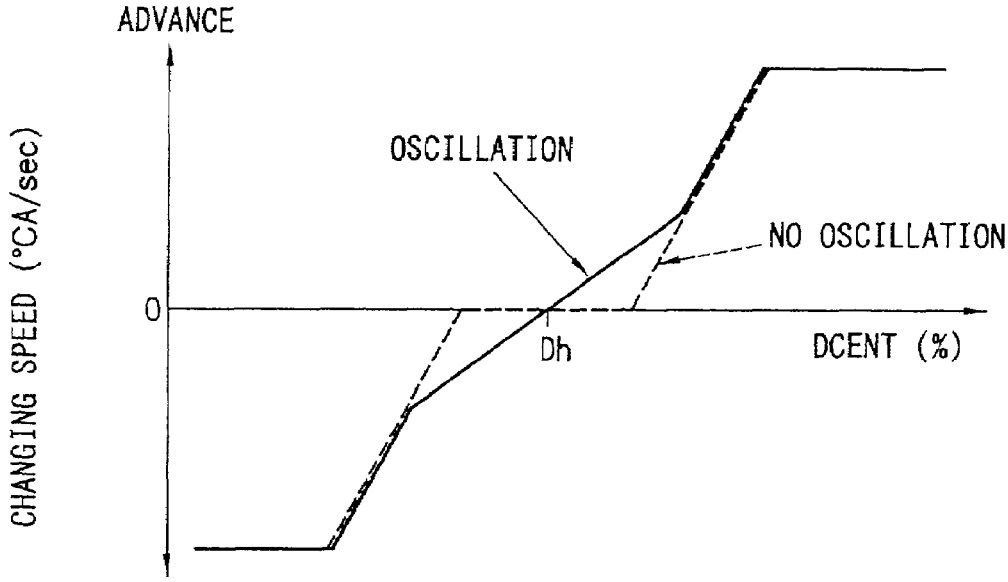
FIG. 36B shows a graph representing a control characteristic in normal control according to the tenth embodiment of the present invention.
Figure 37A:
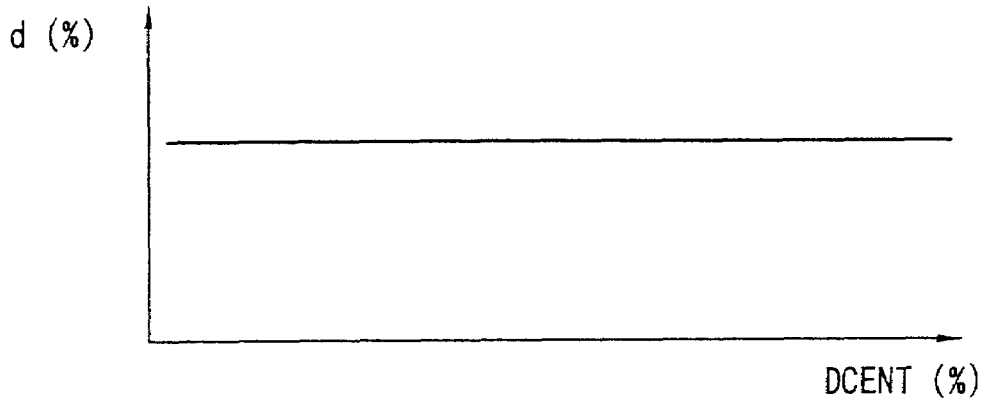
FIG. 37A shows a graph representing values of an amplitude in a learning process according to the tenth embodiment of the present invention.
Figure 37B:
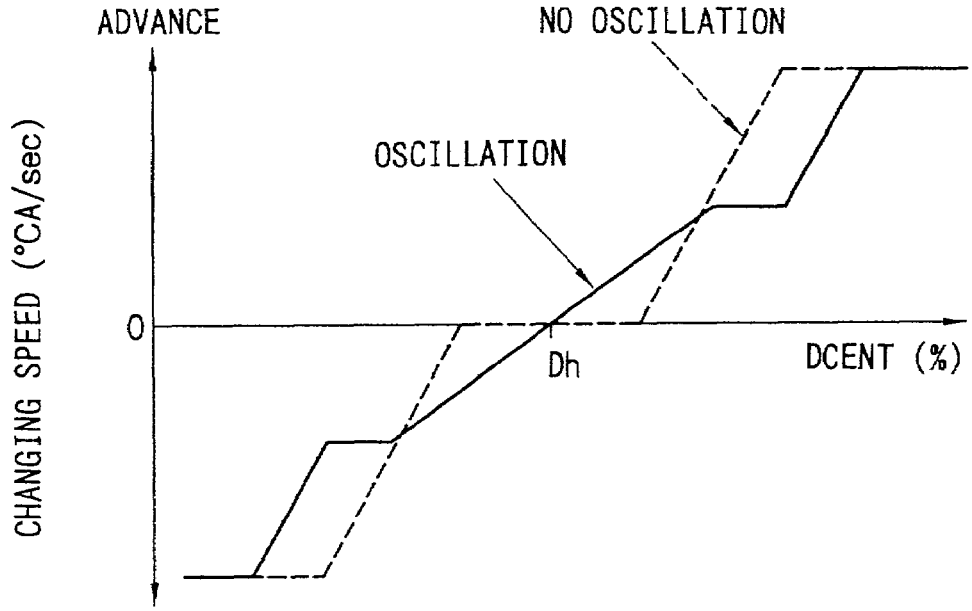
FIG. 37B shows graphs representing a control characteristic in a learning process according to the tenth embodiment of the present invention.

In the tenth embodiment, the amplitude d of vibration carried out in normal control can be set at a fixed value as is the case with the first embodiment. As shown in FIG. 36A, on the other hand, the amplitude d may also be changed in accordance with the vibration center value of the duty value Duty. In this case, the amplitude reaches a maximum when the vibration center value of the duty value Duty is at a position in close proximity to the holding duty value Dh or in close proximity to the center of the dead band. It is desirable to set the amplitude d at a value at least equal to half the width of the dead band. It is good to set the amplitude d at a value, which decreases by a quantity proportional to the distance between the vibration center value of the duty value Duty and a position in close proximity to the holding duty value Dh or the distance between the vibration center value of the duty value Duty and a position in close proximity to the center of the dead band. An area outside the dead band is originally an area with a good response characteristic. Thus, a good response characteristic of the valve-timing control can sufficiently be assured even without vibrating the duty value Duty. In addition, if the amplitude d is increased in an area with a good response characteristic, the control characteristic of the valve-timing control adversely deteriorates in the area with a good response characteristic as shown in FIG. 37B. If the amplitude d of the vibration of the duty value Duty is changed in accordance with the center value of the duty value Duty as shown in FIG. 36A, it is good to set the amplitude d of the vibration of the duty value Duty in the learning process at a fixed value independently of the duty value Duty seen at that point of time as shown in FIG. 37A. In this case, it is good to set the amplitude d of the vibration of the duty value Duty in the learning process at a value about equal to the maximum value of the amplitude d of the vibration of the duty value Duty in the normal control so that the vibration range of the duty value Duty in the learning process can cover the entire area of the dead band independently of the duty value Duty seen at that point of time. It is desirable to set the amplitude d of the vibration of the duty value Duty in the learning process at a value at least equal to half the width of the dead band. By setting the amplitude d of the vibration of the duty value Duty in the learning process at such values, the vibration range of the duty value Duty in the learning process can cover the entire area of the dead band with a high degree of reliability no matter what value the duty value Duty has in the learning process. Thus, the entire dead band can be hidden with a high degree of reliability. As a result, it is possible to avoid deterioration of the degree of precision with which the learning process is carried out to obtain a holding duty value Dh.

Eleventh Embodiment

When the target valve timing is set at the control range limit value on the advance side or the retard side, or in area in close proximity to the limit value, the actual valve timing hits the limit value on the advance side or the retard side in some cases. Accordingly, the changing speed of the valve timing may become 0. Thus, if a holding duty value Dh is found by carrying out a learning process when the target valve timing is set at the control range limit value on the advance side or the retard side, or in area in close proximity to the limit value, a state in which the actual valve timing is hitting the limit value on the advance side or the retard side is incorrectly recognized as a state held by the holding duty value Dh. As a result, it is quite within the bounds of possibility that a holding duty value Dh is incorrectly found through the learning process.

Figure 38:
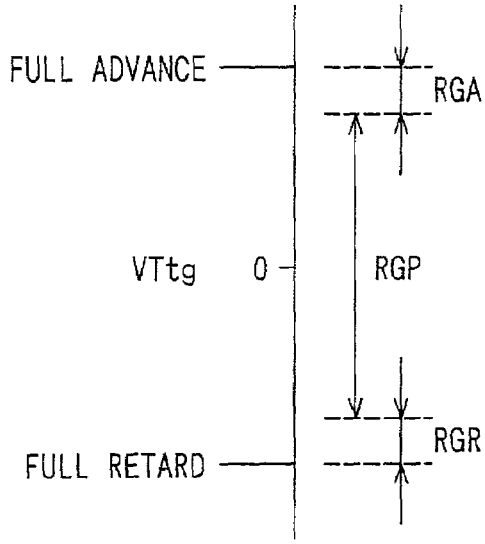
FIG. 38 is a diagram showing a permitted-learning area and prohibited-learning areas in an eleventh embodiment of the present invention.
Figure 39:
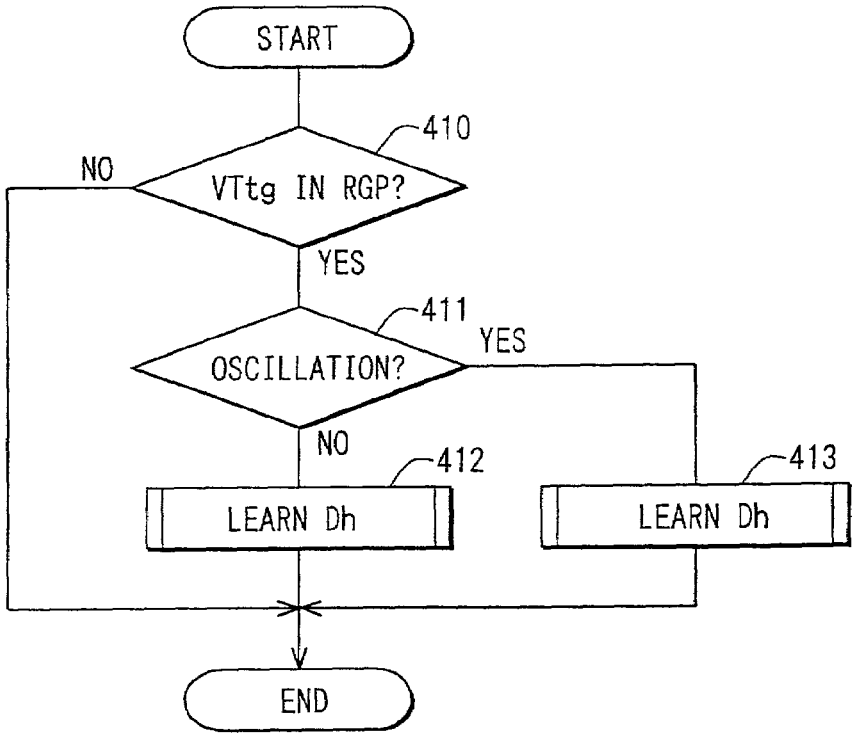
FIG. 39 is a flowchart representing a learning process according to the eleventh embodiment of the present invention.

In order to solve the above problem, in the eleventh embodiment shown in FIGS. 38 and 39, the target valve timing is set at the control range limit value on the advance side or the retard side, or in area in close proximity to the limit value, and learning prohibition areas RGA and RGR are each set as an area for which it is quite within the bounds of possibility that the actual valve timing hits the limit value on the advance side or the retard side. In the learning prohibition areas RGA and RGR, the learning process to obtain a holding duty value Dh is prohibited to naturally prevent an incorrect learned value of the holding duty value Dh from being obtained. In a permitted-learning area RGP, on the other hand, a holding duty value Dh is obtained by carrying out a learning process.

In the eleventh embodiment, the ECU 24 executes a holding-duty-value-learning program represented by a flowchart shown in FIG. 39. The flowchart begins with a step 410 to determine whether the target valve timing VTtg is within the permitted-learning area RGP of the learning process to obtain a holding duty value Dh. Only if the target valve timing VTtg is within the permitted-learning area RGP, does the flow of the program go on to steps 412 and 413 to carry out the learning process to obtain a holding duty value Dh.

In accordance with the eleventh embodiment, it is possible to prevent an erroneous learned holding duty value Dh from being incorrectly obtained.

Twelfth Embodiment

Figure 40:
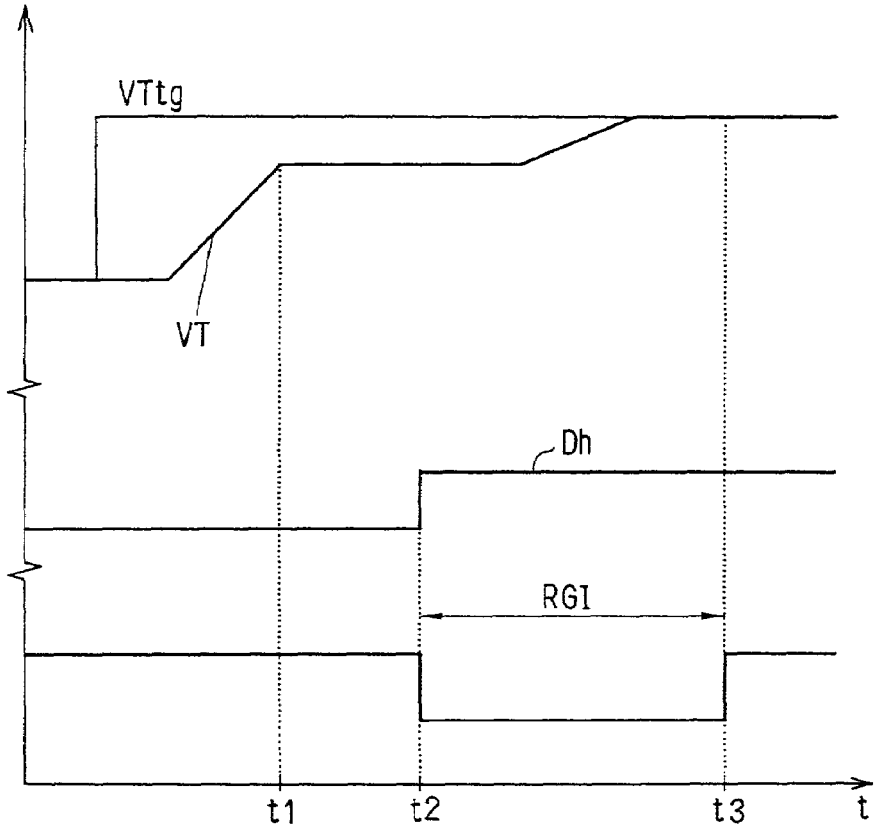
FIG. 40 shows time charts of a control state according to a twelfth embodiment of the present invention.

If the learning process to obtain a holding duty value Dh is carried out too often, the valve timing changes excessively. If the holding duty value Dh is shifted from a proper value in the course of control to hold an actual valve timing at the target actual timing, the actual valve timing will show a behavior like one shown in FIG. 40. From a time t1, the actual valve timing is held in a state of being shifted from the target valve timing. In a period between the time t1 and a time t2, the learned value of the holding duty value DH is updated so as to correct the shift of the actual valve timing from the target valve timing. At the time t2, the duty value Duty changes to reflect the learned value and the actual valve timing changes in a direction toward the target valve timing. After the time t2, the actual valve timing exhibits a response delay. Thus, it is quite within the bounds of possibility that the learning process is carried out again. Such duplicated learning processes lower the degree of precision with which the learning process is carried out.

Figure 41:
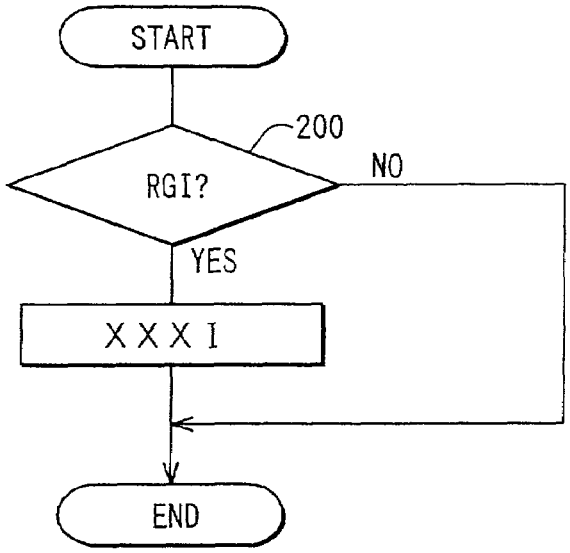
FIG. 41 is a flowchart representing a learning process according to the twelfth embodiment of the present invention.

In the twelfth embodiment, the ECU 24 executes a holding-duty-value-learning program represented by a flowchart shown in FIG. 41. Provided for vibration control, the program begins with a step 200 to determine whether a predetermined time RGI has lapsed since the end of a learning process to find a previous holding duty value Dh. The learning process to find a holding duty value Dh is prohibited till the predetermined time RGI lapses. The learning-process prohibition period RGI is set at a value slightly longer than a lapse of time since a learning process to obtain a holding duty value Dh is ended till the target valve timing is converged to the target valve timing. By setting the learning-process prohibition period RGI at such a value, it is possible to prevent a learning process to find a holding duty value Dh from being carried out during a period in which the actual valve timing is varying in a direction toward the target valve timing at a response delay after the learning process to find a holding duty value Dh is ended. It is thus also possible to prevent degradation of the precision at which the learning process is carried out to find a holding duty value Dh. After the step 200, the program represented by the flowchart shown in FIG. 31 is executed.

Thirteenth Embodiment

In the case of the tenth to twelfth embodiments, effects of the dead band are eliminated by executing control to vibrate the duty vibration value Duty in the course of the normal valve-timing control or during a learning period. Even when control to vibrate the duty value Duty is not executed in the course of the normal control of the valve timing, the control to vibrate the duty value Duty is executed in the learning process to find a holding duty value Dh while eliminating effects of the dead band.

The thirteenth embodiment is explained by referring to FIGS. 42 to 45 as follows.

Figure 42:
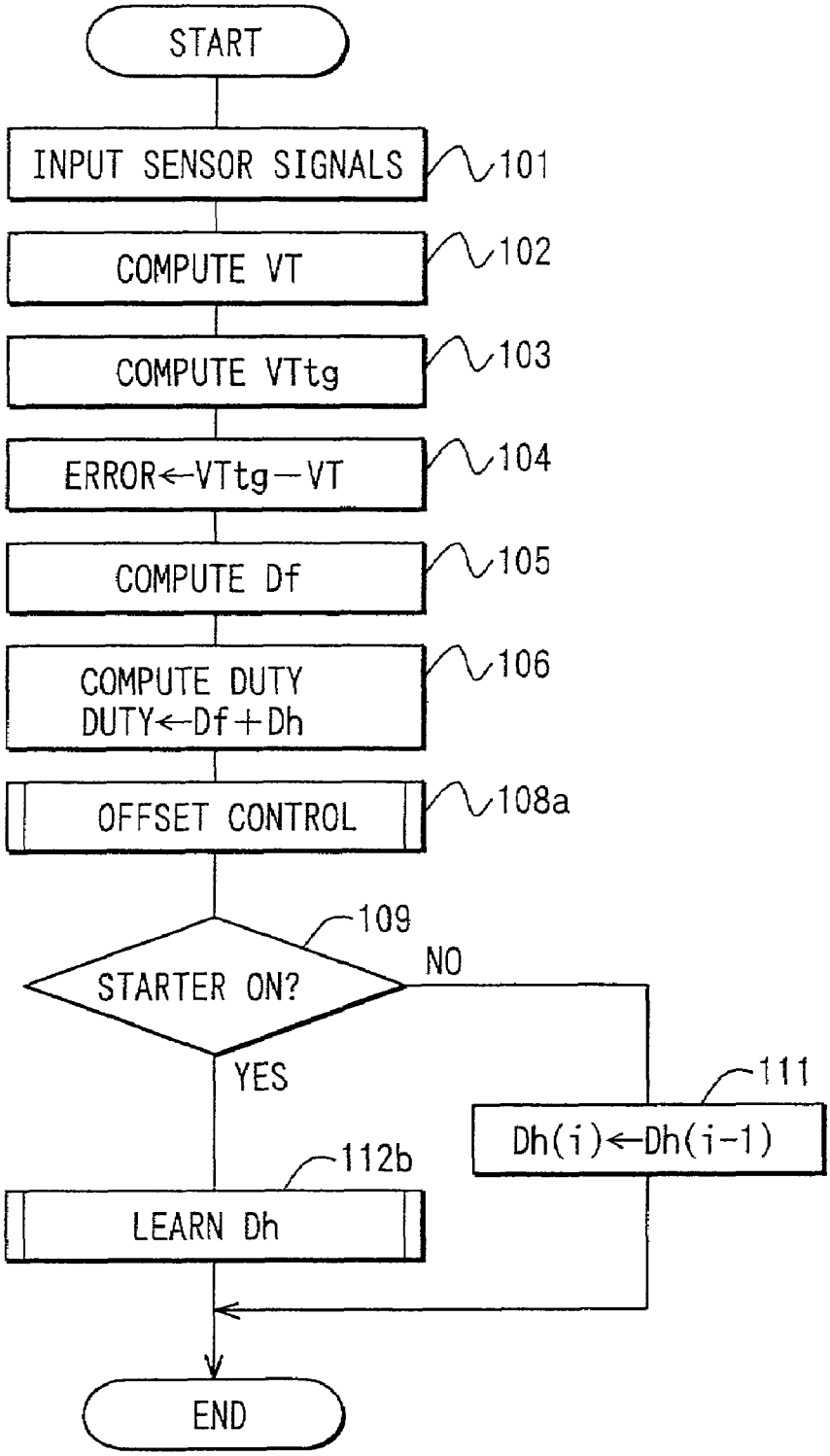
FIG. 42 is a flowchart representing control processing according to a thirteenth embodiment of the present invention.
Figure 43:
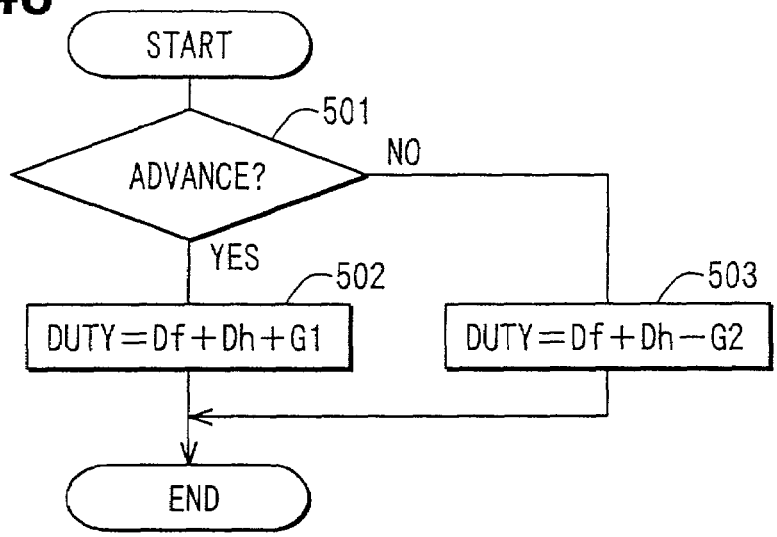
FIG. 43 is a flowchart representing other control processing according to the thirteenth embodiment of the present invention.

Only differences from the first embodiment are described. FIG. 42 is a flowchart representing a valve-timing control program. At a step 108*a*, a dead-band-handling control program represented by a flowchart shown in FIG. 43 is executed. In this case, the duty value Duty's portion going beyond the dead band is offset.

When the program represented by the flowchart shown in FIG. 43 is activated, the flowchart begins with a step 501 to determine whether the target valve timing has a value on the retard direction relative to the present actual valve timing. If the target valve timing has a value in the retard direction relative to the present actual valve timing, the flow of the program goes on to a step 502 at which a duty value Duty is computed from a feedback correction value Df, a holding duty value Dh and an offset quantity G1 on the advance side in accordance with the following equation:

$$\text{Duty}=Df+Dh+G1$$

The offset quantity G1 is shown in FIG. 21. As a result, the duty value Duty is changed in the advance direction by the offset quantity G1 to offset the difference between the target valve timing and the present actual valve timing.

If the target valve timing has a value in the advance direction relative to the present actual valve timing, on the other hand, the flow of the program goes on to a step 503 at which a duty value Duty is computed from the feedback correction value Df, the holding duty value Dh and an offset quantity G2 on the retard side in accordance with the following equation:

$$\text{Duty}=Df+Dh-G2$$

The offset quantity G2 is shown in FIG. 21. As a result, the duty value Duty is changed in the retard direction by the offset quantity G2 to offset the difference between the target valve timing and the present actual valve timing.

Figure 44:
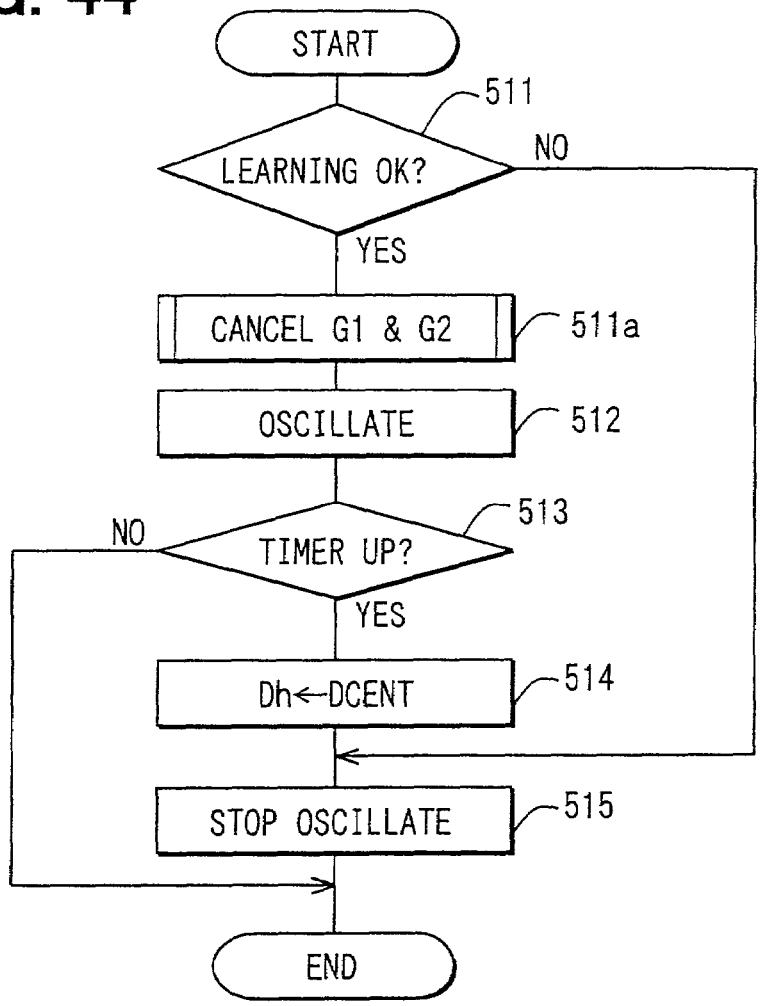
FIG. 44 is a flowchart representing a learning process according to the thirteenth embodiment of the present invention.

As a step 112*b* of the flowchart shown in FIG. 42, a holding-duty-value-learning program represented by a flowchart shown in FIG. 44 is executed. This program begins with a step 511 to determine whether predetermined conditions for execution of the learning process are satisfied. The predetermined conditions for execution of the learning process include:

(1): A period, during which both the target valve timing and the actual valve timing are each sustained at an approximately constant value, shall have been continuing for at least a predetermined time.

(2): A predetermined time shall have lapsed since the end of the previous learning process to find a duty value Dh. If these conditions are all met, the predetermined conditions for execution of the learning process can be considered to hold true. If even one of the conditions is not satisfied, on the other hand, the predetermined conditions for execution of the learning process are considered not to hold true. If the predetermined conditions for execution of the learning process do not hold true, the control to vibrate the duty value Duty to be described later is not executed. It is to be noted that if the predetermined conditions for execution of the learning process becomes unsatisfied in the course of the control to vibrate the duty value Duty or during the learning process, the control to vibrate the duty value Duty is terminated immediately at this point of time at a step 515.

If the determination result indicates that the predetermined conditions for execution of the learning process are satisfied, the flow of the program goes on to a step 511*a*. At the step 511*a*, the offset processing carried out at the step 108*a* of the flowchart shown in FIG. 42 is canceled. Then, at the next step 512, the vibration of the duty value Duty is started. The vibration processing is the same as the tenth to twelfth embodiments. Subsequently, the flow of the program goes on to a step 513 to determine whether a timer has reached a predetermined value. This timer is a timer for measuring the length of a period during which both the target valve timing and the actual valve timing are each sustained at an approximately constant value. If the timer has reached the predetermined value, the flow of the program goes on to a step 514. At the step 514, the vibration center DCENT of the duty value Duty observed at that point of time is used as a new learned holding duty value Dh. Then, at step 515, the vibration of the duty value Duty is halted.

Figure 45:
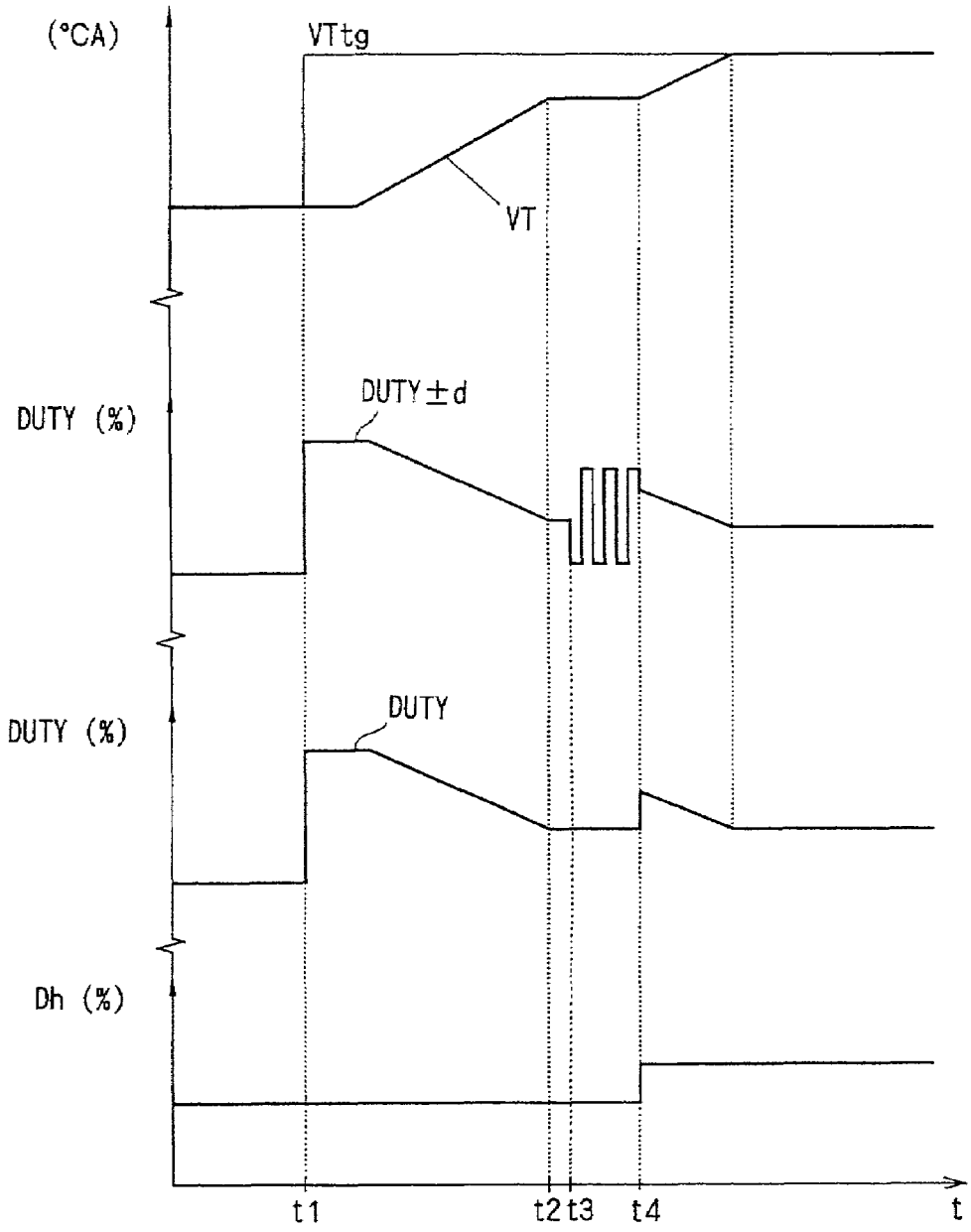
FIG. 45 shows time charts of a control state according to the thirteenth embodiment of the present invention.

FIG. 45 is a diagram showing a control state of the thirteenth embodiment. At a time t1, the target valve timing VTtg is changed. The duty value Duty changes in accordance with a deviation Error. At a time t2, the actual valve timing VT enters an all but halted state prior to convergence to the target valve timing VTtg. As this halted state continues for a predetermined period of time, at a time t3, the conditions for execution of learning process are satisfied. Thus, at the time t3, the vibration of the duty value Duty starts. In addition, as a predetermined time further lapses, the holding duty value Dh is updated at a time t4. As a result, the actual valve timing VT starts moving in a direction toward the target valve timing VTtg. The actual valve timing VT is soon converged to the target valve timing VTtg.

In the thirteenth embodiment, the duty value Duty is vibrated during a learning period. Thus, even under a condition unfavorable for a learning process, a holding duty value Dh can be found through the learning process with a high degree of precision. An example of the unfavorable condition is a low temperature of the oil. As a result, the learning process can be carried out more frequently.

Fourteenth Embodiment

Figure 46:
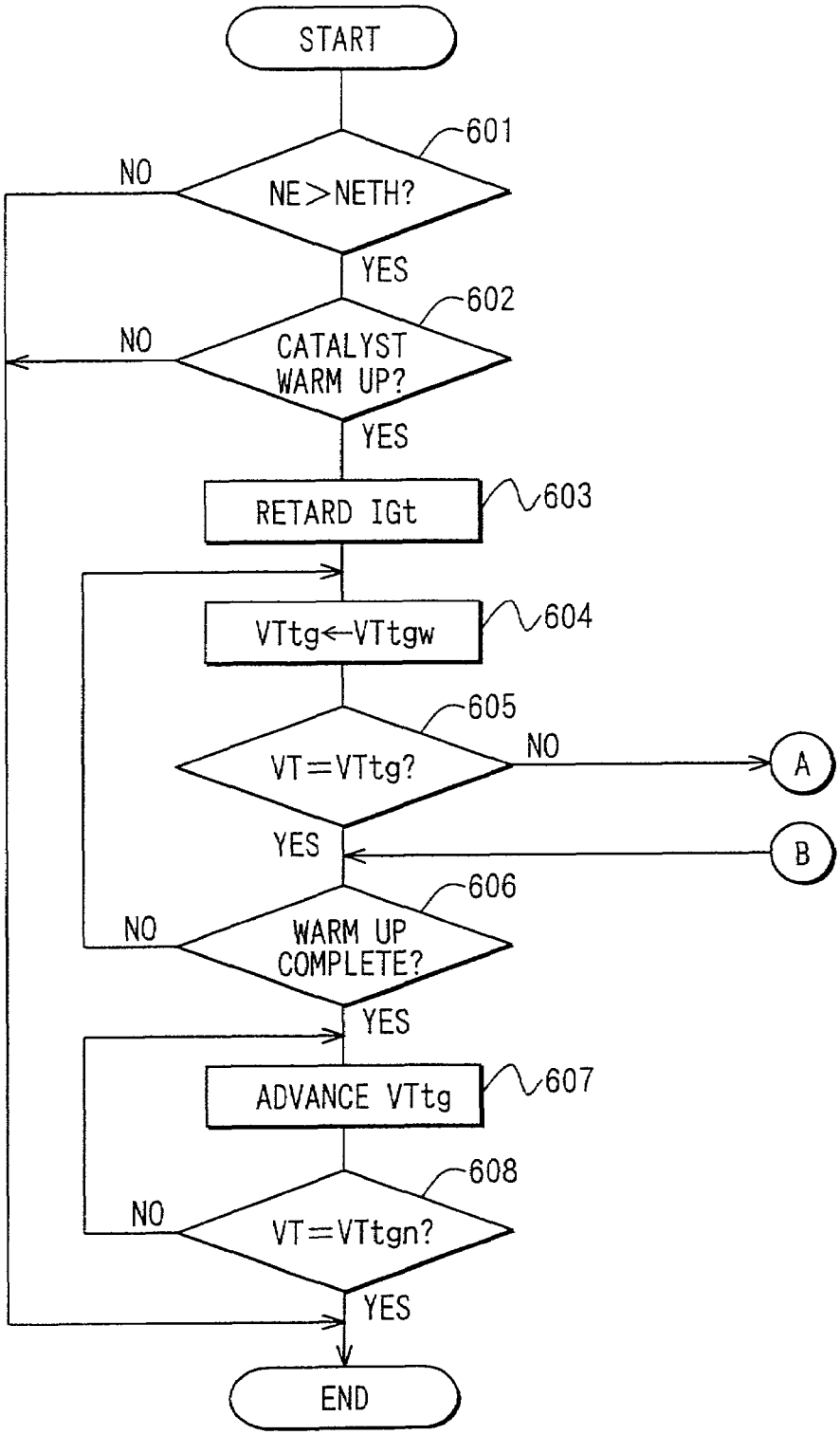
FIG. 46 is a flowchart representing a control process and abnormality determination processing, which are provided by a fourteenth embodiment of the present invention.
Figure 47:
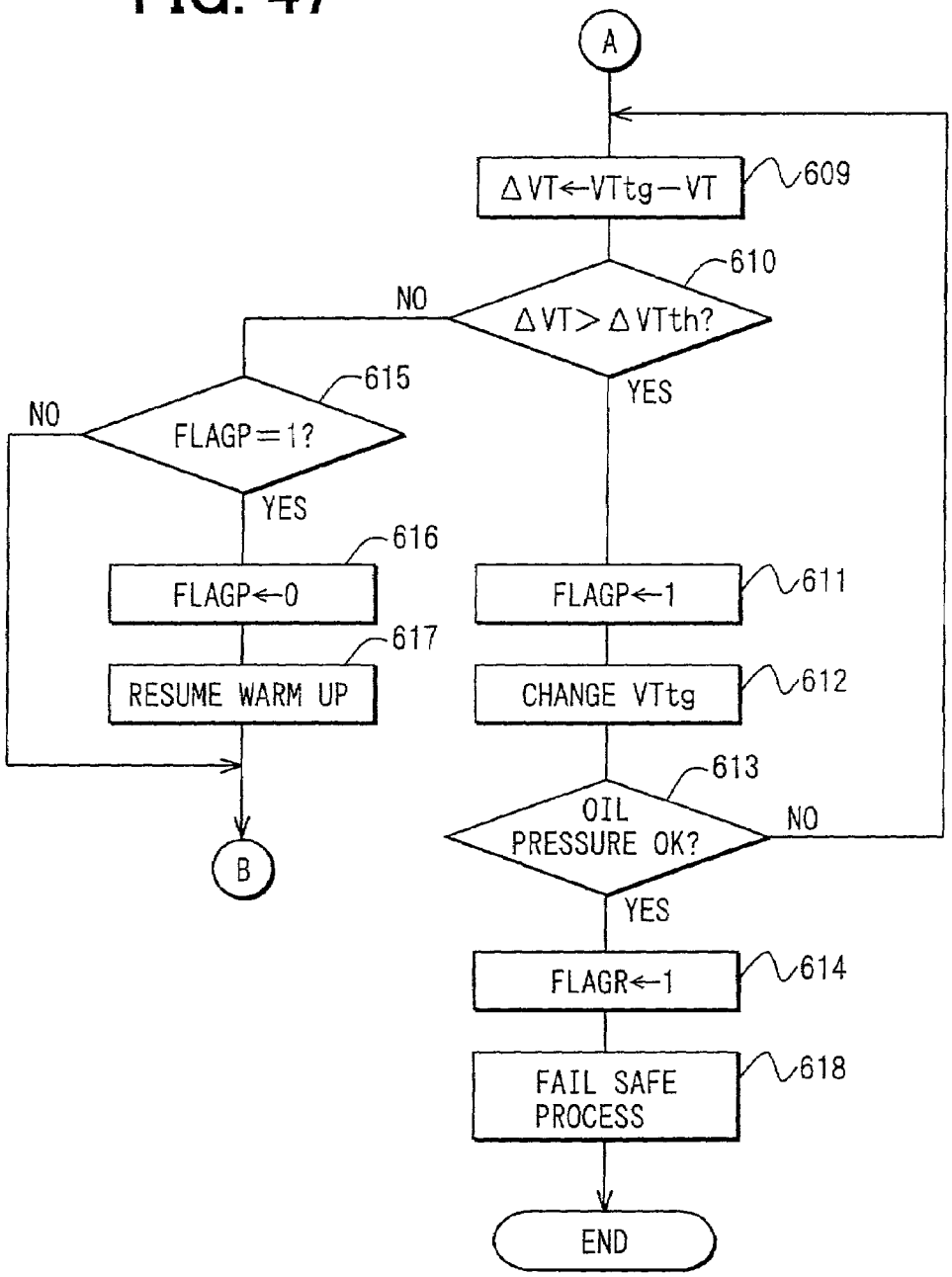
FIG. 47 is a continuation flowchart representing a control process of the fourteenth embodiment and abnormality determination processing, which are provided by the fourteenth embodiment of the present invention.

In a fourteenth embodiment, the ECU 24 executes programs represented by flowcharts shown in FIGS. 46 and 47. In this embodiment, in the course of catalyst early heating control executed after a start of the engine 11, the opening timing of the intake valve is set at a retard angle to improve exhaust emission occurring in the control of processing to heat the catalyst at an early time. In addition, a deviation of the actual opening position of the intake valve relative to the target opening position of the intake valve is examined to determine whether the deviation is greater than a predetermined abnormality criterion value. If the engine 11 is started with some oil leaking, it takes some time for the oil pressure of the oil-pressure circuit employed in the variable valve timing apparatus 18 to increase to a value in a proper range. During this period of time, even if the deviation of the actual opening position of the intake valve relative to the target opening position of the intake valve is found greater than the predetermined abnormality criterion value, no abnormality is determined to exist in the variable valve timing apparatus 18 till a condition for determination of completion of oil replenishment is satisfied. The condition for determination of completion of oil replenishment is set so that the oil pressure for driving the variable valve timing apparatus 18 can be determined to have increased to a value in the proper range.

The programs represented by the flowcharts shown in FIGS. 46 and 47 are each executed at predetermined time intervals or at each predetermined crank angle repeatedly. The flowchart shown in FIG. 46 begins with a step 601 to determine whether the start of the engine 11 has ended. Concretely, the engine evolution speed NE is examined to determine whether it has exceeded a complete-combustion criterion value NETH. The complete-combustion criterion value NETH is typically 400 rpm. Prior to the start of the engine 11, the valve timing of the intake valve is locked at a valve opening position VTst for the start of the engine 11 by a lock mechanism of the variable valve timing apparatus 18. The valve opening position VTst is typically the intake TDC. As the start of the engine is completed, a step 602 is executed. At the step 602, conditions for execution of processing to heat the catalyst at an early time are examined to determine whether the conditions are satisfied. The conditions for execution of the processing to heat the catalyst at an early time typically include:

(1): The engine 11 shall be in a cold-start state, that is, the temperature of the cooling water shall be equal to or lower than a predetermined temperature.

(2): The engine 11 shall be in an idle operating state.

It the above conditions all hold true, the conditions for execution of the processing to heat the catalyst at an early time are considered to be satisfied. If even only one of the above conditions does not hold true, on the other hand, the conditions for execution of the processing to heat the catalyst at an early time are considered to be unsatisfied. If the conditions for execution of the processing to heat the catalyst at an early time are not satisfied, the execution of this program is ended. Thereafter, the variable valve timing apparatus 18 is subjected to the normal control.

If the conditions for execution of the processing to heat the catalyst at an early time are satisfied, on the other hand, the flow of the program goes on to a step 603 at which an ignition timing Igt is retarded. The ignition timing Igt is retarded to a target ignition timing set for the processing to heat the catalyst at an early time. For example, the ignition timing is retarded to an ATDC of 5 degrees Celsius. In this way, the temperature of the exhausted gas is increased to boost the processing to heat the catalyst.

Then, at the next step 604, in order to reduce the exhaust emission, the valve timing VT of the intake valve is retarded to the target valve timing VTtgw set for the processing to heat the catalyst at an early time. For example, the valve timing VT is retarded to an ATDC of 20 degrees CA. In a step 605, it is determined that whether the valve timing VT of the intake valve has attained the target valve timing VTtgw. In a step 606, it is determined that whether the processing to heat the catalyst at an early time has been completed. For example, the determination can be obtained by determining whether a lapse of time since the start of the engine 11 has exceeded a predetermined period. If the processing to heat the catalyst at an early time has been completed, the flow of the program goes on to steps 607 and 608. At the step 607, the target valve timing VTtg is gradually advanced from the target valve timing VTtgw set for the processing to heat the catalyst at an early time. This advance processing is carried out to gradually advance the target valve timing VTtg to a normal target valve timing VTtgn. Then, at the next step 608, the actual target valve timing VT is examined to determine whether the actual target Valve timing VT has reached the normal target valve timing VTtgn.

If the determination result obtained at the step 605 indicates that the valve timing VT of the intake valve has not attained the target valve timing VTtgw, on the other hand, the flow of the program goes on to a step 609 of the flowchart shown in FIG. 47. At the step 609, a deviation ΔVT is computed in accordance with the following equation:

$$\Delta VT = VTtg - VT$$

Then, the flow of the program goes on to a step 610 to determine whether the deviation ΔVT is greater than an abnormal criterion value ΔVTth. The abnormal criterion value ΔVTth is typically 2 degrees CA.

If the deviation ΔVT is determined to be greater than the abnormal criterion value ΔVTth before a condition for determination of completion of oil replenishment to be described later is satisfied, it is quite within the bounds of possibility that the deviation ΔVT exceeds the abnormal criterion value ΔVTth due to a leak of oil. In this case, the abnormal state may be very likely solved. For this reason, the flow of the program goes on to a step 611 at which a FLAGP flag showing that an abnormality has been preliminarily determined is set at 1. That is, at the step 611, a high probability of an abnormality is stored in a memory as a preliminarily determined abnormality. In such a case, the processing to heat the catalyst at an early time and the control of ignition retardation may be halted.

Then, at the next step 612, the target valve timing of the intake valve is advanced from the current actual valve timing by a predetermined quantity VR. Concretely, the target valve timing of the intake valve is changed to a value on the advance side by, for example, 4 degrees CA. In this way, the target valve timing of the intake valve is brought to a value close to an actual valve timing while the deviation$\Delta$VT is being prevented from becoming equal to or smaller than the abnormal criterion value $\Delta$VTth.

Subsequently, the flow of the program goes on to a step 613 to determine whether the condition for determination of completion of oil replenishment is satisfied by determining whether a lapse of time since the start of the engine 11 has reached or exceeded a predetermined criterion time KT. The predetermined criterion time KT is set at a time required to increase the oil pressure of the oil-pressure circuit to a value in a proper range since the oil-pressure circuit is filled with oil. Typically, the predetermined criterion time KT is 50 seconds. If the condition for determination of completion of oil replenishment is not satisfied, the flow of the program goes back to the step 609.

If the determination result obtained at the step 610 indicates that the deviation $\Delta$VT is not greater than an abnormal criterion value $\Delta$VTth, on the other hand, the flow of the program goes on to a step 615. At the step 615, the FLAGP flag is examined to verify that the flag has been set at 1. If the FLAGP flag has been set at 1, the flow of the program goes on to a step 616. At the step 616, the FLAGP flag is reset to 0. Then, at the next step 617, the target valve timing VTtg is gradually returned to the target valve timing VTtgw set for the processing to heat the catalyst at an early time. Afterward, the flow of the program goes back to the step 606 of the flowchart shown in FIG. 46.

If the determination result obtained at the step 613 indicates that the condition for determination of completion of oil replenishment is satisfied, on the other hand, the flow of the program goes on to a step 614. At the step 614, a FLAGR flag indicating an abnormality is set at 1. At this point of time, an abnormality is determined to exist. Then, at the next step 618, information on the abnormality is stored in a rewritable non-volatile memory such as a buffer RAM of the ECU 24, and fail-safe processing is carried out. For example, a warning lamp shown in none of the figures is turned on to give a warning to the driver.

Figure 48:
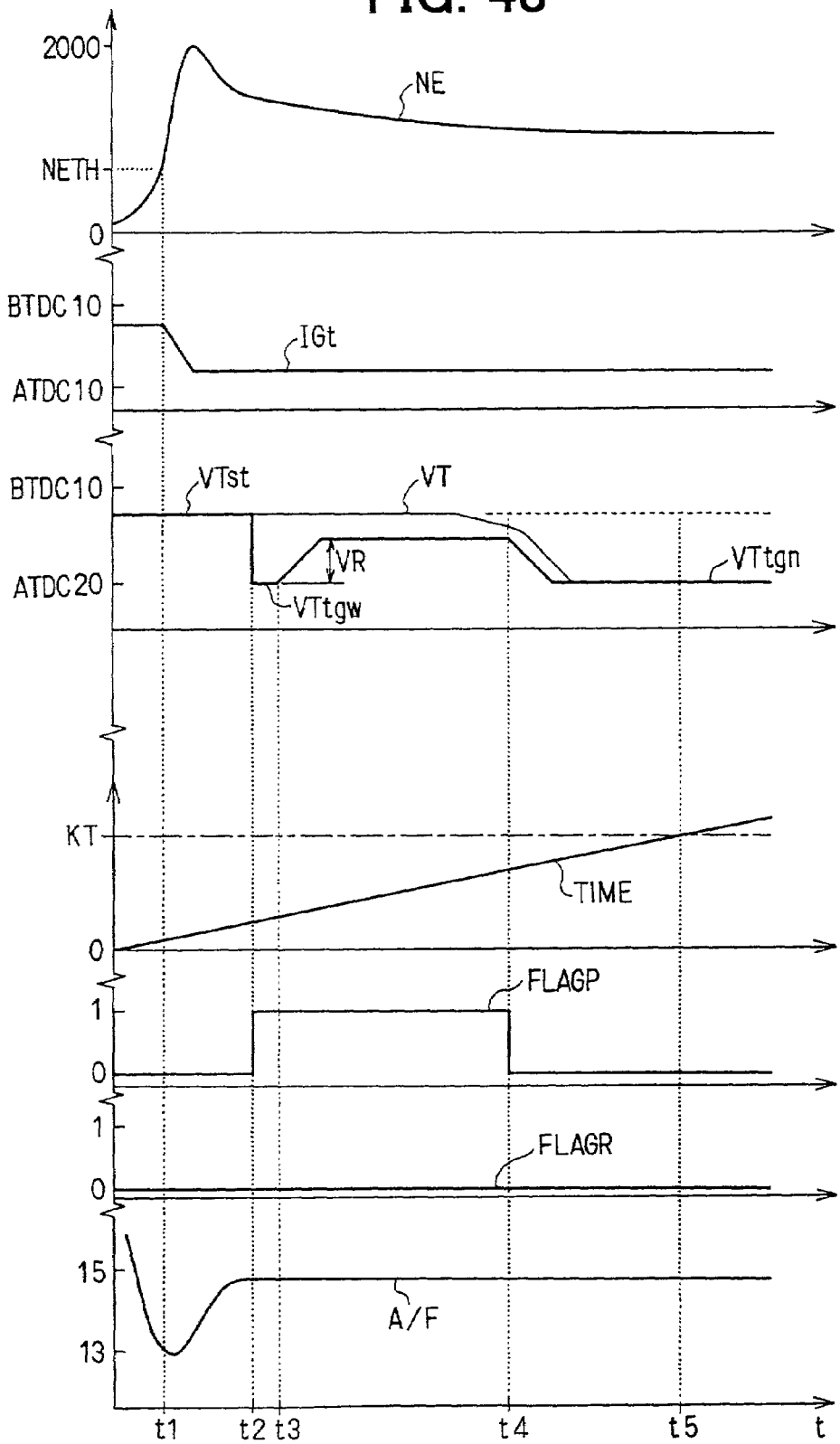
FIG. 48 shows time charts of a control state according to the fourteenth embodiment of the present invention.

FIG. 48 is a diagram showing a control state of this embodiment. FIG. 48 shows a case in which the engine 11 has been started with oil leaking out. In the case shown in the figure, no abnormality exists in the variable valve timing apparatus 18.

At a start of the engine 11, the actual valve timing VT is locked at a start-time valve timing VTst. When the engine 11 is started at a time t1, the ignition timing IGt is retarded. Then, at a time t2, the valve timing is retarded to the target valve timing VTtgw set for the processing to heat the catalyst at an early time. Thus, exhaust emission is reduced. Right after the start of the engine 11, the oil-pressure circuit has not been filled up by oil. Thus, the actual valve timing VT is not capable of following the target valve timing VTtg. As a result, at a time t2, the deviation $\Delta$VT exceeds the abnormal criterion value $\Delta$VTth, causing the FLAGP flag to be set at 1. Then, at a time t3, the target valve timing is shifted by a predetermined quantity VR to a value closer to the actual valve timing VT. Thus, the actual valve timing is prevented from changing abruptly when the oil-pressure circuit is filled up with oil. Subsequently, at a time t4, the deviation $\Delta$VT becomes smaller than the abnormal criterion value $\Delta$VTth. At the same time t4, the FLAGP flag is reset to 0. Later, the target valve timing is again restored to the target valve timing VTtgw. Thus, the actual valve timing gradually changes. The actual valve timing is soon converged to the target valve timing VTtgw. The time lapse TIME since the start of the engine 11 reaches a criterion value KT at a time t5. In the case of the time charts shown in FIG. 48, the sustenance of the FLAGR flag at 0 is continued. As for the air-fuel ratio A/F, variations right after the start of the engine 11 occur to be followed by a transition to a stable state.

In this embodiment, existence of an abnormality is not determined till the condition for determination of completion of oil replenishment is satisfied. It is thus possible to lower the possibility of incorrect determination of an abnormality right after the start of the engine 11.

In addition, since an abnormality is determined preliminarily, it is possible to detect a state in which an abnormality most likely exists. Furthermore, if there is a possibility of an oil leak, the embodiment carries out processing to take the target valve timing to an actual valve timing at the step 612 and processing to gradually restore the target valve timing to the target valve timing set for the processing to heat the catalyst at an early time at the step 617 right after replenishment of oil. It is thus possible to avoid an abrupt variation in a valve timing after the replenishment of oil. As a result, the exhaust emission and the drivability can be prevented from deteriorating.

The condition for determination of completion of oil replenishment, which is checked at the step 613, can be replaced by a technique described as follows.

Figures 49, 50, 51:
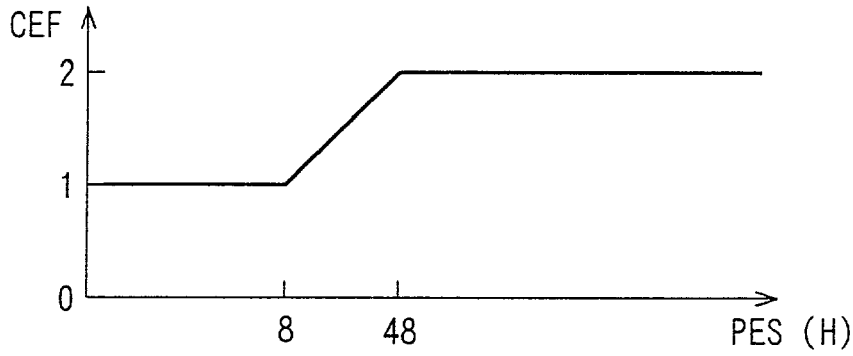
FIG. 49 shows a table used for finding a predetermined criterion time KT that is suitable for a cooling-water temperature Tw.
FIG. 50 shows a map used for finding a correction coefficient CEF that is suitable for an engine stopped time PES.
FIG. 51 shows a table used for finding a predetermined criterion value KNE that is suitable for a cooling-water temperature Tw.

For example, the predetermined criterion time KT used at the step 613 can be changed in accordance with the temperature of the cooling water by using a table shown in FIG. 49 or an equation. Thus, even if the viscosity (or the flowability) of the oil changes in accordance with the temperature of the cooling water and the temperature of the oil, proper determination is possible.

The predetermined criterion time KT can be set in accordance with a time RES during which the engine 11 is in a stopped state. For example, a map shown in FIG. 50 or an equation is used for finding a correction coefficient CEF that is suitable for the engine-stopped-state time RES. The correction coefficient CEF is used for correcting a basic criterion time KTB to find a criterion time KT. Typically, a criterion time KT is found as follows:

$$KT=KTB\times CEF$$

It is thus possible to compensate the criterion time KT for an oil-leak quantity, which changes in accordance with the engine-stopped-state time RES. In addition, a predetermined criterion time KT varied in accordance with the cooling-water temperature Tw can be multiplied by a correction coefficient changed in accordance with the engine-stopped-state time RES to result in a product, which is used as a final predetermined criterion time KT. Thus, by setting a determination condition in accordance with a parameter affecting replenishment of oil in this way, it is possible to prevent a period, in which determination of an abnormality is inhibited, from becoming too long.

At the step 613, the condition for determination of completion of oil replenishment can also be considered to be satisfied if an engine speed $\Sigma$NE cumulated after a start of the engine 11 becomes at least equal to a predetermined criterion value KNE. The engine speed $\Sigma$NE cumulated after a start of the engine 11 is proportional to a post-start cumulative rotational speed (or a post-start cumulative oil flow amount) of the oil pump 20. The greater the post-start cumulative rotational speed of the oil pump 20, the greater the cumulative amount of oil supplied to the oil-pressure circuit. Thus, when the engine speed ΣNE cumulated after a start of the engine 11 becomes at least equal to the predetermined criterion value KNE, the oil pressure of the oil-pressure circuit can be determined to have increased to a value in a proper range. It is to be noted that an engine speed ΣNE cumulated after a start of the engine 11 is found by cumulating the engine speeds NE (rpm) detected by the crank-angle sensor 23 in time units of typically 1 minute. The criterion value KNE can be a constant of typically 90,000 rpm. As an alternative, a table shown in FIG. 51 or an equation can be used to change the criterion value KNE to a value that is suitable for the cooling-water temperature Tw. In addition, a basic criterion value KNEB can be multiplied by the correction coefficient CEK varying in accordance with the engine-stopped-state time RES to result in a product used as a final criterion value KNE as follows.

$$KNE=CEK\times KNEB$$

In addition, a basic criterion value KNEB that is suitable for a cooling-water temperature Tw can be set in accordance with a table similar to that shown in FIG. 51.

In a system provided with an airflow meter for detecting an intake air volume, intake air volumes are cumulated over a predetermined period of time of typically 1 s following a start of the engine 11 to find a cumulative intake air volume. When this cumulative intake air volume becomes at least equal to a predetermined criterion value KGA, the condition for determination of completion of oil replenishment is considered to be satisfied. Since this cumulative intake air volume is a parameter reflecting the engine speed ΣNE cumulated after a start of the engine 11 and, hence, reflecting the post-start cumulative oil flow amount of the oil pump 20, a cumulative intake air volume at least equal to a predetermined criterion value KGA indicates that the oil pressure has increased to a value in a proper range. The predetermined criterion value KGA can be a fixed value. For instance, the predetermined criterion value KGA is set at 900 g/s. As an alternative, the predetermined criterion value KGA is changed in accordance with the cooling-water temperature Tw. For example, a table shown in FIG. 52 or an equation is used for selecting a predetermined criterion value KGA that is suitable for a cooling-water temperature Tw. As another alternative, a basic criterion value KGAB is multiplied by a correction coefficient CEG changed in accordance with the engine-stopped-state time RES to result in a product used as a final criterion value KGA as follows:

$$KGA=CEG\times KGAB$$

A map similar to that shown in FIG. 52 can be used for selecting a basic criterion value KGAB that is suitable for a cooling-water temperature Tw.

In a system provided with an intake-pressure sensor, the condition for determination of completion of oil replenishment can be considered to be satisfied when an intake pressure cumulated after a start of the engine 11 becomes at least equal to a predetermined criterion value KPM. The cumulative intake pressure is obtained by cumulating intake pressures over a predetermined period of typically 1 second following a start of the engine 11. Much like the cumulative intake air volume, the cumulative intake pressure is a parameter reflecting the post-start cumulative oil flow amount of the oil pump 20. For this reason, when the cumulative intake pressure becomes at least equal to the predetermined criterion value KPM, the oil pressure of the oil-pressure circuit may be determined to have increased to a value in the proper range. For instance, the criterion value KPM can be set at a fixed value of 12,000 mm Hg. As an alternative, the criterion value KPM is set in accordance with the cooling-water temperature Tw. For example, a table shown in FIG. 53 or an equation is used or selecting a criterion value KPM that is suitable for a cooling-water temperature Tw. As another alternative, a basic criterion value KPMB is multiplied by a correction coefficient CEP changed in accordance with the engine-stopped-state time RES to result in a product used as a final criterion value KPM as follows:

$$KPM=CEP\times KPMB$$

A map similar to that shown in FIG. 53 can be used for selecting a basic criterion value KPMB that is suitable for a cooling-water temperature Tw.

The condition for determination of completion of oil replenishment can be considered to be satisfied when a post-start cumulative oil flow amount of the oil pump 20 becomes at least equal to a predetermined criterion value KOIL. When the cumulative oil flow amount becomes at least equal to the predetermined criterion value KOIL, the oil pressure of the oil-pressure circuit may be determined to have increased to a value in the proper range. For example, the criterion value KOIL can be set at a fixed value of 15 litters. As an alternative, the criterion value KOIL is set in accordance with the cooling-water temperature Tw. For example, a table shown in FIG. 54 or an equation is used or selecting a criterion value KOIL that is suitable for a cooling-water temperature Tw. As another alternative, a basic criterion value KOILB is multiplied by a correction coefficient CEL changed in accordance with the engine-stopped-state time RES to result in a product used as a final criterion value KOIL as follows:

$$KOIL=CEL\times KOILB$$

A map similar to that shown in FIG. 54 can be used for selecting a basic criterion value KOILB that is suitable for a cooling-water temperature Tw.

The condition for determination of completion of oil replenishment can be considered to be satisfied when the discharge pressure of the oil-pressure control valve 21 becomes at least equal to a predetermined criterion value of typically 20 kPa. This is because there is a relation indicating that, as the discharge pressure of the oil-pressure control valve 21 rises, the oil pressure of the oil-pressure circuit employed in the variable valve timing apparatus 18 also increases as well.

In addition, the condition for determination of completion of oil replenishment can be considered to be satisfied when the mileage after a start of the engine 11 becomes at least equal to a predetermined criterion value. Much like the engine speed cumulated after a start of the engine 11, the mileage after a start of the engine 11 is a parameter reflecting the post-start cumulative oil flow amount of the oil pump 20. Thus, the oil pressure of the oil-pressure circuit can be determined to have increased to a value in a proper range.

The processing carried out by the fourteenth embodiment to detect an abnormality as described above is combined with the control to heat the catalyst at an early time. The processing can be applied to a large number of systems in which control is executed after completion of a start of the engine to advance or retard the valve timing of the intake valve.

Even though the apparatus implemented by each of the first to fourteenth embodiments described above are each an apparatus for the intake valve, the characteristics of the first to fourteenth embodiments can also be applied to the exhaust valve as well. The apparatus implemented by each of the first to fourteenth embodiments covers a wide range of variable-valve apparatus that each change the intake and/or operating quantities of exhaust valves such as the lift amount and the working angle. The apparatus implemented by the first to fourteenth embodiments can be used by combining any of them with any of the others.

In addition, the domain of the present invention is not limited to the variable valve apparatus of an engine. For example, the present invention can also be applied to a broad range of control apparatus for controlling an object having a non-linear control characteristic including a dead band as a portion of its control area.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A method of controlling a control object having a non-linear control characteristic including a dead band, which exhibits a slow response or all but no response to a change in control signal, as a portion of a control area, the method comprising vibrating the control signal at a predetermined amplitude when the control signal is within the dead band so that the predetermined amplitude extends over an area within the dead band as well as beyond limits of the dead band.

2. The method according to claim 1, wherein the predetermined amplitude of the vibrating control signal is at least equal to half the width of the dead band when the control signal is within the dead band.

3. The method according to claim 1, wherein the predetermined amplitude of vibration of the control signal is beyond limits of the dead band even if the center of vibration of the control signal is proximate to the center of the dead band.

4. A control apparatus for controlling a control object having an operational dead band, the control apparatus outputting a control signal that vibrates at a predetermined amplitude when the control signal is within the dead band so that the predetermined amplitude extends over an area within the dead band as well as beyond limits of the dead band even if the center of vibration of the control signal is proximate to the center of the dead band.

5. The control apparatus according to claim 4, wherein the control apparatus vibrates the control signal at an amplitude at least equal to half the width of the dead band when the control signal is within the dead band.

6. A method of controlling a control object having an operational dead band, the method comprising vibrating a control signal provided to the control object at a predetermined amplitude when the control signal is within the dead band so that the predetermined amplitude extends over an area within the dead band as well as beyond limits of the dead band even if the center of vibration of the control signal is proximate to the center of the dead band.

7. The method according to claim 6, wherein the predetermined amplitude is at least equal to half the width of the dead band.

8. A control apparatus for controlling a control object having a non-linear control characteristic including a dead band, which exhibits a slow response or all but no response to a change in control signal, as a portion of a control area, the control apparatus comprising a vibration means for vibrating the control signal at a predetermined amplitude when the control signal is within the dead band so that the predetermined amplitude extends over an area within the dead band as well as beyond limits of the dead band.

9. The control apparatus according to claim 8, wherein the vibration means vibrates the control signal at an amplitude at least equal to half the width of the dead band when the control signal is within the dead band.

10. The control apparatus according to claim 8, wherein the predetermined amplitude of vibration of the control signal is beyond limits of the dead band even if the center of vibration of the control signal is proximate to the center of the dead band.

11. A control apparatus comprising:

a variable valve apparatus for changing a valve variable quantity of at least one of an intake valve and exhaust valve of an engine;

an oil-pressure control valve for adjusting an oil pressure for driving the variable valve apparatus; and a control means for outputting a control signal for controlling the oil-pressure control valve;

wherein the oil-pressure control valve has a non-linear control characteristic including a dead band, which exhibits a slow response or all but no response to a change in the control signal, as a portion of a control area, and the control means has a vibration means for vibrating the control signal at a predetermined amplitude when the control signal is within the dead band.

12. The control apparatus according to claim 11, wherein the vibration means vibrates the control signal at an amplitude at least equal to half the width of the dead band when the control signal is within the dead band.

13. The control apparatus according to claim 11, wherein the vibration means changes the amplitude of the control signal in accordance with a parameter having a correlation with the dead band.

14. The control apparatus according to claim 13, wherein the parameter having a correlation with the dead band is at least one of an oil temperature, an engine temperature, an oil pressure and an engine speed or a parameter having a correlation with at least one of the oil temperature, the engine temperature, the oil pressure and the engine speed.

15. The control apparatus according to claim 11, wherein the vibration means changes the amplitude of the control signal in accordance with a vibration center value of the control signal.

16. The control apparatus according to claim 15, wherein the vibration means decreases the amplitude of the control signal by a quantity proportional to a distance between the vibration center value of the control signal and the dead band.

17. The control apparatus according to claim 11, wherein the vibration means vibrates the control signal if a vibration center value of the control signal exists in a predetermined control area including the dead band, but stops vibration of the control signal if the vibration center value of the control signal exists outside the predetermined control area.

18. The control apparatus according to claim 11, wherein the vibration means corrects the amplitude of the control signal so as to converge the valve variable quantity to a target value of the valve variable quantity if the target value of the valve variable quantity is not changed.

19. The control apparatus according to claim 18, further comprising:

a dead-band-learning means for finding a width of the dead band by gradually reducing the amplitude of the control signal with the valve variable quantity vibrating to accompany vibration of the control signal, recognizing a specific amplitude of the control signal as the valve variable quantity ceases from vibrating, and determining a width of the dead band based on the specific amplitude; or a dead-band-learning means for finding a width of the dead band by gradually increasing the amplitude of the control signal with the valve variable quantity held in a non-vibratory state, recognizing a specific amplitude of the control signal as the valve variable quantity starts to vibrate, and determining a width of the dead band based on the specific amplitude.

20. The control apparatus according to claim 11, wherein the vibration means corrects the amplitude of the control signal so as to change the valve variable quantity by at least a predetermined quantity in a direction toward a target value of the valve variable quantity if the target value of the valve variable quantity is changed.

21. The control apparatus according to claim 11, further comprising for finding a width of the dead band by carrying out a learning process based on the previous vibration of the control signal and the previous vibration center value of the control signal, which are observed as the valve variable quantity starts to change in a direction toward a target value of the valve variable quantity when the target value of the valve variable quantity is changed.

22. The control apparatus according to claim 11, wherein the vibration means changes the vibration frequency in accordance with at least one of an oil temperature, an engine temperature, an oil pressure and an engine speed or a parameter having a correlation with at least one of the oil temperature, the engine temperature, the oil pressure and the engine speed.

23. The control apparatus according to claim 11, wherein the vibration means ceases from vibrating the control signal when the valve variable quantity has been converged to a target value of the variable quantity.

24. The control apparatus according to claim 11, wherein the predetermined amplitude of vibration of the control signal is beyond limits of the dead band even if the center of vibration of the control signal is proximate to the center of the dead band.

25. A control apparatus for controlling a control object having a non-linear control characteristic including a dead band, which exhibits a slow response or all but no response to a change in control signal, as a portion of a control area, the control apparatus calculating the control signal in order to control the control object according to an operating condition thereof and the control apparatus comprising a vibration means for vibrating the control signal at a predetermined amplitude when the control signal is within the dead band, the center of vibration of the control signal being calculated by the control apparatus in advance.

26. A method of controlling a control object having a non-linear control characteristic including a dead band, which exhibits a slow response or all but no response to a change in control signal, as a portion of a control area, the method comprising calculating the control signal in order to control the control object according to an operating condition thereof, and vibrating the control signal at a predetermined amplitude when the control signal is within the dead band, the center of the vibration of the control signal being calculated in advance.

27. A control apparatus for controlling a control object having an operational dead band, the control apparatus calculating a control signal of the control object according to an operating condition thereof, and vibrating the control signal at a predetermined amplitude when the control signal is within the dead band so that the predetermined amplitude extends over an area within the dead band as well as beyond limits of the dead band even if the center of vibration of the control signal is proximate to the center of the dead band, the center of vibration of the control signal being calculated in advance.

28. A method of controlling a control object having an operational dead band, the method comprising calculating a control signal of the control object according to an operating condition thereof, and vibrating the control signal provided to the control object at a predetermined amplitude when the control signal is within the dead band so that the predetermined amplitude extends over an area within the dead band as well as beyond limits of the dead band even if the center of vibration of the control signal is proximate to the center of the dead band, the center of vibration of the control signal being calculated in advance.

29. A method comprising:

providing a variable valve apparatus for changing a valve variable quantity of at least one of an intake valve and exhaust valve of an engine;

providing an oil-pressure control valve for adjusting an oil pressure for driving the variable valve apparatus; and outputting a control signal for controlling the oil-pressure control valve;

wherein the oil-pressure control valve has a non-linear control characteristic including a dead band, which exhibits a slow response or all but no response to a change in the control signal; as a portion of a control area, and the control signal is vibrated at a predetermined amplitude when the control signal is within the dead band.

30. The method according to claim 29, wherein the predetermined amplitude of the vibrating control signal is at least equal to half the width of the dead band when the control signal is within the dead band.

31. The method according to claim 29, wherein the predetermined amplitude of vibration of the control signal is beyond limits of the dead band even if the center of vibration of the control signal is proximate to the center of the dead band.

32. The method according to claim 29, wherein the amplitude of the control signal is vibrated in accordance with a vibration center value of the control signal.

33. The method according to claim 32, wherein the amplitude of the control signal is decreased by a quantity proportional to a distance between the vibration center value of the control signal and the dead band.

* * * * *